US005656134A

United States Patent [19]

Marinack et al.

[11] Patent Number: 5,656,134

[45] Date of Patent: Aug. 12, 1997

[54] BIAXIALLY UNDULATORY TISSUE AND CREPING PROCESS USING UNDULATORY BLADE

[75] Inventors: Robert J. Marinack, Oshkosh; Anthony O. Awofeso, Appleton; Frank D. Harper; Thomas N. Kershaw, both of Neenah, all of Wis.

[73] Assignee: James River Corporation of Virginia, Richmond, Va.

[21] Appl. No.: 532,120

[22] Filed: Sep. 22, 1995

Related U.S. Application Data

[60] Division of Ser. No. 359,318, Dec. 16, 1994, which is a continuation-in-part of Ser. No. 320,711, Oct. 11, 1994.

[51] Int. Cl.[6] ..... B31F 1/12

[52] U.S. Cl. ..... 162/281

[58] Field of Search ..... 162/109, 111, 162/112, 113, 281, 282; 264/281, 282; 425/369; 15/256.51

[56] References Cited

U.S. PATENT DOCUMENTS

| | | | |
|---|---|---|---|
| 1,548,783 | 8/1925 | Lorenz | 162/113 |
| 1,571,593 | 2/1926 | Lorenz | 162/113 |
| 1,582,842 | 4/1926 | Lorenz | 162/113 |
| 1,588,732 | 6/1926 | Hoberg | 162/281 |
| 3,163,575 | 12/1964 | Nobbe | 162/281 |
| 3,507,745 | 4/1970 | Fuerst | 162/281 |

FOREIGN PATENT DOCUMENTS

| | | | |
|---|---|---|---|
| 615517 | 1/1961 | Italy | 162/281 |
| 389832 | 3/1933 | United Kingdom | 162/113 |
| 456032 | 11/1936 | United Kingdom | 162/113 |
| 827735 | 2/1960 | United Kingdom | 162/113 |

*Primary Examiner*—Peter Chin

[57] ABSTRACT

The present invention relates to biaxially undulatory single-ply and multi-ply tissues, single-ply and multi-ply towels, single-ply and multi-ply napkins and other personal care and cleaning products as well as novel creping blades and novel processes for the manufacture of such paper products. The present invention is directed to tissue and towel product having highly desirable bulk, appearance and softness characteristics produced by utilizing a novel undulatory creping blade having a multiplicity of serrulations formed in its rake surface which presents differentiated creping angles and/or rake angles to the web as it is being creped. The invention is also directed to a novel blade having an undulatory rake surface having trough-shaped serrulations in the rake surface of the blade. The undulatory creping blade has a multiplicity of alternating serrulated sections of either uniform depth or a multiplicity of arrays of serrulations having non-uniform depth.

3 Claims, 61 Drawing Sheets

Undulatory blade has 50 degree bevel,
16 undulations/inch, 0.030" undulation depth
Products embossed at 0.080" depth

BIAXIALLY UNDULATORY TISSUE AND CREPING PROCESS USING UNDULATORY BLADE

RELATED APPLICATIONS

This is a division of application Ser. No. 08/359,318, filed Dec. 16, 1994, which is a Continuation-in-Part of Ser. No. 08/320,711, filed on Oct. 11, 1994.

Tissue products are commonly produced by depositing cellulosic fibers suspended in water on a moving foraminous support to form a nascent web, removing water from the nascent web, adhering the dewatered web to a heated cylindrical Yankee dryer, and then removing the web from the Yankee with a creping blade which, in conventional processes, imparts crepe ridges extending generally transversely across the sheet, the machine direction, frequency of these crepe bars ranging from about 10 to about 150 crepe bars per inch of tissue. Tissues produced in this conventional fashion may often be considered lacking in bulk, appearance and softness and so require additional processing after creping, particularly when produced using conventional wet pressing technology. Tissues produced using the through air drying technique normally have sufficient bulk but may have an unattractive appearance. To overcome this, an overall pattern is imparted to the web during the forming and drying process by use of a patterned fabric having proprietary designs to enhance appearance that are not available to all producers. Further, through air dried tissues can be deficient in surface smoothness and softness unless strategies such as calendering, embossing and stratification of low coarseness fibers on the tissue's outer layers are employed in addition to creping. Conventional tissues produced by wet pressing are almost universally subjected to various post-processing treatments after creping to impart softness and bulk. Commonly such tissues are subjected to various combinations of both calendering and embossing to bring the softness and bulk parameters into acceptable ranges for premium quality products. Calendering adversely affects bulk and may raise tensile modulus, which is inversely related to tissue softness. Embossing increases product caliper and can reduce modulus, but lowers strength and can hurt surface softness. Accordingly, it can be appreciated that these processes can have adverse effects on strength, appearance, surface smoothness and particularly thickness perception since there is a fundamental conflict between bulk and calendering.

FIELD OF THE INVENTION

The present invention is directed to tissue having highly desirable bulk, appearance and softness characteristics produced by a process utilizing a novel undulatory creping blade having a multiplicity of serrulations formed in its rake surface which presents differentiated creping angles and/or rake angles to the web as it is being creped. The invention is also directed to a novel blade having an undulatory rake surface having trough-shaped serrulations in the rake surface of the blade. The undulatory creping blade preferably has a multiplicity of alternating serrulated creping sections of either uniform depth or a multiplicity of arrays of serrulations having non-uniform undulatory depth. The present invention also relates to biaxially undulatory single-ply and multi-ply tissues, single-ply and multi-ply towels, single-ply and multi-ply napkins and other personal care and cleaning products as well as novel creping blades and the novel processes for producing such products.

DESCRIPTION OF BACKGROUND ART

Paper is generally manufactured by dispersing cellulosic fiber in an aqueous medium and then removing most of the liquid. The paper derives some of its structural integrity from the mechanical interlocking of the cellulosic fibers in the web, but most by far of the paper's strength is derived from hydrogen bonding which links the cellulosic fibers to one another. With paper intended for use as bathroom tissue, the degree of strength imparted by this inter-fiber bonding, while necessary to the utility of the product, can result in a lack of perceived softness that is inimical to consumer acceptance. One common method of increasing the perceived softness and cushion of bathroom tissue is to crepe the paper. Creping is generally effected by fixing the cellulosic web to a Yankee drier with an adhesive/release agent combination and then scraping the web off the Yankee by means of a creping blade. Creping, by breaking a significant number of inter-fiber bonds, adds to and increases the perceived softness of resulting bathroom tissue product. However, creping with a conventional blade alone may not be sufficient to impart the desired combinations of softness, bulk and appearance.

We have discovered that tissue having highly desirable bulk, appearance and softness characteristics, can be produced by a process similar to conventional processes, particularly conventional wet pressing, except that the conventional creping blade is replaced with an undulatory creping blade presenting differentiated creping and rake angles to the sheet and having a multiplicity of spaced serrulated creping sections of either uniform depths or non-uniform arrays of depths. The depths of the undulations are above about 0.008 inches.

Techniques for creping of tissue and towel weight papers using patterned or non-uniform creping blades are known but these known techniques rather than being suitable for production of premium quality bath tissue, facial tissue or kitchen toweling, have been suggested for, and seem more suited for, production of wadding or insulating papers or other extremely coarse papers.

Three references of interest are Fuerst, U.S. Pat. No. 3,507,745; B. D. Nobbe, U.S. Pat. No. 3,163,575; and possibly British Patent 456,032. Fuerst, U.S. Pat. No. 3,507,745, suggests use of a highly beveled blade which has square shouldered notches formed into the rake surface. This type of a blade is said to be suitable for producing very high bulk for cushioning and insulation purposes but, in our opinion, is not suitable for premium quality towel and tissue products. The depth of the Fuerst blades' notches are only about 0.0015 inches to 0.007 inches.

Nobbe, U.S. Pat. No. 3,163,575, describes a doctor blade for differentially creping sheets from a drum to produce a product which is quite similar to that of the Fuerst patent. The Nobbe patent describes a blade with a relatively flat bevel angle into which notches have been cut, defining regions having a very large bevel angle. The crepe in the portions of the sheet that contact the notched portions of the blade will have quite a coarse crepe or no crepe, while the areas of the sheet that contact the unnotched blade portions will have a fine crepe.

In the Fuerst patent, the unmodified blade has a very large bevel angle, with portions of its creping edge being flattened to produce a surface that results in fine crepe in the portion of the sheet that contact this surface. The portions of the sheet that contact the unmodified sections of the blade will have very coarse crepe, thus giving an appearance of having almost no crepe. Our experience suggests that neither the Nobbe nor the Fuerst blades are suitable for the manufacture of commercially acceptable premium quality tissue and towel products.

Pashley, British Patent 456,032, teaches creping of a sheet from a drum using a creping blade whose edge has been serrated in a sawtooth pattern, the teeth being about one-eight (0.125) inch deep and numbering about 8 to the inch. The distance from tip to base of these teeth is about 2 to about 25 times the depth of the undulations that are cut into the present crepe blade. The product described in the Pashley patent has crepe that is much coarser and more irregular than the crepe of a product made using conventional creping technology. While this type of product may hold some advantages in the manufacture of crepe wadding, a product having such a coarse crepe would not normally be considered acceptable for use in premium tissue and towel products.

What has been needed is a simple, reliable process for creping tissue weight substrates to produce desirable products having higher caliper at lower basis weight than are produced in processes using a conventional creping blade. Products made using the creping procedure of the present invention will have a crepe fineness similar to that of conventionally-made tissue sheets but the resulting web combines crepe bars extending in the cross direction with undulations extending in the machine direction.

SUMMARY OF THE INVENTION

We have discovered that tissue having highly desirable bulk, appearance and softness characteristics, can be produced by a process similar to conventional processes, particularly conventional wet pressing, by replacing the conventional creping blade with an undulatory creping blade having a multiplicity of serrulated creping sections presenting differentiated creping and rake angles to the sheet. The depth of the undulations is preferably above about 0.008 inches, more preferably between about 0.010 inches and about 0.040 inches. Further, in addition to imparting desirable initial characteristics directly to the sheet, the process of the present invention produces a sheet which is more capable of withstanding calendering without excessive degradation than a conventional wet press tissue web. Accordingly, using this creping technique it is possible to achieve overall processes which are more forgiving and flexible than conventional existing processes. In particular, the overall processes can be used to provide not only desirable premium products including high softness tissues and towels having surprisingly high strength accompanied by high bulk and absorbency, but also to provide surprising combinations of bulk, strength and absorbency which are desirable for lower grade commercial products. For example, in commercial (away-from-home) toweling, it is usually considered important to put quite a long length of toweling on a relatively small diameter roll. In the past, this has severely restricted the absorbency of these commercial toweling products as absorbency suffered severely from the processing used to produce toweling having limited bulk, or more precisely, the processing used to increase absorbency also increased bulk to a degree which was detrimental to the intended application. The process of the present invention makes it possible to achieve surprisingly high absorbency in a relatively non-bulky towel thus providing an important new benefit to this market segment. Similarly, many webs of the present invention can be calendered more heavily than many conventional webs while still retaining bulk and absorbency, making it possible to provide smoother, and thereby softer feeling, surfaces without unduly increasing tensile modulus or unduly degrading bulk. On the other hand, if the primary goal is to save on the cost of raw materials, the tissue of the present invention can have surprising bulk at a low basis weight without an excessive sacrifice in strength or at low percent crepe while maintaining high caliper. Accordingly, it can be appreciated that the advantages of the present invention can be manipulated to produce novel products having many combinations of properties which previously were somewhat impractical.

Further, it appears that the process producing these advantages is at least comparable in runnability and forgivingness to conventional creping processes and may be run on equipment adapted to use conventional creping blades as the undulatory creping blades of the present invention will fit into conventional holders and will operate at roughly equivalent holder angles. The life of the preferred undulatory blades seems to be at least about the same as the life expected with conventional blades. At this time, preliminary results indicate that the life of preferred undulatory creping blades according to the present invention could possibly even be significantly greater than the life of a conventional blade, although, to be able to claim this definitively would require a substantial amount of commercial operating data which are, of course, simply not available. Preliminary data also indicate that care must be taken in operating the undulatory creping blade to collect dust formed.

In contrast to conventional tissues having creping bars generally running transversely, the tissue of the present invention has a biaxially undulatory surface wherein the transversely extending crepe bars are intersected by longitudinally extending undulations imparted by the undulatory creping blade.

BRIEF DESCRIPTION OF THE DRAWINGS

FIGS. 3A, 3B & 3C illustrate a blade made following the teachings of U.S. Pat. No. 3,507,745 (Fuerst) after it has been run in.

FIG. 8 contrasts the creping geometry of the undulatory creping blade with that of the blade disclosed in Fuerst, U.S. Pat. No. 3,507,745.

FIG. 13D showing a biaxially undulatory tissue of the present invention.

FIGS. 14A and 14B illustrate felt and Yankee sides, respectively, wet creped with a conventional blade having a 15° bevel. FIGS. 14C and 14D illustrate felt and Yankee sides, respectively, of sheets wet-creped with an undulatory creping blade with a 15° bevel having 12 undulations/inch, each undulation having a depth of 0.025 inch depth.

In FIG. 56A, the angle between the serrulations of the relief surface is 90°. In FIG. 56B, the serrulations incline upwardly to the tip of the blade, and in FIG. 56C, the serrulations incline downwardly.

DETAILED DESCRIPTION OF THE PREFERRED EMBODIMENTS

Figure 1B:
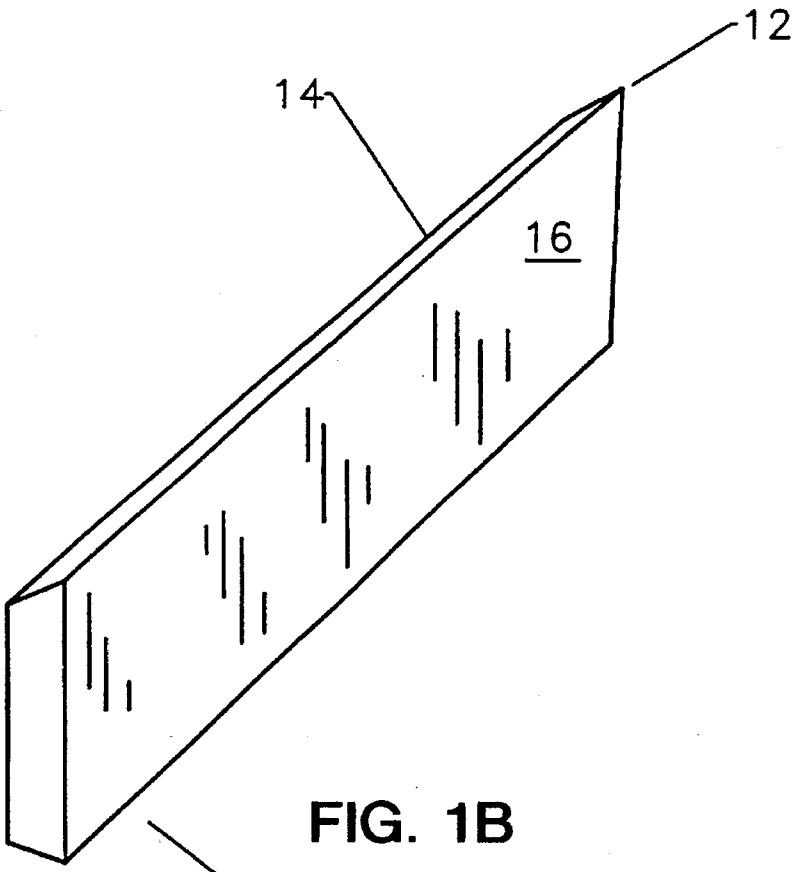
FIGS. 1A, 1B & 1C illustrate three views of a blank for making an undulatory creping blade of the present invention prior to knurling for formation of serrulations in the blade.
Figure 1C:
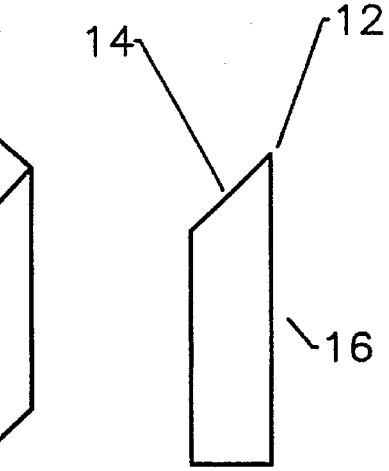
Figure 1A:
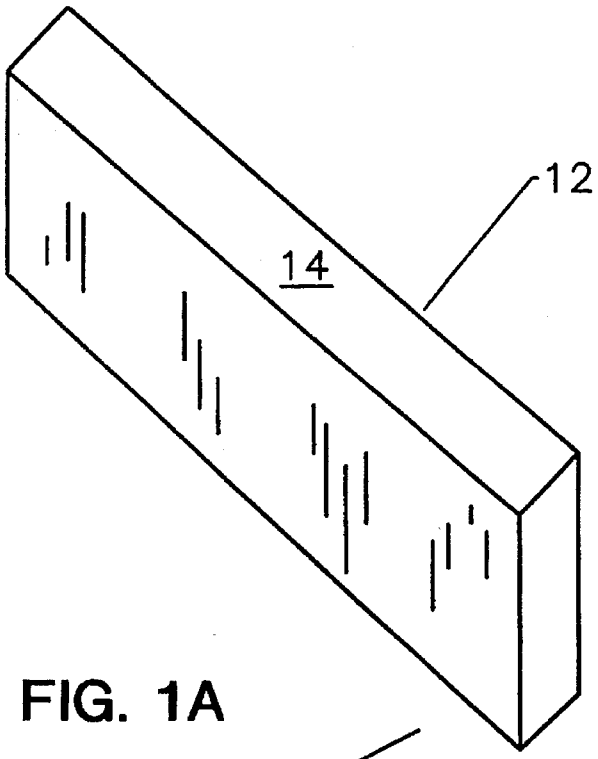

FIGS. 1A–1C illustrate a portion of conventional creping blade 10 which is, in practice, the blank from which undulatory creping blades usable in the practice of the present invention are most conveniently made. In blade 10, contact surface 12 between rake surface 14 and relief surface 16 is indicated by a simple line to indicate the initially narrow width of contact surface 12 before the blade wears.

Figures 2A, 2B, 2C:
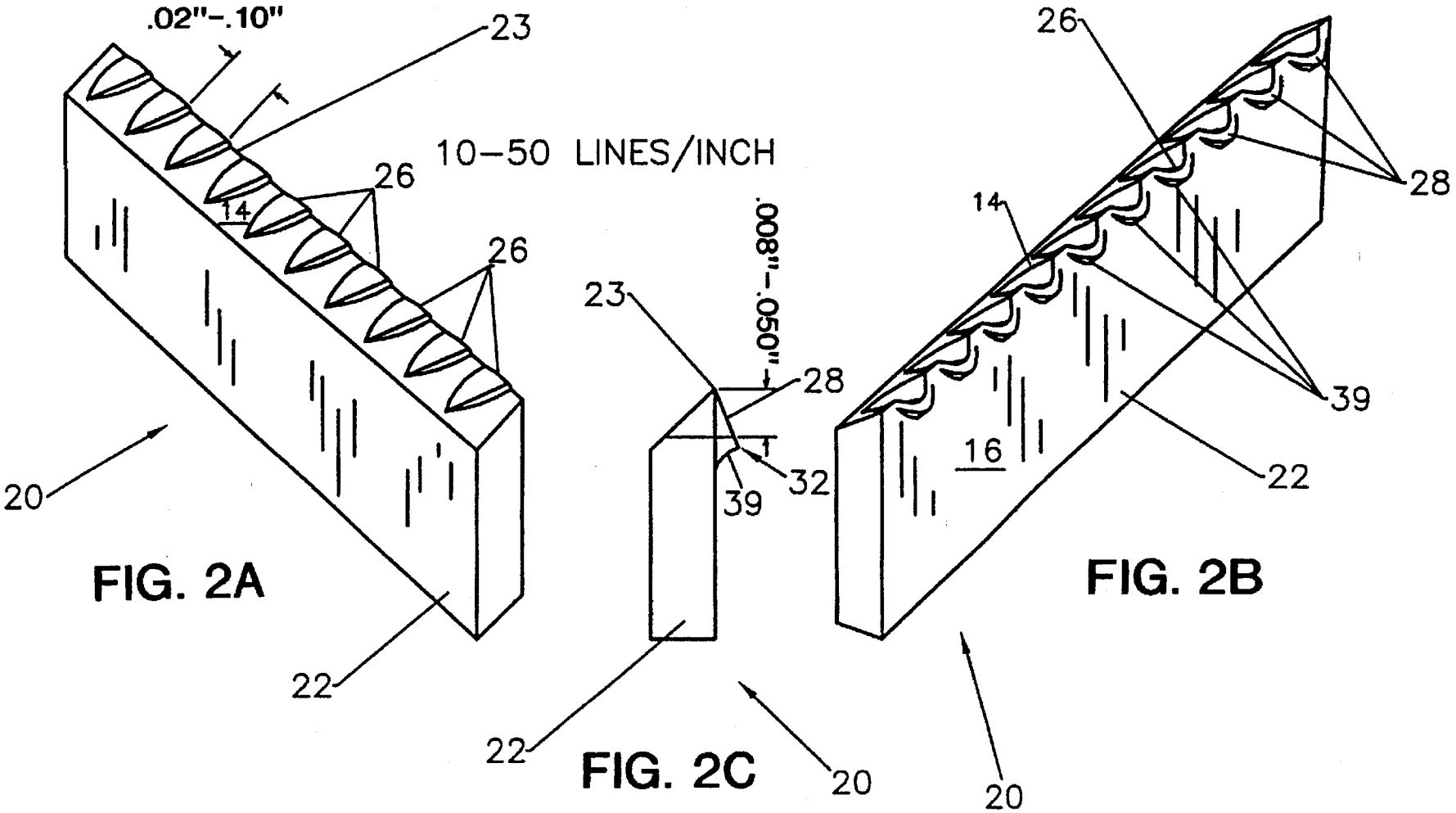
FIGS. 2A, 2B and 2C illustrate perspective views of an undulatory creping blade of the present invention.
Figure 3B:
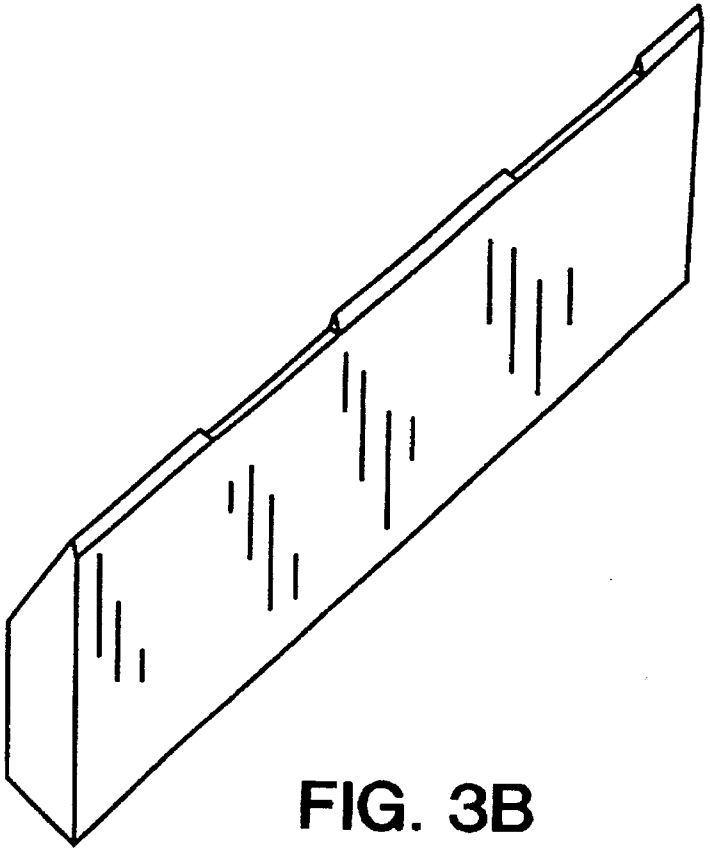
Figure 3C:
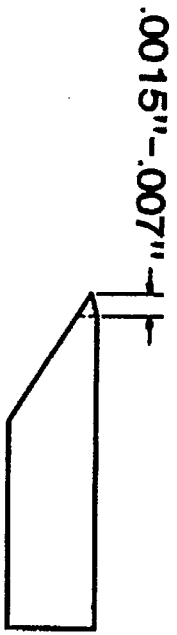
Figure 3A:
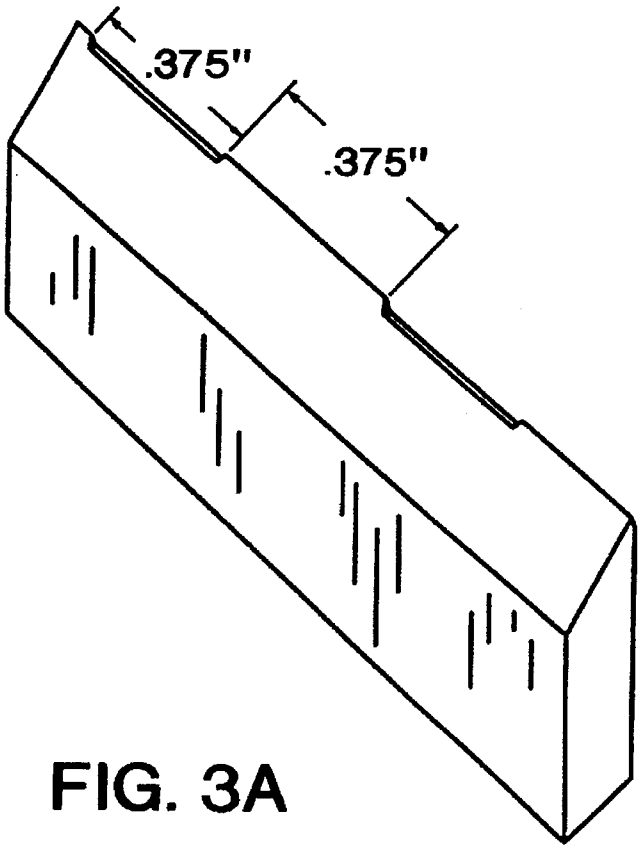

FIGS. 2A and 2B illustrate a portion of a preferred undulatory creping blade 20 usable in the practice of the present invention in which body 22 extends indefinitely in length, typically exceeding 100 inches in length and often reaching over 26 feet in length to correspond to the width of the Yankee dryer on the larger modern paper machines. Flexible blades of the present invention having indefinite length can suitably be placed on a spool and used on machines employing a continuous creping system. In such cases the blade length would be several times the width of the Yankee dryer. In contrast, the width of body 22 of blade 20 is usually on the order of several inches while the thickness of body 22 is usually on the order of fractions of an inch.

Figure 4:
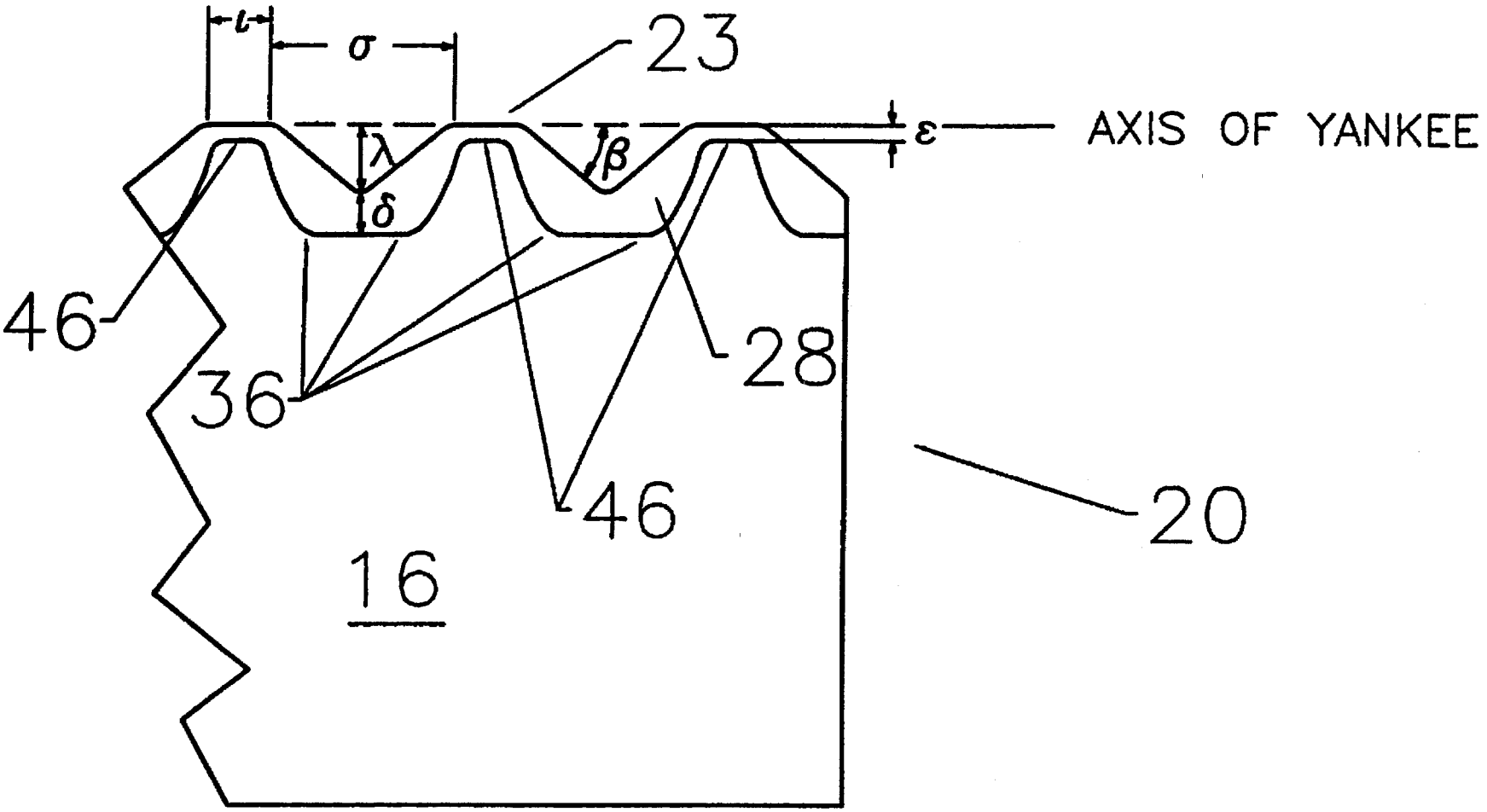
FIG. 4 schematically illustrates the contact region defined between the undulatory creping blade of the present invention and the Yankee.
Figure 6C:
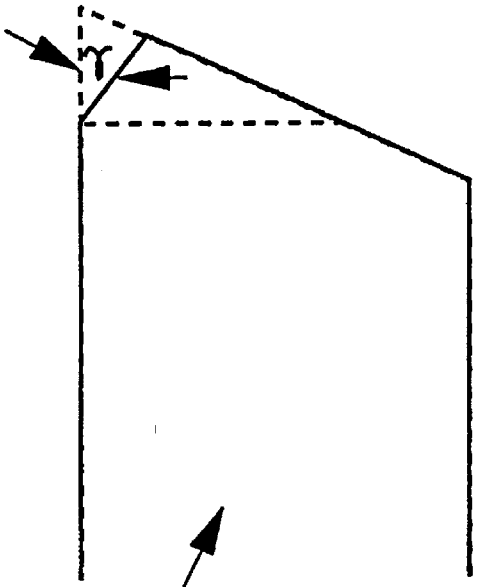
FIG. 6C illustrates what we term a "reverse relieved undulatory creping blade".
Figure 6B:
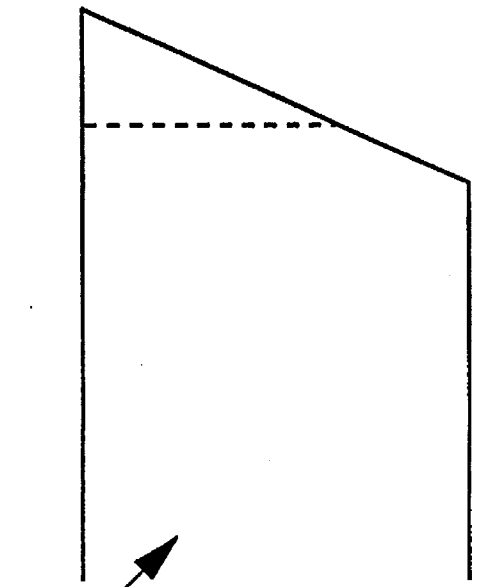
FIG. 6B illustrates what we term a "flush dressed undulatory creping blade".
Figure 6A:
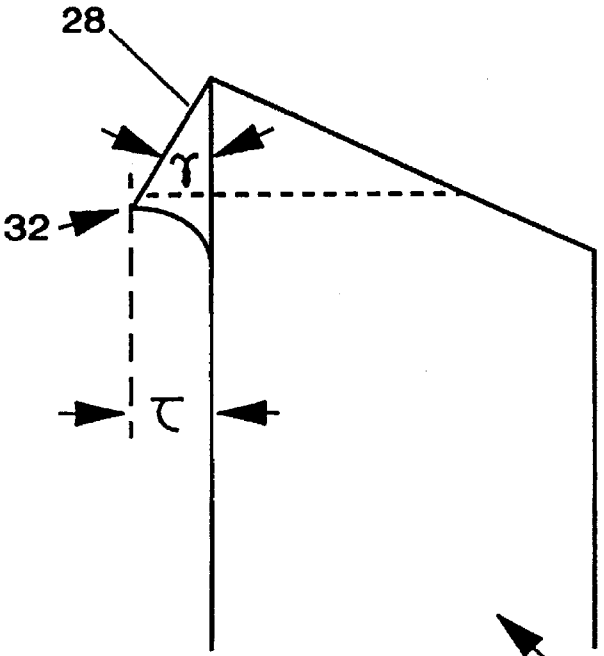
FIG. 6A illustrates an undulatory creping blade wherein the Yankee-side of the undulatory creping blade has been beveled at an angle equal to that of the creping blade or holder angle.
Figure 7:
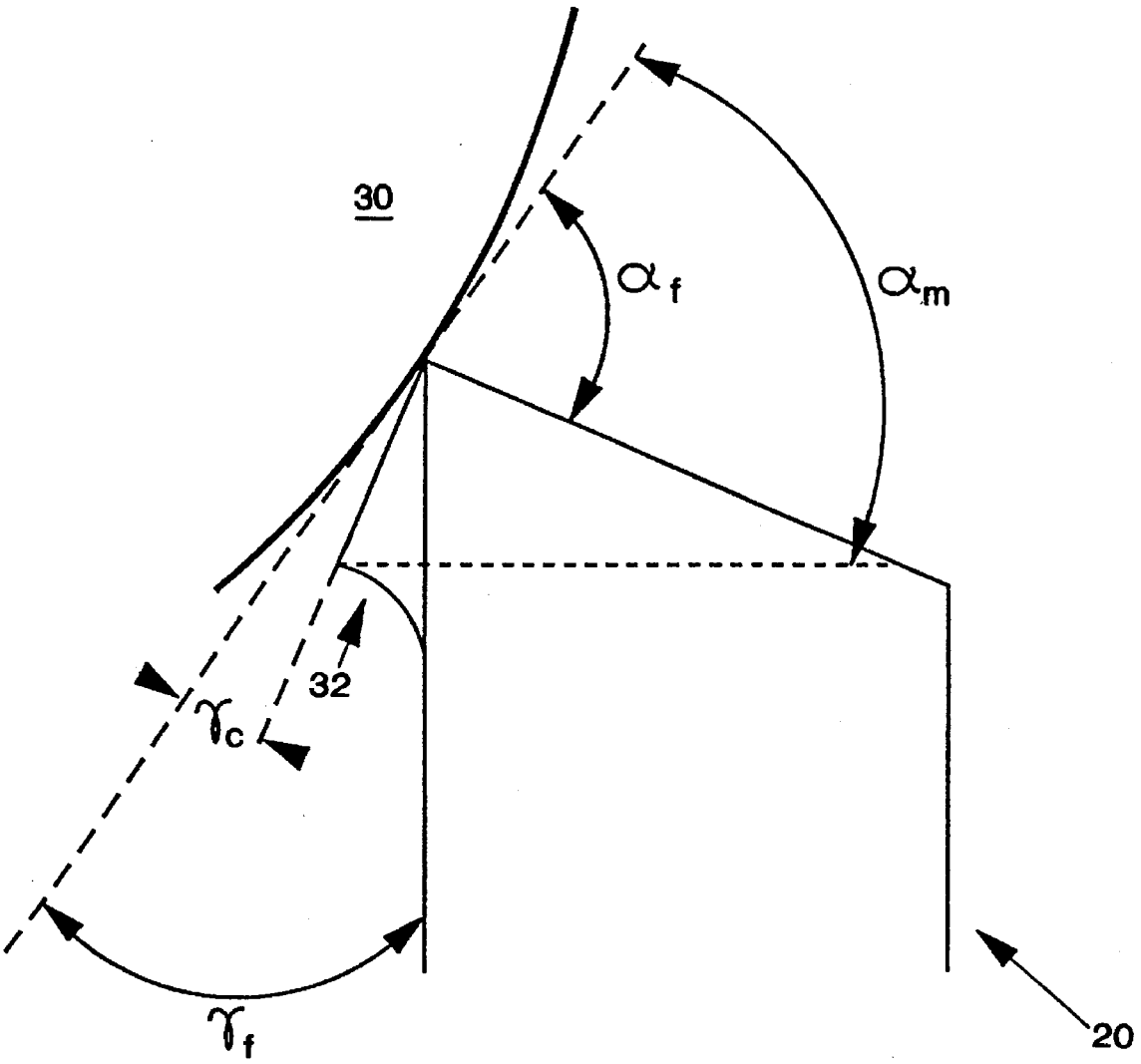
FIG. 7 shows the creping process geometry and illustrates the nomenclature used to define angles herein.
Figure 8B:
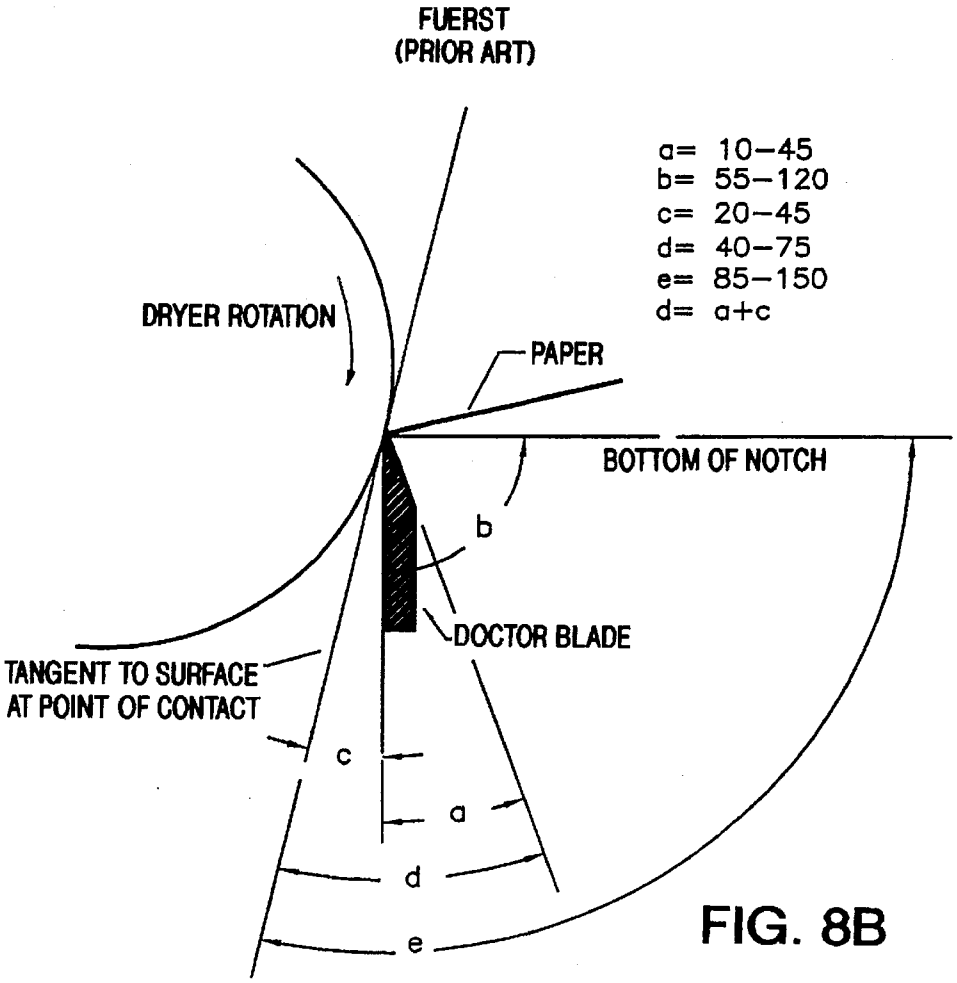
FIG. 8B is a drawing of the blade of Fuerst U.S. Pat. No. 3,507,745 in engagement with a Yankee dryer.
Figure 8A:
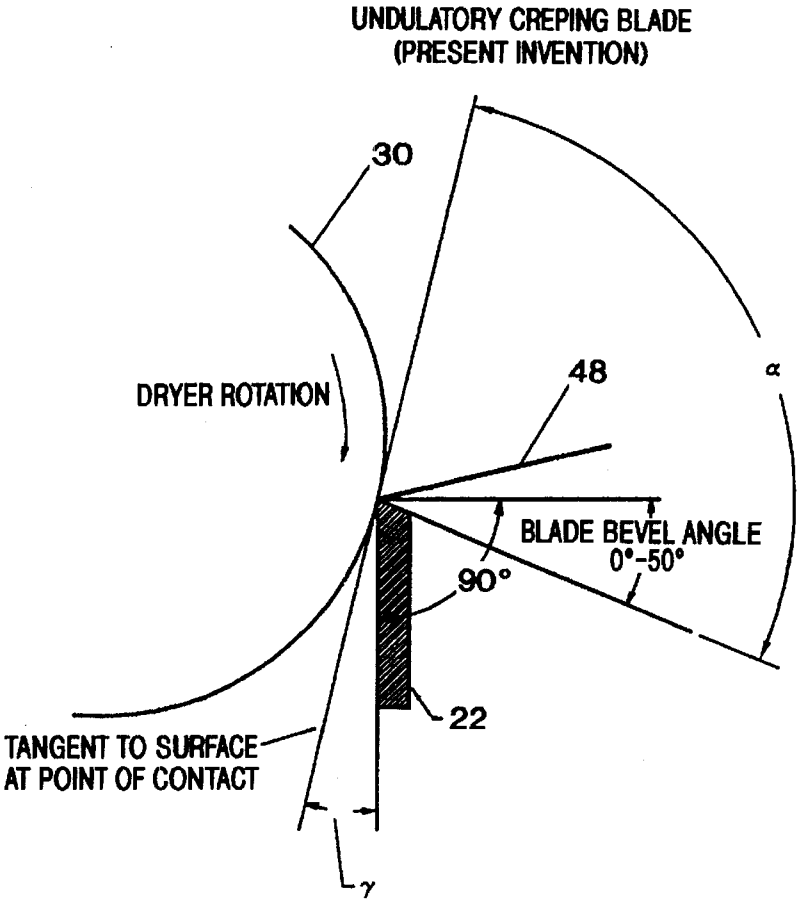
FIG. 8A illustrates the crepe angles and the undulatory blade of the present invention in engagement with the Yankee dryer (30).
Figure 15:
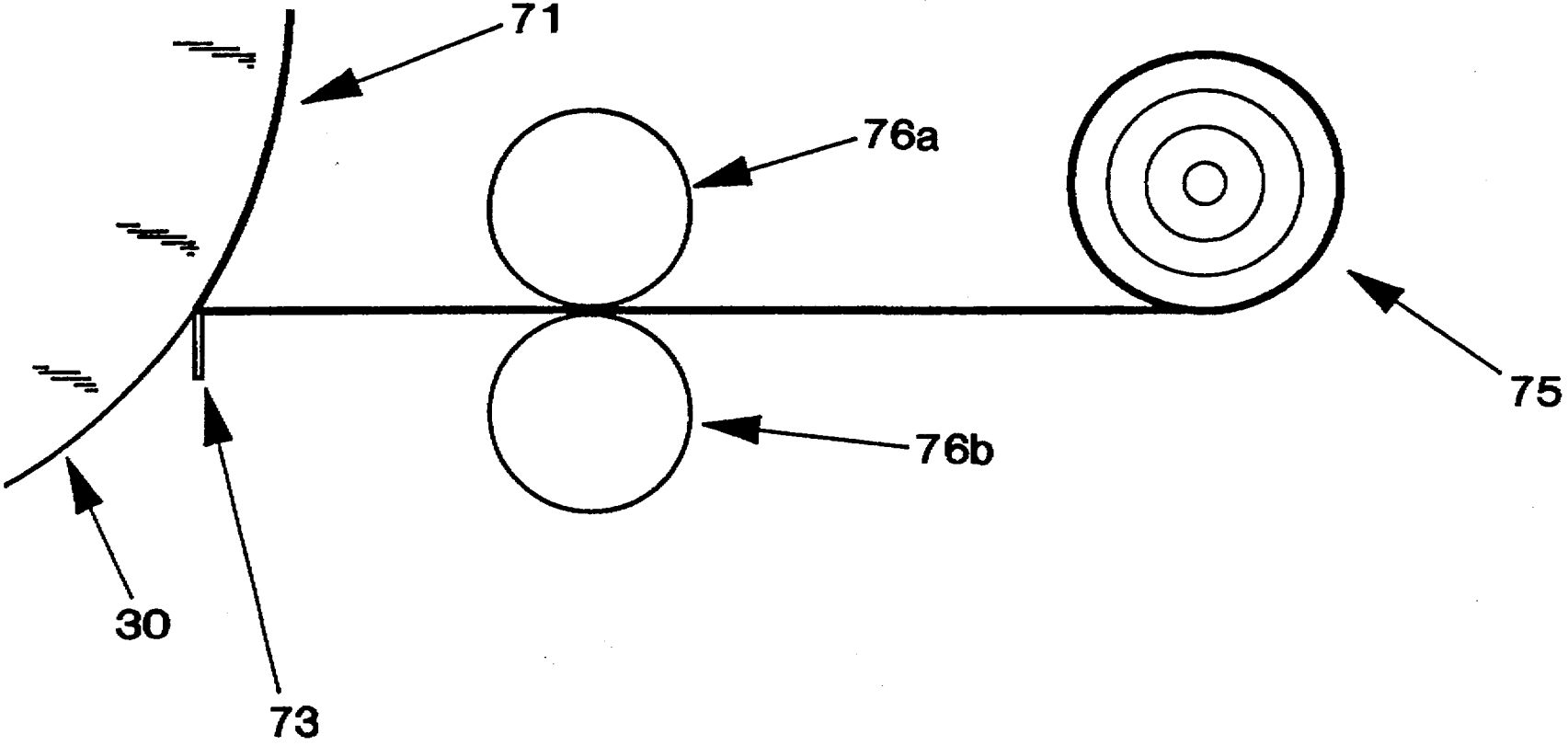
FIG. 15 illustrates the dry crepe process.
Figure 16:
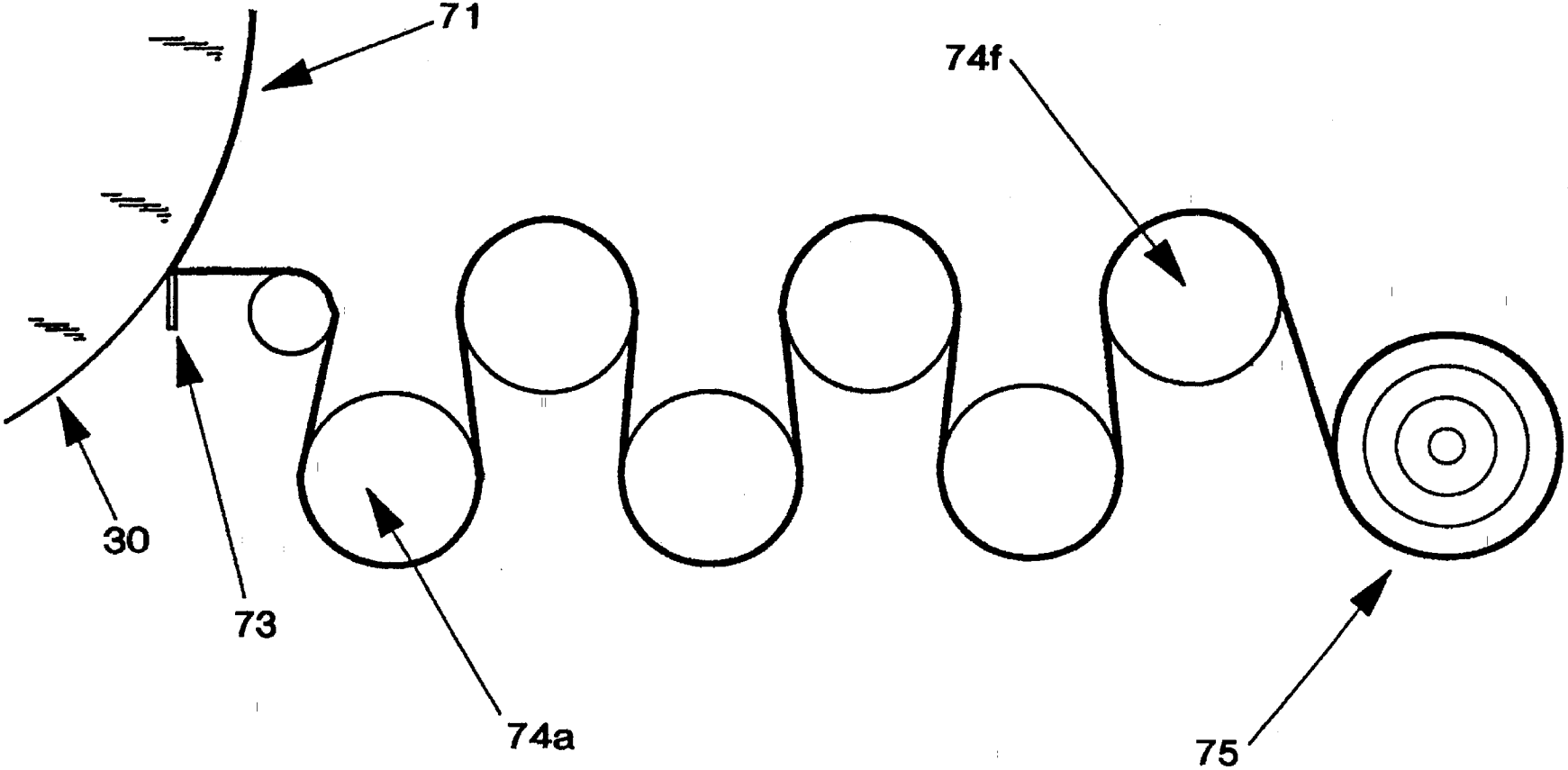
FIG. 16 illustrates the wet crepe process.

As illustrated in FIGS. 2A and 2B, undulatory cutting edge 23 is defined by serrulations 26 disposed along, and formed in, one edge of body 22 so that undulatory engagement surface 28 schematically illustrated in more detail in FIGS. 4, 6 and 7 disposed between rake surface 14 and relief surface 16, engages Yankee 30 during use as shown in FIGS. 8, 15 and 16. Although a definitive explanation of the relative contribution of each aspect of the geometry is not yet available, it appears that four aspects of the geometry have predominant importance. In the most preferred blades 20 of the present invention, four key distinctions are observable between these most preferred blades and conventional blades: the shape of engagement surface 28, the shape of relief surface 16, the shape of rake surface 14, and the shape of actual undulatory cutting edge 23. The geometry of engagement surface appears to be associated with increased stability as is the relief geometry. The shape of undulatory cutting edge 23 appears to strongly influence the configuration of the creped web, while the shape of rake surface 14 is thought to reinforce this influence.

It appears that improved stability of the creping operation is associated with presence of the combination of: (i) undulatory engagement surface 28 having increased engagement area; and (ii) foot 32 defined in relief surface 16 and providing a much higher degree of relief than is usually encountered in conventional creping. This is illustrated in FIGS. 6A, 6B and 6C. FIG. 6A illustrates a preferred blade of the present invention wherein the beveled area engages the surface of the Yankee 30 shown in FIG. 8 in surface-to-surface contact. In FIG. 6B, foot 32 is dressed away so that the Yankee-side of blade 20 is flat and blade 20 engages the surface of the Yankee 30 shown in FIG. 8 in line-to-surface contact. In FIG. 6C, not only has Yankee-side foot 32 been removed but the Yankee-side of blade 20 has been beveled at an angle equal to blade angle $\gamma_f$ as defined in FIG. 7. It appears that combinations of the four primary features greatly increase the beneficial results of use of the preferred undulatory blades 20 of the present invention.

It is also hypothesized that hardening of the blade due to cold working during the knurling process may contribute to improved wear life. Microhardness of the steel at the root of a serrulation can show an increase of 3–5 points on the Rockwell 'C' scale. This increase is believed to be insufficient to significantly increase the degree of wear experienced by the Yankee, but may increase blade life.

It appears that the biaxially undulatory geometry of the creped web is largely associated with presence of: (i) undulatory rake surface 14; and (ii) undulatory cutting edge 23 which both exert a shaping and bulking influence on the creped web.

When the most preferred undulatory creping blades of the present invention are formed, each serrulation 26 results in formation of indented undulatory rake surfaces 34, nearly planar crescent-shaped bands 36, foot 32 and protruding relief surface 39. In FIGS. 2A and 2B, each undulation is shown resulting in two indented undulatory rake surfaces 34 separated by dividing surface 40 corresponding to edge 42 defined in FIG. 53 knurling tool 44. While the presence of dividing surface 40 makes it easy to visualize the nature of indented undulatory rake surface 34, there is no requirement that these surfaces be discontinuous and, indeed, it is expected that, as knurling tool 44 is used repeatedly, edge 42 will become blunted resulting in a single continuous indented undulatory rake surface 34. In our experience, either type of indented undulatory rake surface 34 is suitable. As illustrated best in FIG. 4, undulatory engagement surface 28 consists of a plurality of substantially co-linear rectilinear elongate regions 46 of width "$\epsilon$", and length "l" interconnected by nearly planar crescent-shaped bands 36 of width "$\delta$"; depth "$\lambda$" and span "$\sigma$". As seen best in FIGS. 2B and 2C, each nearly planar crescent-shaped band 36 defines one surface of each relieved foot 32 projecting out of relief surface 16 of body 22 of blade 20. We have found that, for best results, certain of the dimensions of the respective elements defining the undulatory engagement surface 28 i.e., substantially co-linear rectilinear elongate regions 46 and nearly planar crescent-shaped bands 36 are preferred. In particular, width "$\epsilon$" of substantially co-linear rectilinear elongate regions 46 is preferably substantially less than width "$\delta$" of nearly planar crescent-shaped bands 36, at least in a new blade. In preferred embodiments, the length "l" of substantially co-linear rectilinear elongate regions 46 should be from about 0.002" to about 0.084". For most applications, "l" will be less than 0.05". Depth "$\lambda$" of serrulations 26 should be from about 0.008" to about 0.050"; more preferably from about 0.010" to about 0.035" and most preferably from about 0.015" to about 0.030", and span "$\sigma$" of nearly planar crescent-shaped bands 28 should be from about 0.01" to about 0.095"; more preferably from about 0.02" to about 0.08" and most preferably from about 0.03" to about 0.06". In some applications, the undulatory engagement surface 28 can be discontinuous. This can happen if blade 20 is tilted in one of two ways: first, the undulatory engagement surface may consist only of substantially co-linear elongate regions 46 or possibly a combination of substantially co-linear elongate regions 46 and the upper portions of crescent-shaped bands 36 if blade 20 is tilted away from Yankee 30; or second, the undulatory engagement surface may consist of the lower portions of crescent-shaped bands 36 if blade 20 is tilted inwardly with respect to Yankee 30. Both of these configurations do run stably and, in fact, have run satisfactorily for extended periods.

Several angles must be defined in order to describe the geometry of cutting edge of the undulatory blade of the present invention. To that end, we prefer to use the following terms:

creping angle "$\alpha$"—the angle between rake surface 14 of blade 20 and the plane tangent to Yankee 30 at the point of intersection between undulatory cutting edge 23 and Yankee 30;

axial rake angle "$\beta$"—the angle between the axis of Yankee 30 and undulatory cutting edge 23 which is, of course, the curve defined by the intersection of the surface of Yankee 30 with indented rake surface 34 of blade 20;

relief angle "$\gamma$"—the angle between relief surface 16 of blade 20 and the plane tangent to Yankee 30 at the intersection between Yankee 30 and undulatory cutting edge 23, the relief angle measured along the flat portions of the present blade is equal to what is commonly called "blade angle" or "holder angle"; and side rake angle "$\phi$", shown in FIG. 5—the angle between line 40 and the normal to Yankee 30 in the plane defined by the normal to the Yankee at the points of contact in with the cutting edge of the blade (Line 23, FIGS. 2 and 4) and the axis of the Yankee dryer. The Yankee 30 is shown in FIG. 8.

Quite obviously, the value of each of these angles will vary depending upon the precise location along the cutting edge at which it is to be determined. We believe that the remarkable results achieved with the undulatory blades of the present invention are due to those variations in these angles along the cutting edge. Accordingly, in many cases it will be convenient to denote the location at which each of these angles is determined by a subscript attached to the basic symbol for that angle. We prefer to use the subscripts "f", "c" and "m" to indicate angles measured at the rectilinear elongate regions, at the crescent shaped regions and the minima of the cutting edge, respectively. Accordingly, "$\gamma_f$", the relief angle measured along the flat portions of the present blade, is equal to what is commonly called "blade angle" or "holder angle".

For example, as illustrated in FIGS. 7 and 8, the local creping angle "$\alpha$" is defined at each location along undulatory cutting edge 23 as being the angle between rake surface 14 of blade 20 and the plane tangent to Yankee 30. Accordingly, it can be appreciated that as shown in FIGS. 7 and 8, "$\alpha_f$", the local creping angle adjacent to substantially co-linear rectilinear elongate regions 46 is usually higher than "$\alpha_c$", the local creping angle adjacent to nearly planar crescent-shaped bands 36. Further, it can be appreciated that, along the length of nearly planar crescent-shaped bands 36, the local creping angle "$\alpha_c$" varies from higher values adjacent to each rectilinear elongate region 46 to lower values "$\alpha_m$" adjacent the lowest portion of each serrulation 26. Angle "$\alpha_c$", though not specifically labeled in FIG. 7 should be understood to be the creping angle measured at any point on the indented undulatory rake surface 34 (shown in FIG. 5). As such, it will have a value between "$\alpha_f$" and "$\alpha_m$". In preferred blades of the present invention, the rake surface may generally be inclined, forming an included angle between 30° and 90° with respect to the relief surface, while "$\alpha_f$" will range from about 30° to about 135°, preferably from about 60° to about 135°, and more preferably from about 75° to about 125° and most preferably 85° to 115°; while "$\alpha_m$" will preferably range from about 15° to about 135°, and more preferably from about 25° to about 115°.

Similarly as illustrated in FIG. 4 the local axial rake angle "$\beta$" is defined at each location along undulatory cutting edge 23 as the angle between the axis of Yankee 30 and the curve defined by the intersection of the surface of Yankee 30 with indented rake surface 34 of blade 20, otherwise known as undulatory cutting edge 23. Accordingly, it can be appreciated that local axial rake angle along substantially co-linear rectilinear elongate regions 46, "$\beta_f$", is substantially 0°, while the local axial rake angle along nearly planar crescent-shaped bands 36, "$\beta_c$", varies from positive to negative along the length of each serrulation 26. Further, it can be appreciated that the absolute value of the local axial rake angle "$\beta_c$" varies from relatively high values adjacent to each rectilinear elongate region 46 to much lower values, approximately 0°, in the lowest portions of each serrulation 26. In preferred blades of the present invention, "$\beta_c$" will range in absolute value from about 15° to about 75°, more preferably from about 20° to about 60°, and most preferably from about 25° to about 45°.

As discussed above and shown best in FIGS. 2A and 2B, in the preferred blades of the present invention, each nearly planar crescent-shaped band 36 intersects a protruding relief surface 39 of each relieved foot 32 projecting out of relief surface 16 of body 22 of blade 20. While we have been able to operate the process of the present invention with blades 20 not having relieved foot 32, we have found that the presence of a substantial relief of foot 32 makes the procedure much less temperamental and much more forgiving. We have found that for very light or weak sheets, the process often does not run easily without the foot. FIGS. 6A, 6B and 6C illustrate blade 20 with and without foot 32. Normally, we prefer that the height "$\tau$" of each relieved foot 32 be at least about 0.005" at the beginning of each operation. It appears that most stable creping continues for at least the time in which relieved foot 32 has a height "$\tau$" of at least about 0.002" and that, once relieved foot 32 is entirely eroded, web 48 [shown in FIG. 52] becomes much more susceptible to tearing and perforations.

As illustrated in FIGS. 7 and 8, local relief angle "$\gamma$" is defined at each location along undulatory cutting edge 23 as being the angle between relief surface 16 of blade 20 and the plane tangent to Yankee 30. Accordingly, it can be appreciated that "$\gamma_f$", the local relief angle having it apex at surface 23, is greater than or equal to "$\gamma_c$", the local relief angle adjacent to nearly planar crescent-shaped bands 36. Further, it can be appreciated that the local relief angle "$\gamma_c$" varies from relatively high values adjacent to each rectilinear elongate region 46 to lower values close to 0° in the lowest portions of each serrulation 26. In preferred blades of the present invention, "$\gamma_f$" will range from about 5° to about 60°, preferably from about 10° to about 45°, and more preferably from about 15° to about 30°, these values being substantially similar to those commonly used as "blade angle" or "holder angle" in conventional creping; while "$\gamma_c$" will be less than or equal to $\gamma_f$, preferably less than 10° and more preferably approximately 0° if measured precisely at undulatory cutting edge 23. However, even though relief angle "$\gamma_c$" when measured precisely at undulatory cutting edge 23 is very small, it should be noted that relief surface 16, which is quite highly relieved, is spaced only slightly away from undulatory cutting edge 23.

Figure 5F:
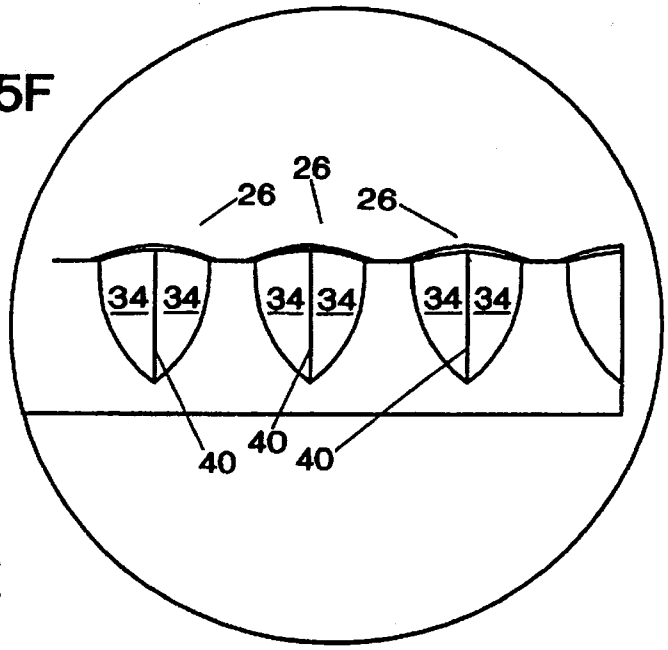
FIGS. 5A–G illustrates various elevational views of an undulatory creping blade of the present invention.
Figure 5C:
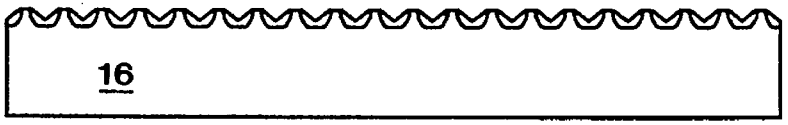
Figure 5B:
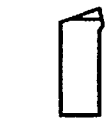
Figure 5E:
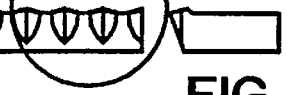
Figure 5A:
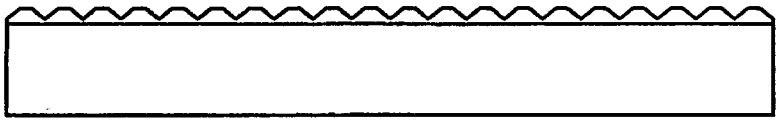
Figure 5D:
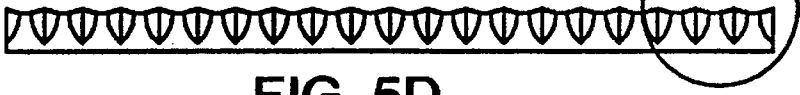
Figure 5G:
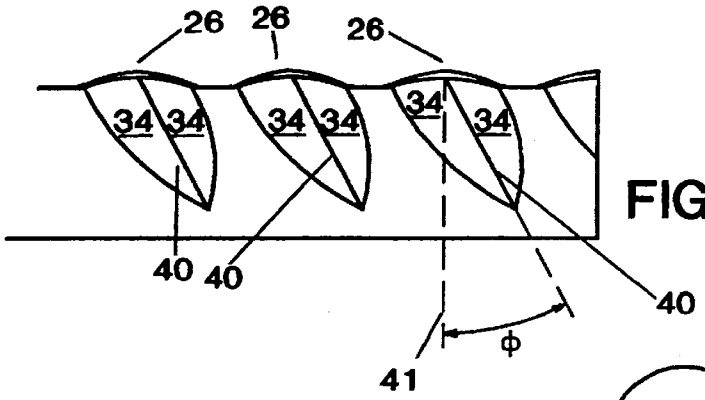

In most cases, side rake angle "$\phi$", defined above, is between about 0° and 45° and is "balanced" by another surface of mirror image configuration defining another opposing indented rake surface 34 as we normally prefer that the axis of symmetry of the serrulation be substantially normal to relief surface 16 of blade 20 as is shown in FIG. 5F. However, we have obtained desirable results when the serrulations are not "balanced" but rather are "skewed" as indicated in FIG. 5G.

Our novel undulatory creping blade 20 comprises an elongated, relatively rigid, thin plate, the length of the plate being substantially greater than the width of said plate and the width of said plate being substantially greater than the thickness thereof, said plate having: an undulatory engagement surface formed therein along the length of an elongated edge thereof, said undulatory engagement surface being adaptable to be engaged against the surface of a Yankee drying cylinder, said undulatory engagement surface constituting a spaced plurality of nearly planar crescent-shaped bands of width "$\delta$", depth "$\lambda$" and span "$\sigma$" interspersed with, and inter-connected by, a plurality of substantially co-linear rectilinear elongate regions of width "$\epsilon$" and length "l", the initial width "$\epsilon$" of the substantially rectilinear elongate regions being, substantially less than the initial width "$\delta$" of the nearly planar crescent-shaped bands of the serrulated engagement surface.

In the undulatory creping blade, the creping angle, defined by the portion of each indented rake surface interspersed among said substantially co-linear rectilinear elongate regions, is between about 30° and 135°, the absolute value of the side rake angle "$\phi$" being between about 0° and 45°.

In a preferred embodiment, the undulatory creping blade comprises an elongated, relatively rigid, thin plate, the length of the plate being substantially greater than the width of said plate and typically over 100 inches in length and the width of said plate being substantially greater than the thickness thereof, said plate having: a serrulated engagement surface formed therein along the length of an elongated edge thereof, said serrulated engagement surface being adaptable to be engaged against the surface of a Yankee drying cylinder, said serrulated engagement surface constituting a spaced plurality of nearly planar crescent-shaped bands of width "δ", depth "λ" and span "σ" interspersed with, and inter-connected by, a plurality of substantially co-linear rectilinear elongate regions of width "ε" and length "l", the initial width "ε" of the substantially rectilinear elongate regions being substantially less than the initial width "δ" of the nearly planar crescent-shaped bands of the serrulated engagement surface, a rake surface defined thereupon adjoining said serrulated engagement surface, extending across the thickness of said plate. A relief surface defined thereupon adjoining said serrulated engagement surface, the length "l" of each of said plurality of substantially co-linear rectilinear elongate regions being between about 0.0020" and 0.084", the span "σ" of each of said plurality of nearly planar crescent-shaped bands being between about 0.01" and 0.095, the depth "λ" of each of said plurality of nearly planar crescent-shaped bands being between about 0.008" and 0.05".

Advantageously, adjacent each of said relieved nearly planar crescent-shaped bands, a foot having a height of at least about 0.001 inch protrudes from said relief surface, the relief angle of the relieved nearly planar crescent-shaped bands being greater than the relief angle of substantially co-linear rectilinear elongate regions.

The advantages of using the undulatory creping blade process apply also to wet crepe and Through Air Drying (TAD) processes as well as to conventional dry crepe technology. The dry crepe process is illustrated in FIG. 15. In the process, tissue sheet 71 is creped from Yankee dryer 30 using undulatory creping blade 73. The moisture content of the sheet when it contacts undulatory creping blade 73 is usually in the range of 2 to 8 percent. Optionally, the creped sheet may be calendered by passing it through calender rolls 76*a* and 76*b* which impart smoothness to the sheet while reducing its thickness. After calendering, the sheet is wound on reel 75.

The wet crepe process is illustrated in FIG. 16. In the process, tissue sheet 71 is creped from Yankee dryer 30 using undulatory creping blade 73. The moisture content of the sheet contacting undulatory creping blade 73 is usually in the range of 15 to 50 percent. After the creping operation, the drying process is completed by use of one or more steam-heated can dryers 74*a*–74*f*. These dryers are used to reduce the moisture content to its desired final level, usually from 2 to 8 percent. The completely dried sheet is then wound on reel 75.

Figure 17:
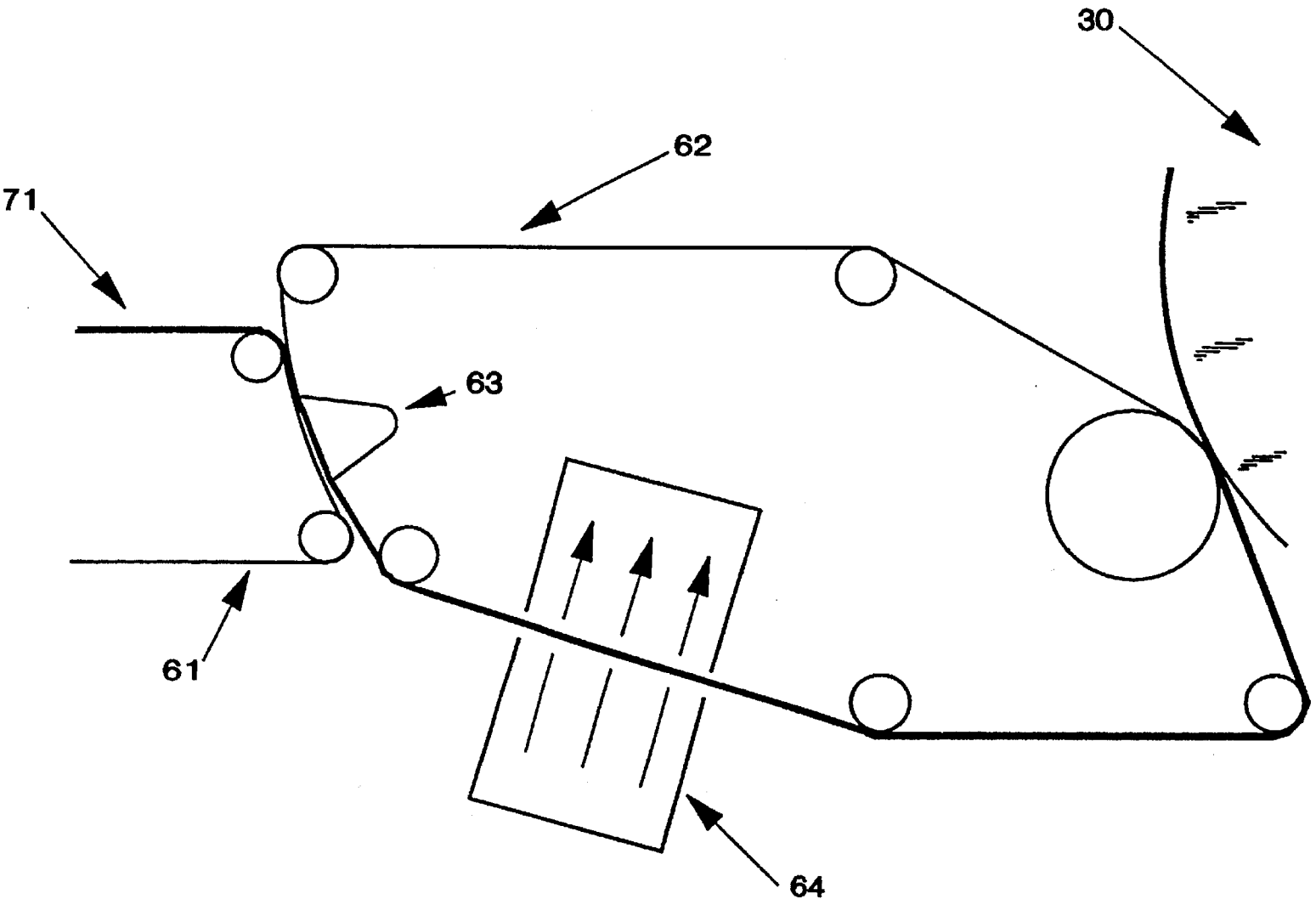
FIG. 17 illustrates the TAD process.

The TAD process is illustrated in FIG. 17. In the process, wet sheet 71 that has been formed on forming fabric 61 is transferred to through-air-drying fabric 62, usually by means of vacuum device 63. TAD fabric 62 is usually a coarsely woven fabric that allows relatively free passage of air through both fabric 62 and nascent web 71. While on fabric 62, sheet 71 is dried by blowing hot air through sheet 71 using through-air-dryer 64. This operation reduces the sheet's moisture to a value usually between 10 and 65 percent. Partially dried sheet 71 is then transferred to Yankee dryer 30 where it is dried to its final desired moisture content and is subsequently creped off the Yankee.

Figure 55:
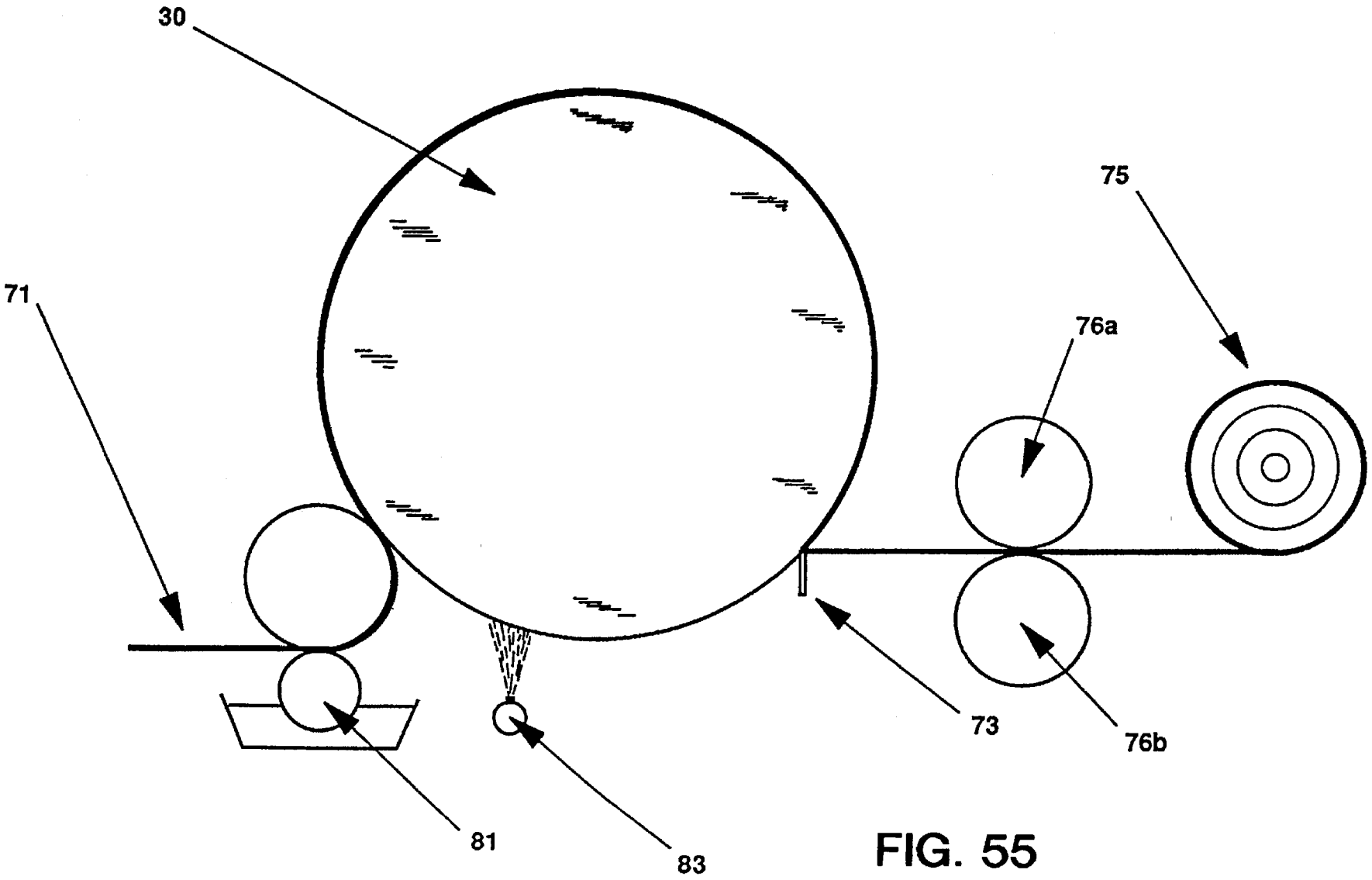
FIG. 55 illustrates a recrepe process.

Our process also includes an improved process for production of a double or a recreped sheet. In our process the once creped cellulosic web is adhered to the surface of a Yankee dryer. The moisture is reduced in the cellulosic web while in contact with the Yankee dryer and the web is recreped from the Yankee dryer. The recrepe process is shown in FIG. 55. In this process, adhesive is applied to either a substantially dried, creped web 71, Yankee/crepe dryer 30 or to both. The adhesive may be applied in any of a variety of ways, for example using patterned applicator roll 81 as shown, adhesive spray device 83, or using various combinations of applicators as are known to those skilled in the art. Moisture from the adhesive and possibly some residual moisture in the sheet are removed using Yankee/crepe dryer 30. The sheet is then creped from Yankee/crepe dryer 30 using crepe blade 73, optionally calendered using calender rolls 76*a* and 76*b*, and wound on reel 75. Advantageously our process includes, providing an undulatory creping member disposed to crepe said once creped cellulosic web from said Yankee/crepe dryer, said undulatory creping member compromising: an elongated blade adapted to be engagable against, and span the width of, said Yankee/crepe dryer, said blade having: a rake surface defined thereupon, extending generally outwardly from said Yankee when said blade is engaged against said Yankee/crepe dryer and extending across substantially the width of said Yankee/crepe dryer, a relief surface defined thereupon generally adjacent to the portion of said Yankee/crepe dryer from which said dried cellulosic web has been creped or recreped when said blade is engaged against said Yankee/crepe dryer and extending across substantially the width of said Yankee/crepe dryer, the intersection between said rake surface and said relief surface defining a serrulated engagement surface formed along the length of an elongated edge thereof, said serrulated engagement surface being adaptable to be engaged against the surface of said Yankee/crepe drying cylinder in surface-to-surface contact, said serrulated engagement surface constituting a spaced plurality of nearly planar crescent-shaped bands of width "δ", depth "λ" and span "σ" interspersed with, and interconnected by, a plurality of substantially co-linear rectilinear elongate regions of width "ε" and length "l", the initial width "ε" of the substantially rectilinear elongate regions being substantially less than the initial width "δ" of the nearly planar crescent-shaped bands of the serrulated engagement surface; said relief surface being configured so as to form a highly relieved foot contiguous to each nearly planar crescent-shaped band of the serrulated engagement surface; the length "l" of each of said plurality of substantially co-linear rectilinear elongate regions being between about 0.002 inch and 0.0084 inch and the span "σ" of each of said plurality of nearly planar crescent-shaped bands being between about 0.01 inch and 0.095 inch, the depth "λ" of each of said plurality of nearly planar crescent-shaped bands being between about 0.0080 inch and 0.0500 inch; and controlling the creping geometry such that: (a) the resulting recreped web exhibits from about 10 to about 150 crepe bars per inch, said crepe bars extending transversely in the cross machine direction and (b) said sheet exhibits undulations extending longitudinally in the machine direction, the number of longitudinally extending undulations per inch being from about 10 to about 50.

Our invention also comprises an improved process for production of a creped tissue web, including the steps of: forming a latent cellulosic web on a foraminous surface; adhering said latent cellulosic web to the surface of a Yankee dryer; drying the latent cellulosic web while in contact with the Yankee dryer to form a dried cellulosic web; and creping the dried cellulosic web from the Yankee dryer; wherein the improvement includes: for said creping of the dried cellulosic web, providing an undulatory creping blade having a undulatory cutting edge disposed to crepe said dried cellulosic web from said Yankee dryer; controlling the creping geometry and the adhesion between the Yankee dryer and the latent cellulosic web during drying such that the resulting tissue has from about 10 to about 150 crepe bars per inch, said crepe bars extending transversely in the cross machine direction, the geometry of the undulatory creping blade being such that the web formed has undulations extending longitudinally in the machine direction, the number of longitudinally extending undulations per inch being from about 10 to about 50.

Figure 52:
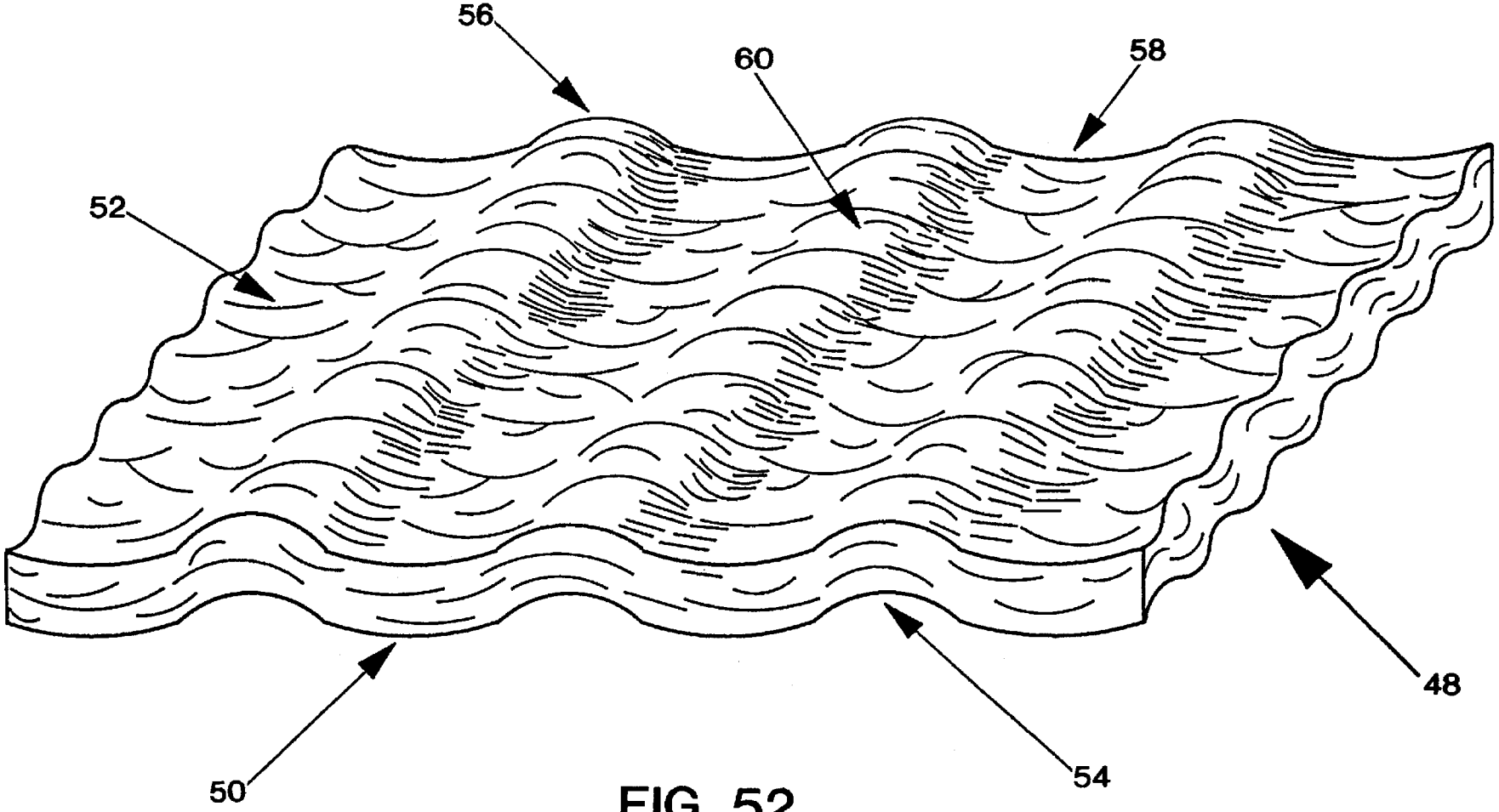
FIG. 52 schematically illustrates the creped web of the present invention.

Our invention particularly relates to a creped or recreped web as shown in FIG. 52 comprising a biaxially undulatory cellulosic fibrous web 48 creped from a Yankee dryer 30 shown in FIG. 8, characterized by a reticulum of intersecting crepe bars 52, and undulations defining ridges 50 on the air side thereof, said crepe bars 52 extending transversely in the cross machine direction, said ridges 50 extending longitudinally in the machine direction, said web 48 having furrows 54 between ridges 50 on the air side as well as crests 56 disposed on the Yankee side of the web opposite furrows 54 and sulcations 58 interspersed between crests 56 and opposite to ridges 50, wherein the spatial frequency of said transversely extending crepe bars 52 is from about 10 to about 150 crepe bars per inch, and the spatial frequency of said longitudinally extending ridges 50 is from about 10 to about 50 ridges per inch. It should be understood that strong calendering of the sheet made with this invention can significantly reduce the height of ridges 50, making them difficult to perceive by the eye, without loss of the beneficial effects of this invention.

The crepe frequency count for a creped base sheet or product is measured with the aid of a microscope. The Leica Stereozoom® 4 microscope has been found to be particularly suitable for this procedure. The sheet sample is placed on the microscope stage with its Yankee side up and the cross direction of the sheet vertical in the field of view. Placing the sample over a black background improves the crepe definition. During the procurement and mounting of the sample, care should be taken that the sample is not stretched. Using a total magnification of 18×–20×, the microscope is then focused on the sheet. An illumination source is placed on either the right or left side of the microscope stage, with the position of the source being adjusted so that the light from it strikes the sample at an angle of approximately 45 degrees. It has been found that Leica or Nicholas Illuminators are suitable light sources. After the sample has been mounted and illuminated, the crepe bars are counted by placing a scale horizontally in the field of view and counting the crepe bars that touch the scale over a one-half centimeter distance. This procedure is repeated at least two times using different areas of the sample. The values obtained in the counts are then averaged and multiplied by the appropriate conversion factor to obtain the crepe frequency in the desired unit length.

It should be noted that the thickness of the portion of web 48 between longitudinally extending crests 56 and furrows 54 will on the average typically be about 5% greater than the thickness of portions of web 48 between ridges 50 and sulcations 58. Suitably, the portions of web 48 adjacent longitudinally extending ridges 50 (on the air side) are about from about 1% to about 7% thinner than the thickness of the portion of web 48 adjacent to furrows 54 as defined on the air side of web 48.

The height of ridges 50 correlates with the depth of serrulations 26 formed in undulatory creping blade 20. At a serrulation depth of about 0.010 inches, the ridge height is usually from about 0.0007 to about 0.003 inches for sheets having a basis weight of 14–19 pounds per ream. At double the depth, the ridge height increases to 0.005 to 0.008 inches. At serrulation depths of about 0.030 inches, the ridge height is about 0.010 to 0.013 inches. At higher undulatory depth, the height of ridges 50 may not increase and could in fact decrease. The height of ridges 50 also depends on the basis weight of the sheet and strength of the sheet.

Advantageously, the average thickness of the portion of web 48 adjoining crests 56 is significantly greater than the thickness of the portions of web 48 adjoining sulcations 58; thus, the density of the portion of web 48 adjacent crests 56 can be less than the density of the portion of web 48 adjacent sulcations 58. The process of the present invention produces a web having a specific caliper of from about 3.5 to about 8 mils per 8 sheets per pound of basis weight. The usual basis weight of web 48 is from about 7 to about 35 lbs/3000 sq. ft. ream.

Suitably, when web 48 is calendered, the specific caliper of web 48 is from about 2.0 to about 6.0 mils per 8 sheets per pound of basis weight and the basis weight of said web is from about 7 to about 35 lbs/3000 sq. ft. ream.

Figure 11A:
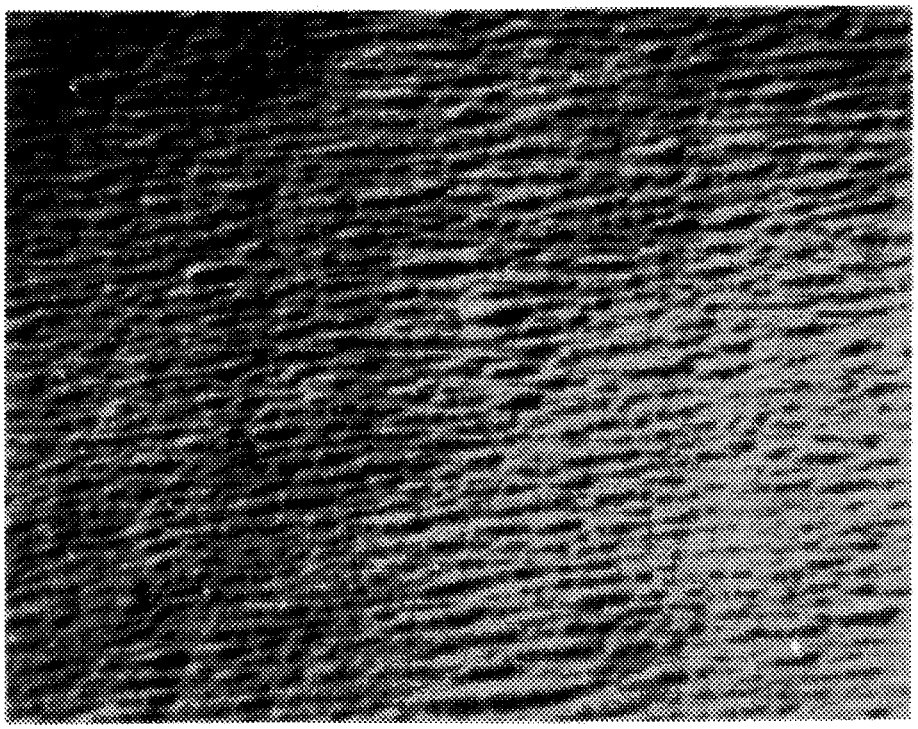
FIGS. 11A–11C compare low angle photomicrographs (8×) of a conventionally creped prior art tissue base sheet (FIG. 11A) with a sheet made following the prior art Fuerst reference (FIG. 11B) and a biaxially undulatory tissue of the present invention (FIG. 11C), long direction of the photograph is the cross direction of the sheet.
Figure 11B:
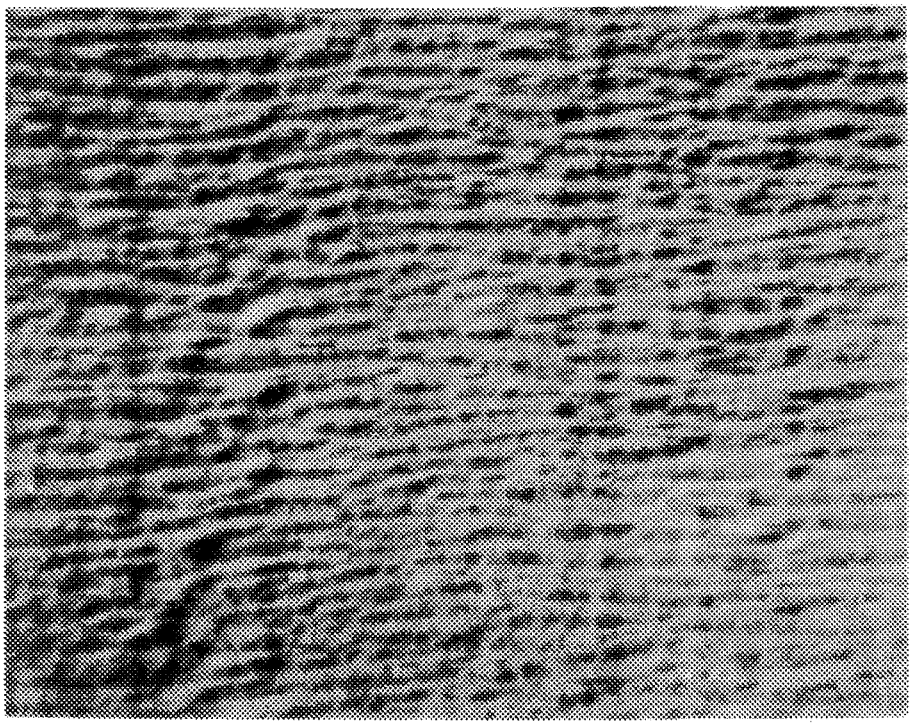
Figure 11C:
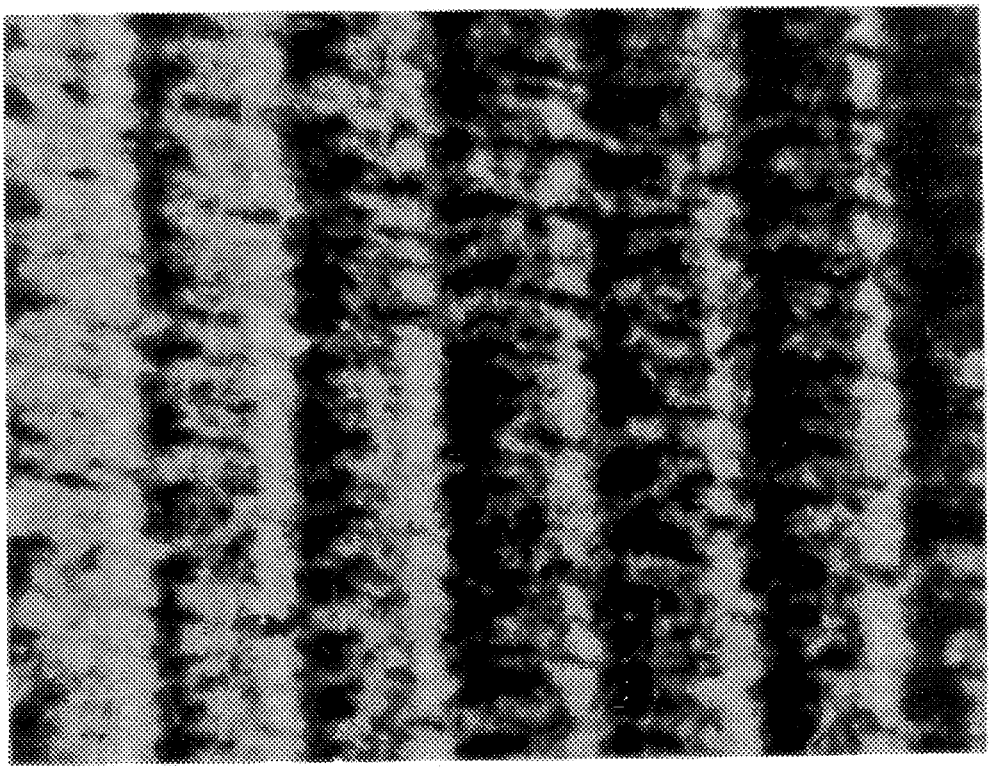

FIG. 11A shows the surface of a tissue sheet that has been creped using a conventional square (0° bevel) creping blade. FIG. 11B shows the surface of a tissue base sheet that has been creped using a blade such as that described in the Fuerst, U.S. Pat. No. 3,507,745. The surface of a base sheet creped using the process of the present invention is shown in FIG. 11C. For all three tissue sheets, the long dimension of the photomicrograph corresponds to the cross direction of the base sheet. As can be seen from the photomicrograph FIG. 11A, the sheet surface has crepe bars extending in the sheet's cross direction. FIG. 11B shows a photomicrograph of a sheet produced using a creping blade constructed following as closely as possible the teachings of Fuerst. This sheet, like the control sheet, has crepe ridges that extend in the cross direction only. Close examination of FIG. 11B reveals relatively wide (0.3125") alternating bands of coarser and finer crepe that extend in the base sheet's machine direction, corresponding to the sharpened and flattened edges of the blade. FIG. 11C is a photomicrograph of a sheet of the present invention produced using undulatory creping blade 20. FIG. 11C shows the biaxially undulatory nature of this product which has a reticulum of intersecting crepe bars and undulations, the crepe bars extending transversely in the sheets's cross direction and intersecting longitudinally extending crests comprising machine-direction "lunes."

In preferred webs, the density of the portions of the web adjacent crests 56 is less than the density of the portions of the web adjacent sulcations 58; the web is calendered; the specific caliper of the web is from about 2.0 to about 4.5 mils per 8 sheets per pound of basis weight; and the basis weight of the web is from about 7 to about 14 lbs/3000 sq. ft. ream. In the calendered web the density difference between the areas adjoining crests and the areas adjoining sulcations is diminished.

Figure 12A:
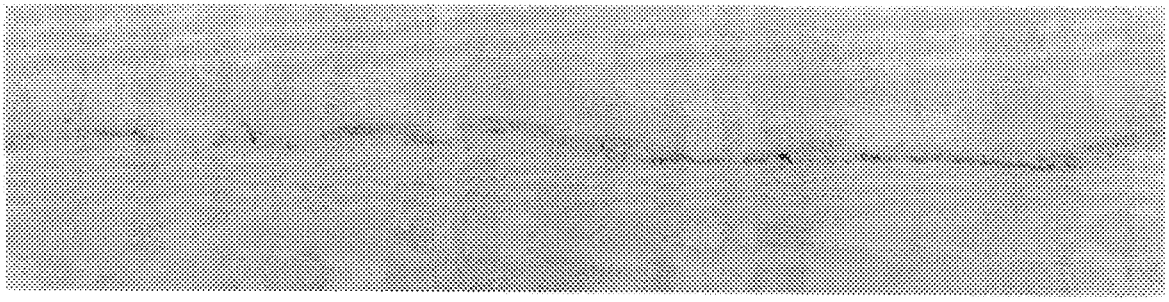
FIGS. 12A–12C are photomicrographs (50×), looking in the machine direction, comparing: prior art conventionally creped tissues (FIG. 12A); products made following the prior art Fuerst patent (FIG. 12B); and products of the present invention creped using an undulatory crepe blade (FIG. 12C).
Figure 12B:
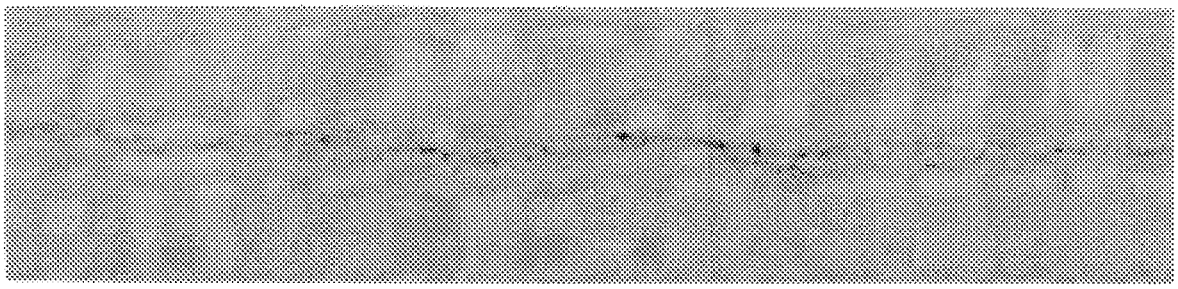
Figure 12C:
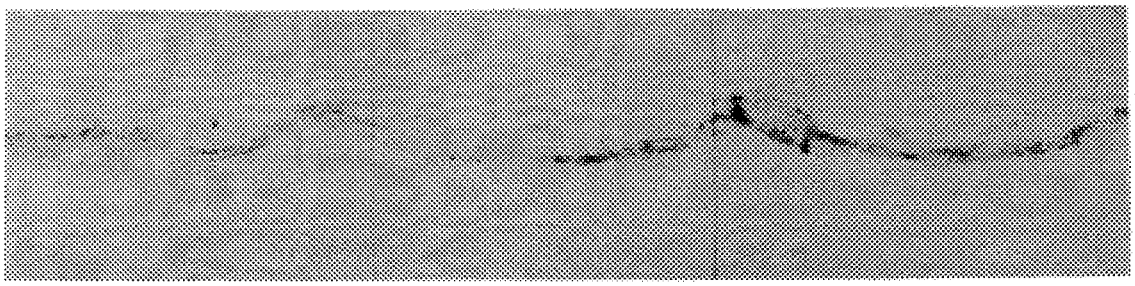
Figure 13A:
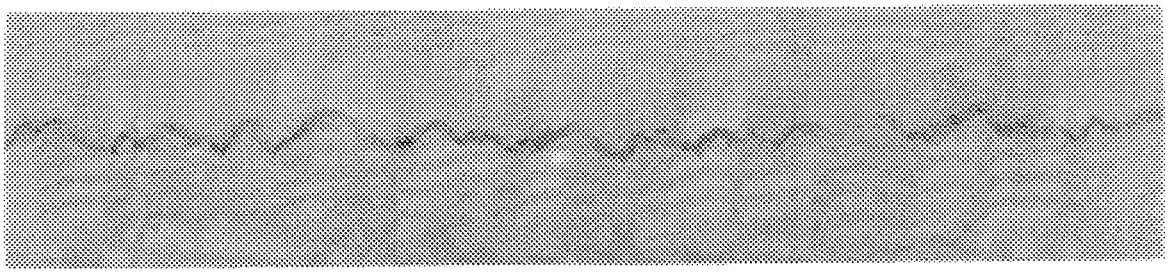
FIGS. 13A–13D are photomicrographs (50×), looking in the cross direction, comparing: tissue creped conventionally (FIG. 13A); tissues creped using a blade following the prior art Fuerst patent, FIG. 13B showing a section creped at a sharpened section of the Fuerst blade, FIG. 13C showing a section creped at a flattened section.
Figure 13B:
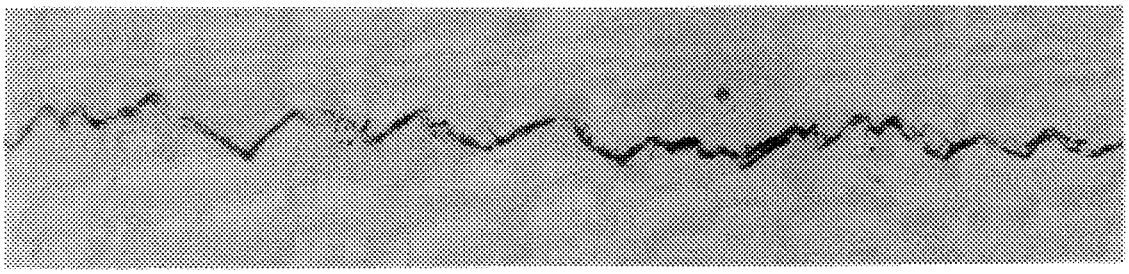
Figure 13C:
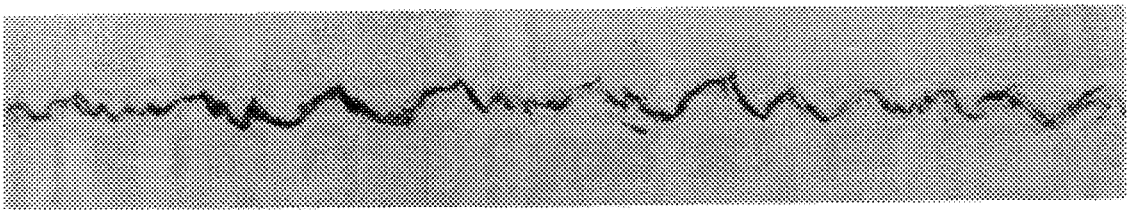
Figure 13D:
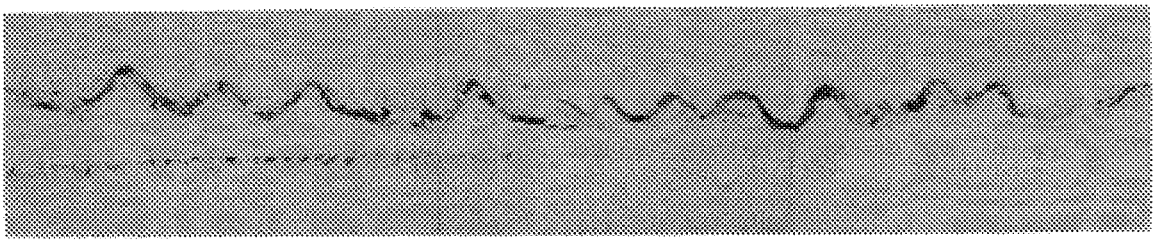
Figure 14A:
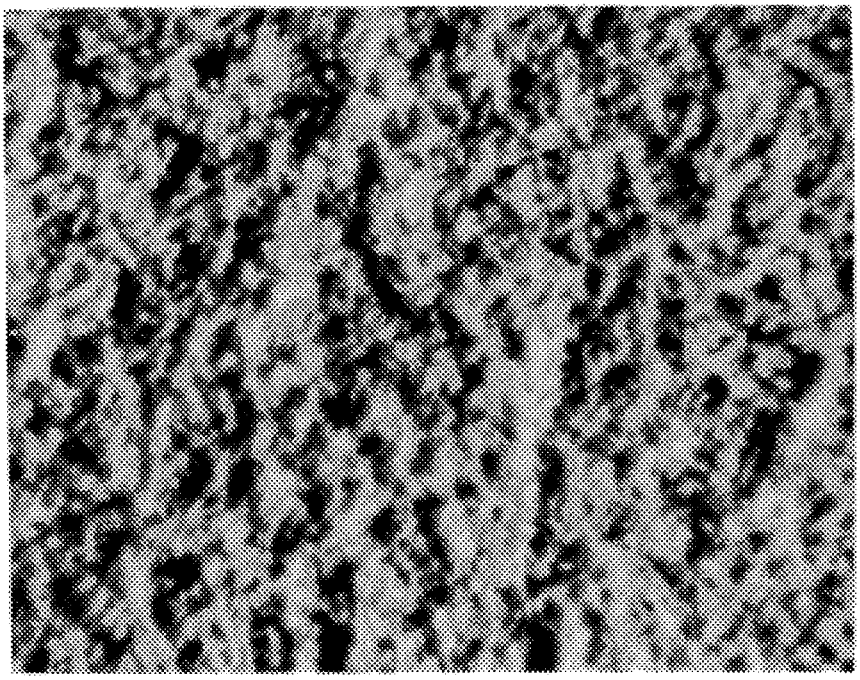
FIGS. 14A–14D are photomicrographs (16×) of wet creped sheets illustrating the prominent machine direction undulations produced by creping with an undulatory creping blade as compared to prior art blades.
Figure 14B:
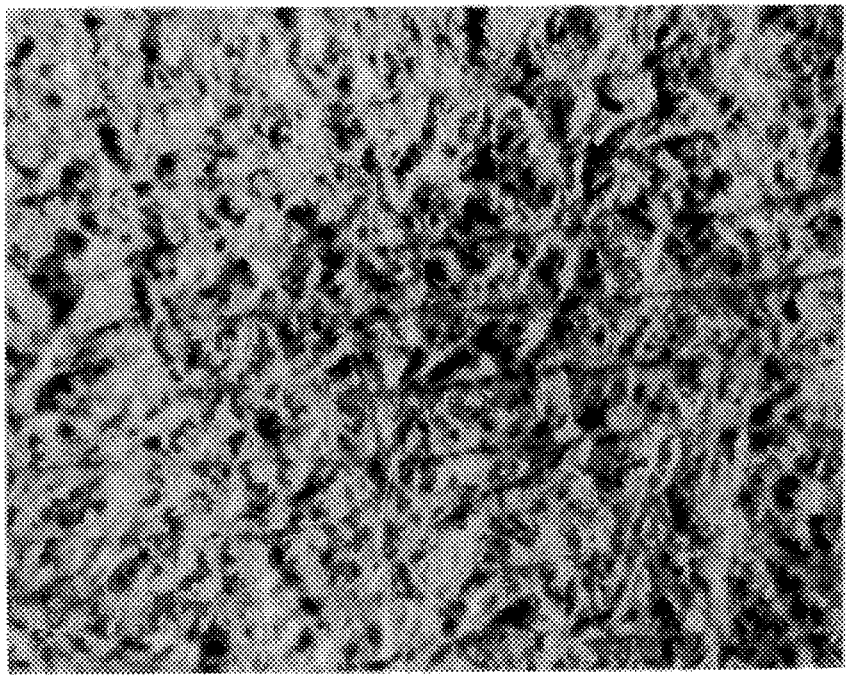
Figure 14C:
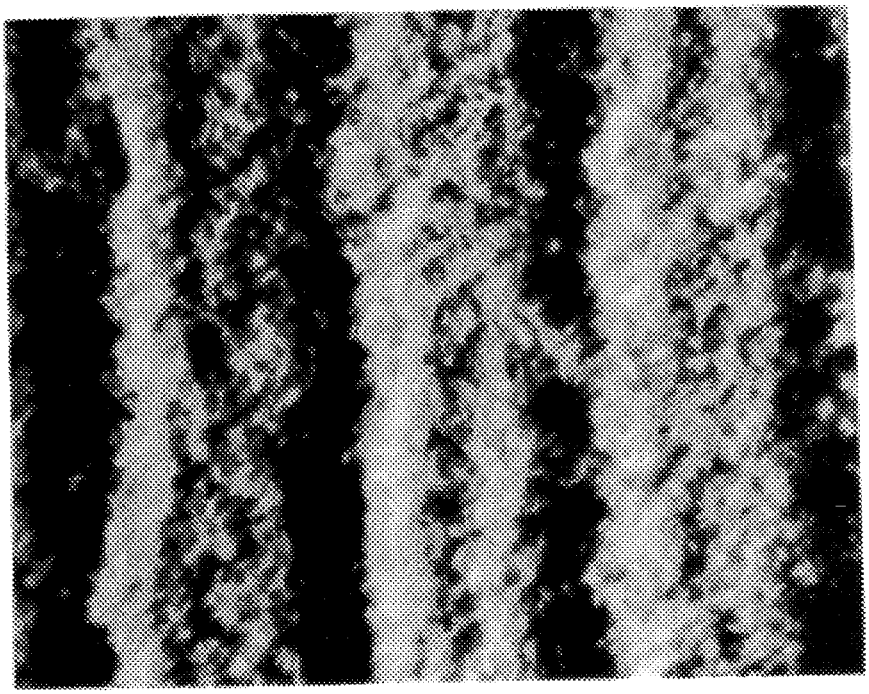
Figure 14D:
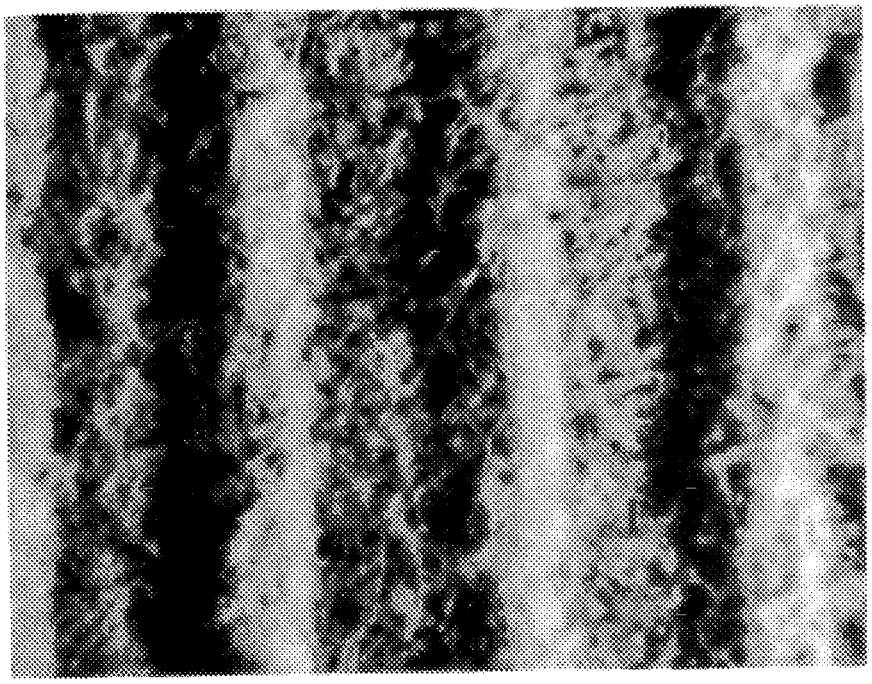

FIG. 12 shows (50× magnification) photomicrographs of the edges of three base sheets, looking in the machine direction. FIGS. 12A and 12B compare control and Fuerst products respectively, having similar, relatively flat profiles. In contrast, FIG. 12C illustrates a sheet creped using an undulatory creping blade, exhibiting undulations extending in the machine direction.

FIG. 13 shows photomicrographic views (50× magnification) of the edges of the base sheets looking in the sheets' cross directions. These figures allow comparisons of the sheets' crepe frequency to be made. FIG. 13A shows the sheet creped using the control crepe blade. FIGS. 13B and 13C show the crepe pattern for the sheet manufactured using the Fuerst blade. FIG. 13B shows a section of the sheet that was creped at one of the blade's sharpened sections, while FIG. 13C shows a section creped on a flattened section of the blade. It can be seen that the crepe originating from the Fuerst blade's sharpened region has, in general, crepes having a longer wavelength as compared to those corresponding to the portions of the sheet creped using the flatter portion of the blade, which have a crepe frequency more similar to that of the control. The crepe frequency of the sheet produced by the undulatory creping blade has a crepe appearance similar to that of the control, demonstrating that the use of this type of undulatory creping blade does not substantially alter the sheet's overall crepe frequency.

Our process produces novel single- and multi-ply tissue, towel, napkins and facial tissue having the characteristic biaxially undulatory geometry described for the web. However, certain physical properties differ. The following Table A will illustrate the properties of the various paper products produced by the novel undulatory creping blade process. Please note that for multi-ply tissue, the caliper is based on 8 multi-ply sheets (8×number of plies in each multiply sheet=plies total). For example, the caliper of two-ply tissues based on 8 two-ply sheets has 16 plies total. This holds true also for multi-ply towel paper products. In the wet crepe process, the nascent web is subjected to overall compaction while the percent solids is less than fifty percent by weight.

TABLE A

Physical Properties of Single-Ply and Multi-Ply Tissue and Single-Ply and Multi-Ply Towel

| | |
|---|---|
| Single-Ply Tissue | |
| Base Sheet, Uncalendered: | |
| Basis Weight: | 10–20 lbs/ream |
| Caliper: | 35–100 mils/8 sheets |
| Specific Caliper: | 3.0–5.5 mils/8 sheets/lbs/ream |
| CD Dry Tensile: | at least 250 grams/3 inches |
| Base Sheet, Calendered | |
| Basis Weight: | 10–20 lbs/ream |
| Caliper: | 30–80 mils/8 sheets |
| Specific Caliper: | 2.5–4.5 mils/8 sheets/lbs/ream |
| CD Dry Tensile: | at least 250 grams/3 inches |
| Tensile Modulus: | less than 75 grams/inch/% |
| Friction Deviation: | less than 0.300 |
| Finished Product, Unembossed: | |
| Basis Weight: | 10–20 lbs/ream |
| Caliper: | 30–80 mils/8 sheets |
| Specific Caliper: | 2.5–4.5 mils/8 sheets/lbs/ream |
| CD Dry Tensile: | at least 250 grams/3 inches |
| Tensile Modulus: | less than 75 grams/inch/% |
| Friction Deviation: | less than 0.300 |
| Finished Product, Embossed: | |
| Basis Weight: | 10–20 lbs/ream |
| Caliper: | 35–100 mils/8 sheets |
| Specific Caliper: | 2.75–5.5 mils/8 sheets/lbs/ream |
| CD Dry Tensile: | at least 200 grams/3 inches |
| Tensile Modulus: | less than 50 grams/inch/% |
| Friction Deviation: | less than 0.330 |
| Multi-Ply Tissue | |
| Base Sheet, Uncalendered: | |
| Basis Weight: | 7–14 lbs/ream |
| Caliper: | 25–85 mils/8 sheets |
| Specific Caliper: | 3.0–6.5 mils/8 sheets/lbs/ream |

TABLE A-continued

Physical Properties of Single-Ply and Multi-Ply Tissue and Single-Ply and Multi-Ply Towel

| | |
|---|---|
| CD Dry Tensile: | at least 150 grams/3 inches |
| Base Sheet, Calendered: | |
| Basis Weight: | 7–14 lbs/ream |
| Caliper: | 20–70 mils/8 sheets |
| Specific Caliper: | 2.5–5.5 mils/8 sheets/lbs/ream |
| CD Dry Tensile: | at least 150 grams/3 inches |
| Tensile Modulus: | less than 40 grams/inch/% |
| Friction Deviation: | less than 0.250 |
| Finished Product, Unembossed: | |
| Basis Weight: | 13–35 lbs/ream |
| Caliper: | 40–135 mils/8 sheets |
| Specific Caliper: | 2.5–5.5 mils/8 sheets/lbs/ream* |
| CD Dry Tensile: | at least 250 grams/3 inches |
| Tensile Modulus: | less than 80 grams/inch/% |
| Friction Deviation: | less than 0.250 |
| Finished Product, Embossed: | |
| Basis Weight: | 13–35 lbs/ream |
| Caliper: | 45–160 mils/8 sheets |
| Specific Caliper: | 2.5–5.5 mils/8 sheets/lbs/ream* |
| CD Dry Tensile: | at least 225 grams/3 inches |
| Tensile Modulus: | less than 50 grams/inch/% |
| Friction Deviation: | less than 0.300 |
| Single-Ply Towel; Dry Creped | |
| Base Sheet, Uncalendered: | |
| Basis Weight: | 15–35 lbs/ream |
| Caliper: | 45–135 mils/8 sheets |
| Specific Caliper: | 2.5–4.5 mils/8 sheets/lbs/ream |
| CD Wet Tensile: | at least 250 grams/3 inches |
| Tensile Modulus: | less than 250 grams/inch/% |
| Base Sheet, Calendered: | |
| Basis Weight: | 15–35 lbs/ream |
| Caliper: | 35–100 mils/8 sheets |
| Specific Caliper: | 2.0–4.0 mils/8 sheets/lbs/ream |
| CD Wet Tensile: | at least 250 grams/3 inches |
| Tensile Modulus: | less than 250 grams/inch/% |
| Friction Deviation: | less than 0.400 |
| Note: Base sheets are not usually calendared | |
| Finished Product, Unembossed: | |
| Basis Weight: | 15–35 lbs/ream |
| Caliper: | 30–135 mils/8 sheets |
| Specific Caliper: | 2.0–4.0 mils/8 sheets/lbs/ream |
| CD Wet Tensile: | at least 250 grams/3 inches |
| Tensile Modulus: | less than 250 grams/inch/% |
| Friction Deviation: | less than 0.500 |
| Absorbency: | at least 100 grams/sq. meter |
| Finished Product, Embossed: | |
| Basis Weight: | 15–35 lbs/ream |
| Caliper: | 75–200 mils/8 sheets |
| Specific Caliper: | 3.0–8.0 mils/8 sheets/lbs/ream |
| CD Wet Tensile: | at least 200 grams/3 inches |
| Tensile Modulus: | less than 150 grams/inch/% |
| Friction Deviation: | less than 0.520 |
| Absorbency: | at least 150 grams/sq. meter |
| Singl-Ply Towel; Wet Creped | |
| Base Sheet, Uncalendered: | |
| Basis Weight: | 15–35 lbs/ream |
| Caliper: | 35–125 mils/8 sheets |
| Specific Caliper: | 2.2–4.0 mils/8 sheets/lbs/ream |
| CD Wet Tensile: | at least 300 grams/3 inches |
| Tensile Modulus: | less than 500 grams/3 inches |
| Base Sheet, Calendered: | |
| Basis Weight: | 15–35 lbs/ream |
| Caliper: | 25–100 mils/8 sheets |
| Specific Caliper: | 2.0–3.5 mils/8 sheets/lbs/ream |
| CD Wet Tensile: | at least 300 grams/3 inches |
| Tensile Modulus: | less than 500 grams/inch/% |

TABLE A-continued

| Physical Properties of Single-Ply and Multi-Ply Tissue and Single-Ply and Multi-Ply Towel | |
|---|---|
| Friction Deviation: | less than 0.400 |
| Note: Base sheets are not usually calendared | |
| Finished Product; Unembossed: | |
| Basis Weight: | 15-35 lbs/ream |
| Caliper: | 25–125 mils/8 sheets |
| Specific Caliper: | 2.0–4.0 mils/8 sheets/lbs/ream |
| CD Wet Tensile: | at least 300 grams/3 inches |
| Tensile Modulus: | less than 500 grams/inch/% |
| Friction Deviation: | less than 0.400 |
| Absorbency: | at least 75 grams/sq. meter |
| Finished Product; Embossed: | |
| Basis Weight: | 15–35 lbs/ream |
| Caliper: | 40–175 mils/8 sheets |
| Specific Caliper: | 2.2–5.5 mils/8 sheets/lbs/ream |
| CD Wet Tensile: | at least 250 grams/3 inches |
| Tensile Modulus | less than 400 grams/inch/% |
| Friction Deviation: | less than 0.425 |
| Absorbency: | at least 100 grams/sq. meter |
| Multi-Ply Towel; Dry Creped Base Sheet, Uncalendered | |
| Basis Weight: | 9–18 lbs/ream |
| Caliper: | 35–120 mils/8 sheets |
| Specific Caliper: | 3.0–7.0 mils/8 sheets/lbs/ream |
| CD Wet Tensile: | at least 150 grams/3 inches |
| Tensile Modulus: | less than 150 grams/3 inches |
| Base Sheet, Calendered: | |
| Basis Weight: | 9–18 lbs/ream |
| Caliper: | 30–100 mils/8 sheets |
| Specific Caliper: | 2.5–6.0 mils/8 sheets/lbs/ream |
| CD Wet Tensile: | at least 150 grams/3 inches |
| Tensile Modulus: | less than 150 grams/inch/% |
| Friction Deviation: | less than 0.350 |
| Note: Base sheets are not usually calendered | |
| Finished Product; Unembossed: | |
| Basis Weight: | 17–36 lbs/ream |
| Caliper: | 50–200 mils/8 sheets |
| Specific Caliper: | 2.5–7.0 mils/8 sheets/lbs/ream |
| CD Wet Tensile: | at least 250 grams/3 inches |
| Tensile Modulus: | less than 300 grams/inch/% |
| Friction Deviation: | less than 0.425 |
| Absorbency: | at least 175 grams/sq. meter |
| Finished Product; Embossed: | |
| Basis Weight: | 17–40 lbs/ream |
| Caliper: | 75–225 mils/8 sheets |
| Specific Caliper: | 4.0–7.0 mils/8 sheets/lbs/ream |
| CD Wet Tensile: | at least 250 grams/3 inches |
| Tensile Modulus: | less than 150 grams/inch/% |
| Friction Deviation: | less than 0.450 |
| Absorbency: | at least 175 grams/sq. meter |
| Multi-Ply Towel; Wet Creped Base Sheet, Uncalendered: | |
| Basis Weight: | 10–17 lbs/ream |
| Caliper: | 35–125 mils/8 sheets |
| Specific Caliper: | 3.0–7.5 mils/8 sheets/lbs/ream |
| CD Wet Tensile: | at least 200 grams/3 inches |
| Tensile Modulus: | less than 400 grams/3 inches |
| Base Sheet, Calendered: | |
| Basis Weight: | 10–17 lbs/ream |
| Caliper: | 25–100 mils/8 sheets |
| Specific Caliper: | 2.5–6.5 mils/8 sheets/lbs/ream |
| CD Wet Tensile: | at least 200 grams/3 inches |
| Tensile Modulus: | less than 400 grams/inch/% |
| Friction Deviation: | less than 0.375 |
| Note: Base sheets are not usually calendared | |

TABLE A-continued

| Physical Properties of Single-Ply and Multi-Ply Tissue and Single-Ply and Multi-Ply Towel | |
|---|---|
| Finished Product; Unembossed: | |
| Basis Weight: | 18–34 lbs/ream |
| Caliper: | 50–200 mils/8 sheets |
| Specific Caliper: | 2.5–7.5 mils/8 sheets/lbs/ream |
| CD Wet Tensile: | at least 350 grams/3 inches |
| Tensile Modulus: | less than 600 grams/inch/% |
| Friction Deviation: | less than 0.400 |
| Absorbency: | at least 75 grams/sq. meter |
| Finished Product; Embossed: | |
| Basis Weight: | 18–34 lbs/ream |
| Caliper: | 50–200 mils/8 sheets |
| Specific Caliper: | 2.5–7.5 mils/8 sheets/lbs/ream |
| CD Wet Tensile: | at least 250 grams/3 inches |
| Tensile Modulus: | less than 400 grams/inch/% |
| Friction Deviation: | less than 0.425 |
| Absorbency: | at least 100 grams/sq. meter |

Tissues of the present invention will have pleasing tactile properties, sometimes referred to as softness or texture. In Table A, tensile modulus and friction deviation are presented as indicia of perceived softness as softness is not a directly measurable, unambiguous quantity but rather is somewhat subjective.

Bates has reported that the two most important components for predicting perceived softness are roughness and modulus referred to herein as stiffness modulus. See J. D. Bates "Softness Index: Fact or Mirage?," TAPPI, vol. 48, No. 4, pp 63A–64A, 1965. See also H. Hollmark, "Evaluation of Tissue Paper Softness", TAPPI, vol. 66, No. 2, pp 97–99, February, 1983, relating tensile stiffness and surface profile to perceived softness.

Alternatively, surface texture can be evaluated by measuring geometric mean deviation (MMD) in the coefficient of friction using a Kawabata KES-SE Friction Tester equipped with a fingerprint type sensing unit using the low sensitivity range, a 25 g stylus weight and dividing the instrument readout by 20 to obtain the mean deviation in the coefficient of friction. The geometric mean deviation in the coefficient of friction is then, of course, the square root of the product of the MMD in the machine direction and the cross direction.

Tensile strengths reported herein were determined on an Instron Model 4000:Series IX using cut samples three inches wide, the length of the samples being normally six inches, for products having a sheet size of less than six inches the sample length is the between perforation distance in the case of machine direction tensile and the roll width in the case of the cross direction. The test is run employing the 2 lb. load cell with lightweight grips applied to the total width of the sample and recording the maximum load. The results are reported in grams/3 inch strip.

Tensile modulus, reported in grams per inch per percent strain is determined by the procedure used for tensile strength except that the modulus recorded is the geometric mean of the slopes on the cross direction and machine direction load-strain curves from a load of 0 to 50 g/in and a sample width of only 1 inch is used.

Throughout this specification and claims, where the absorbency of a product is mentioned, the absorbency is measured using a Third Generation Gravimetric Absorbency Testing System model M/K 241, available from M/K Systems Inc., Danvers, Mass. modified as follows: A customized sample holder is fabricated to accept the sample to be tested, a 50 mm diameter circular section of the base sheet or finished product, which is normally cut using a circular die. When base sheet intended for a two-ply product is tested, it is customary that two base sheet samples be inserted into the apparatus and tested together.

The sample holder consists of two parts, a base and a cover. The base is made from a circular piece of acrylic, six inches in diameter by one inch thick. The outer 0.3855 inches bottom side of the disk is removed to a depth of 0.75 inches. Removing this outer portion of the disk's bottom allows it to fit in the apparatus' base holder. In the center of the disk, a 0.118 inch diameter hole is drilled all the way through the disk to allow water to be conducted through the bottom of the base to the sample. On the bottom side of the base, this hole is enlarged by drilling for a distance of 0.56 inches using an 11/32 (0.34375) inch drill. This enlargement will be tapped to a depth of 0.375 inches to allow insertion of a tube fitting that will convey water through the base and to the sample.

On the top side of the base, a circular section 2.377 inches in diameter by 0.0625 inches deep is machined from the center of the base. Additional machining is done to cut a series of four concentric circular channels about the hole in the base's center. The innermost of these channels begins at a distance 0.125 inches from the center of the base and extends radially outward for a width of 0.168 inches. The second channel begins 0.333 inches from the center and also extends outward for 0.168 inches. The third channel begins 0.541 inches from the center and also extends outward for 0.168 inches. The fourth channel begins 0.749 inches from the base center and also extends outward for 0.168 inches. Each of the channels will extend to a depth of 0.2975 inches below the unmachined top surface of the base. In addition to the four channels described immediately above, a circular sample-holding ring that extends from a distance of 0.917 inches from the base center outward to a distance of 1.00 inches from the center is etched into the base. This ring extends an additional 0.01 inch below the surface of the 0.0625 inch cut described above; thus the bottom of this ring is 0.0725 inches below the unaltered top of the base. This ring is designed to contact the outer edge of the sample to be tested and to hold it in place.

The sample cover is also made of acrylic. It is circular with a diameter of 2.375 inches and a total thickness of 0.375 inches. The top of the cover is completely removed to a depth of 0.125 inches except for a circle in its center that is 0.625 inches in diameter. The center of this unremoved portion of the top is recessed to a depth of 0.0625 inches. The recess is circular and has a diameter of 0.375 inches.

The cover's bottom surface will contact the top surface of the sample being tested. A circular section in the center of the cover's bottom 0.250 inches in diameter and the cover's outer perimeter to a distance of 0.3125 inches from the cover edge is left unaltered; the remainder of the cover bottom is recessed to a depth of 0.1875 inches.

The sample cover as described above should have a weight of 32.5 grams. The dimensions of the top of the cover may be slightly modified to insure that the targeted weight is obtained. It should also be noted that all of the sample holder dimensions described above have a tolerance of 0.0005 inches.

In addition to the customized sample holder, the instrument must also be modified by fitting it with a pinch valve and a timing/control system. A suitable pinch valve is the model 388-NO-12-12-15 made by Anger Scientific. The pinch valve is located along the flexible tubing leading from the supply reservoir to the bottom of the sample holder base. It has been found that ¼" ID by ⅜" OD, 1/16" wall thickness Close Tolerance Medical Grade Silicone Tubing, T5715-124 S/P Brand, available from Baxter Laboratory, McGraw Park, Ill. is suitable for this application. When a test is initiated, the action of the valve momentarily constricts the tubing so that water is forced up to contact the bottom of the sample. The restriction time is limited to that which will allow the water to contact the sample without forcing water into the sample. After the contact has been made, the wicking action of the sample will allow water to continue to flow until the sample is saturated. To insure that the constriction time will be constant from test to test, the valve should be equipped with a timer control system. A suitable timer is the National Semiconductor Model LM 555.

To run an absorbency test, the height of the sample holder must be adjusted. The adjustment is made by placing a towel sample in the sample holder and lowering the holder until the sample begins to absorb water. The sample holder is then raised 5 mm above this level. After several samples have been run, the sample height will have to be adjusted, as the amount of water introduced from the make-up reservoir to the supply reservoir may not exactly match the amount of water absorbed by the sample.

Figures 56A, 56B, 56C:
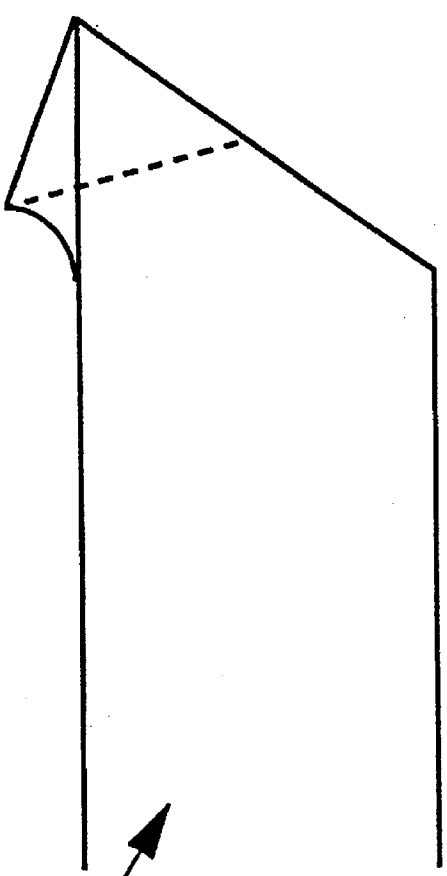
FIGS. 56A–56C illustrates and compares undulatory creping blades having inclined serrulations with a blade having serrulations which are substantially normal to the relief surface of the blade.

For tissue and towel products, suitable blade bevels include angles ranging about 0° to 50°, suitable undulation frequencies include frequencies ranging from about 10 to about 50 undulation per inch and suitable undulation depth is from about from 0.008 to about 0.050 inches. The preferred undulation depth varies from about 0.01 to about 0.040 inches. In most cases, it is convenient for the serrulations to be symmetrical and for the axes of symmetry of the serrulations to be normal to the Yankee or to the relief surface of the undulatory creping blade although there are advantages to use of undulatory creping blades wherein the axes of symmetry of the serrulations incline defining a vertical angle other than 90°, either up or down, with respect to the relief surface of the undulatory creping blade as shown in FIG. 56. Similarly, the axes of the serrulations may advantageously define an horizontal angle other than 0°, i.e., left or right, with respect to the relief surface.

The novel paper products prepared by utilizing the novel undulatory creping blade can be prepared using any suitable conventional furnish such as softwood, hardwood, recycle, mechanical pulps, including thermo-mechanical and chemi-thermo-mechanical pulp, anfractuous fibers and combinations of these.

In general, it is contemplated that neither a strength enhancing agent or a softener/debonder is required to produce the web which is creped by the novel undulatory creping blade. However, if the furnish contains a large portion of hardwood, then it may be advantageous to use strength enhancing agents, preferably water soluble starch. The starch can be present in an amount of about 1 to 10 pounds per ton of the furnish. Alternatively, if the furnish contains a lot of coarser fibers such as softwood or recycled fiber, it may be advantageous to employ a softener.

Representative softeners have the following structure:

$$[(RCO)_2EDA]HX$$

wherein EDA is a diethylenetriamine residue, R is the residue of a fatty acid having from 12 to 22 carbon atoms, and X is an anion or $$[(RCONHCH_2CH_2)_2NR']HX$$

wherein R is the residue of a fatty acid having from 12 to 22 carbon atoms, R' is a lower alkyl group, and X is an anion.

The preferred softeners are Quasoft® 202-JR and 209-JR made by Quaker Chemical Corporation which is a mixture of linear amine amides and imidazolines of the following structure:

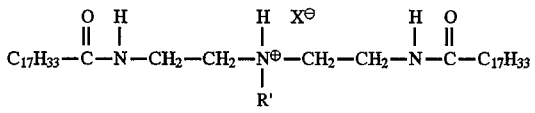

(i)

and

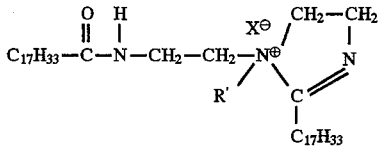

ii)

wherein X is an anion.

As the nitrogenous cationic softener/debonder reacts with a paper product during formation, the softener/debonder ionically attaches to cellulose and reduces the number of sites available for hydrogen bonding thereby decreasing the extent of fiber-to-fiber bonding.

Other useful softeners include amido amine salts derived from partially acid neutralized amines. Such materials are disclosed in U.S. Pat. No. 4,720,383; column 3, lines 40–41. Also relevant are the following articles: Evans, *Chemistry and Industry*, 5 Jul. 1969, pp. 893–903; Egan, *J. Am. Oil Chemist's Soc.*, Vol. 55 (1978), pp. 118–121; and Trivedi et al., *J. Am. Oil Chemist's Soc.*, June 1981, pp. 754–756. All of the above are incorporated herein by reference. As indicated therein, softeners are often available commercially only as complex mixtures rather than as single compounds. While this discussion will focus on the predominant species, it should be understood that commercially available mixtures would generally be used to practice.

At this time, Quasoft® 202-JR and 209-JR are preferred softener materials which are derived by alkylating a condensation product of oleic acid and diethylenetriamine. Synthesis conditions using a deficiency of alkylating agent (e.g., diethyl sulfate) and only one alkylating step, followed by pH adjustment to protonate the non-ethylated species, result in a mixture consisting of cationic ethylated and cationic non-ethylated species. A minor proportion (e.g., about 10%) of the resulting amido amines cyclize to imidazoline compounds. Since these materials are not quaternary ammonium compounds, they are pH-sensitive. Therefore, when using this class of chemicals, the pH in the headbox should be approximately 6 to 8, more preferably 6 to 7 and most preferably 6.5 to 7.

The softener employed for treatment of the furnish is provided at a treatment level that is sufficient to impart a perceptible degree of softness to the paper product but less than an amount that would cause significant runnability and sheet strength problems in the final commercial product. The amount of softener employed, on a 100% active bases, is preferably from about 1.0 pounds per ton of furnish up to about 10 pounds per ton of furnish. More preferred is from about 2 to about 5 pounds per ton of furnish. Treatment of the wet web with the softener can be accomplished by various means. For instance, the treatment step can comprise spraying, applying with a direct contact applicator means, or by employing an applicator felt.

To facilitate the creping process, adhesives are applied directly to the Yankee. Usual paper making adhesives are suitable. Suitable nitrogen containing adhesives include glyoxylated polyacrylamides and polyaminoamides. Blends such as the gloyoxylated polyacrylamide blend comprise at least of 40 weight percent polyacrylamide and at least 4 weight percent of glyoxal. Polydiallyldimethyl ammonium chloride is not needed for use as an adhesive but it is found in commercial products and is not detrimental to our operations.

The preferred blends comprise about 2 to about 50 weight percent of the glyoxylated polyacrylamide, about 40 to about 95 percent of polyacrylamide.

Suitable polyaminoamide resins are disclosed in U.S. Pat. No. 3,761,354 which is incorporated herein by reference. The preparation of polyacrylamide adhesives is disclosed in U.S. Pat. No. 4,217,425 which is incorporated herein by reference.

EXAMPLE 1

This example illustrates the advantages of the undulatory creping blade over a conventional blade and a blade following the teachings disclosed in Fuerst, U.S. Pat. No. 3,507,745. Towel and tissue base sheets were made on a crescent former pilot paper machine from a furnish consisting of 50% Northern Softwood Kraft, 50% Northern Hardwood Kraft. Three different crepe blades were used to crepe the product from the Yankee dryer: a square control or conventional creping blade, a blade which we made following the teachings of the Fuerst patent as closely as possible bearing in mind the artful imprecision obviously employed in drafting thereof, and an undulatory creping blade. The blade we made following the Fuerst patent had a 70° blade bevel, a notch depth of 0.005 inches and a notch width of 0.3125 inches which corresponds to our best understanding of the teachings therein. The undulatory creping blade had a 25° bevel, an undulation depth of 0.020 inches, and an undulation frequency of 20 undulations/inch.

When the blade made following the Fuerst patent was initially inserted into the creping blade holder, the sheet produced by the blade contained many holes and could not be wound onto the reel. It was found that it was necessary to allow the blade to "run in" as taught in Fuerst by running it against the Yankee dryer for approximately 20 minutes before a sheet could be successfully threaded and wound onto the reel. This run-in time, which Fuerst describes as being necessary to successful operation, represents a substantial loss of production and contrasts sharply with our experience with undulatory creping blades which can normally be used to produce product directly after insertion into the blade holder.

Towel base sheets were made on a crescent former pilot paper machine using the 50% Northern Softwood Kraft, 50% Northern Hardwood Kraft furnish. Sixteen pounds of wet strength resin (aminopolyamide-epichlorohydrin Kymene® 557H manufactured by Hercules) per ton of pulp was added to the furnish. The sheets were all made using a 20% crepe. The product was creped using the three different crepe blades described above. For the sheets made using the control crepe blade and the undulatory creping blade, base sheets were made at several strength levels, with refining being used to vary the tissue's strength. The product creped using the blade made according to the Fuerst patent was made at a single strength level.

Figure 18:
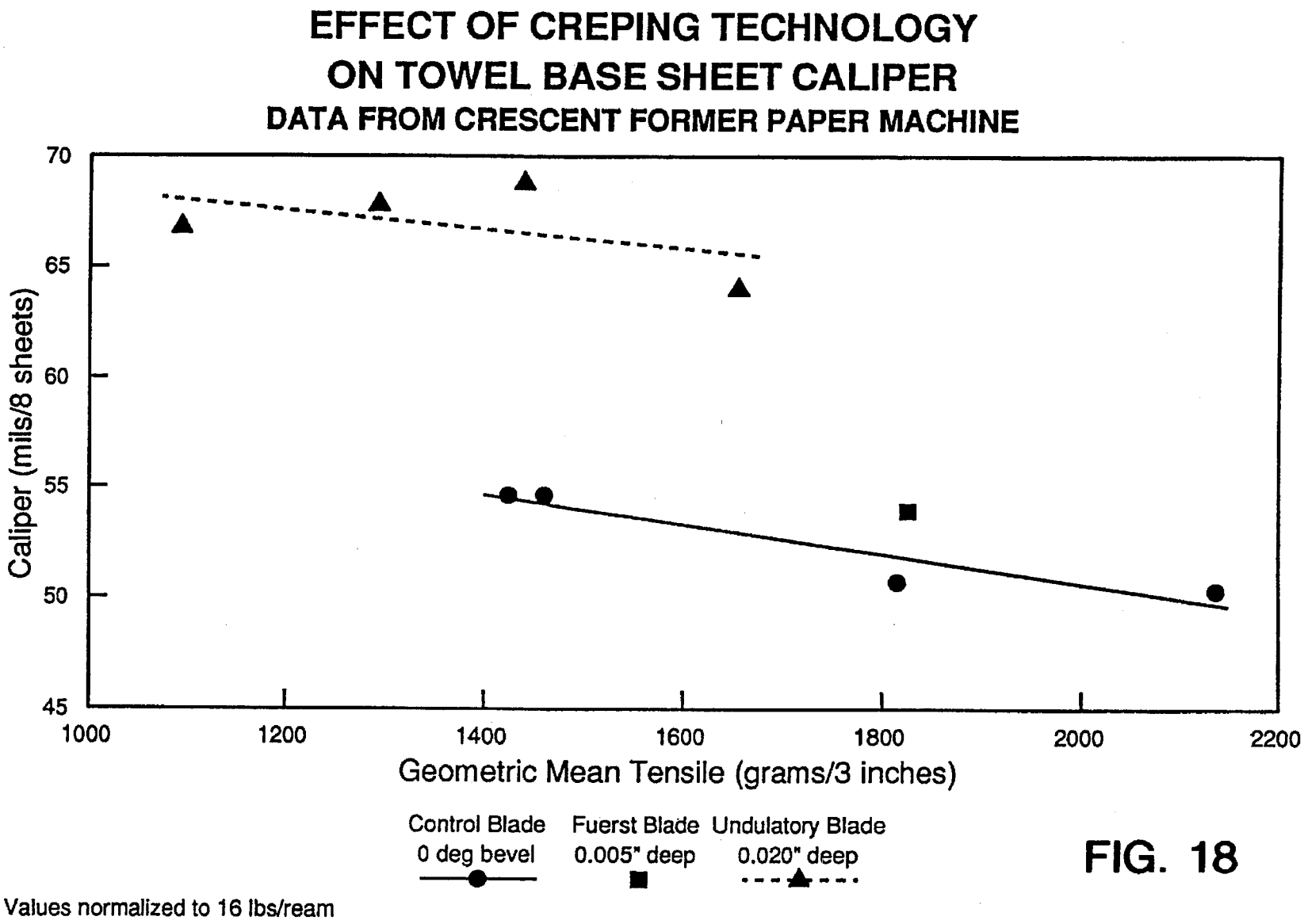
FIG. 18 illustrates the combination of bulk and strength achieved with the method of the present invention as compared with that of conventional creping technology as well as that achieved with a blade following the teachings of Fuerst, U.S. Pat. No. 3,507,745.
Figure 19:
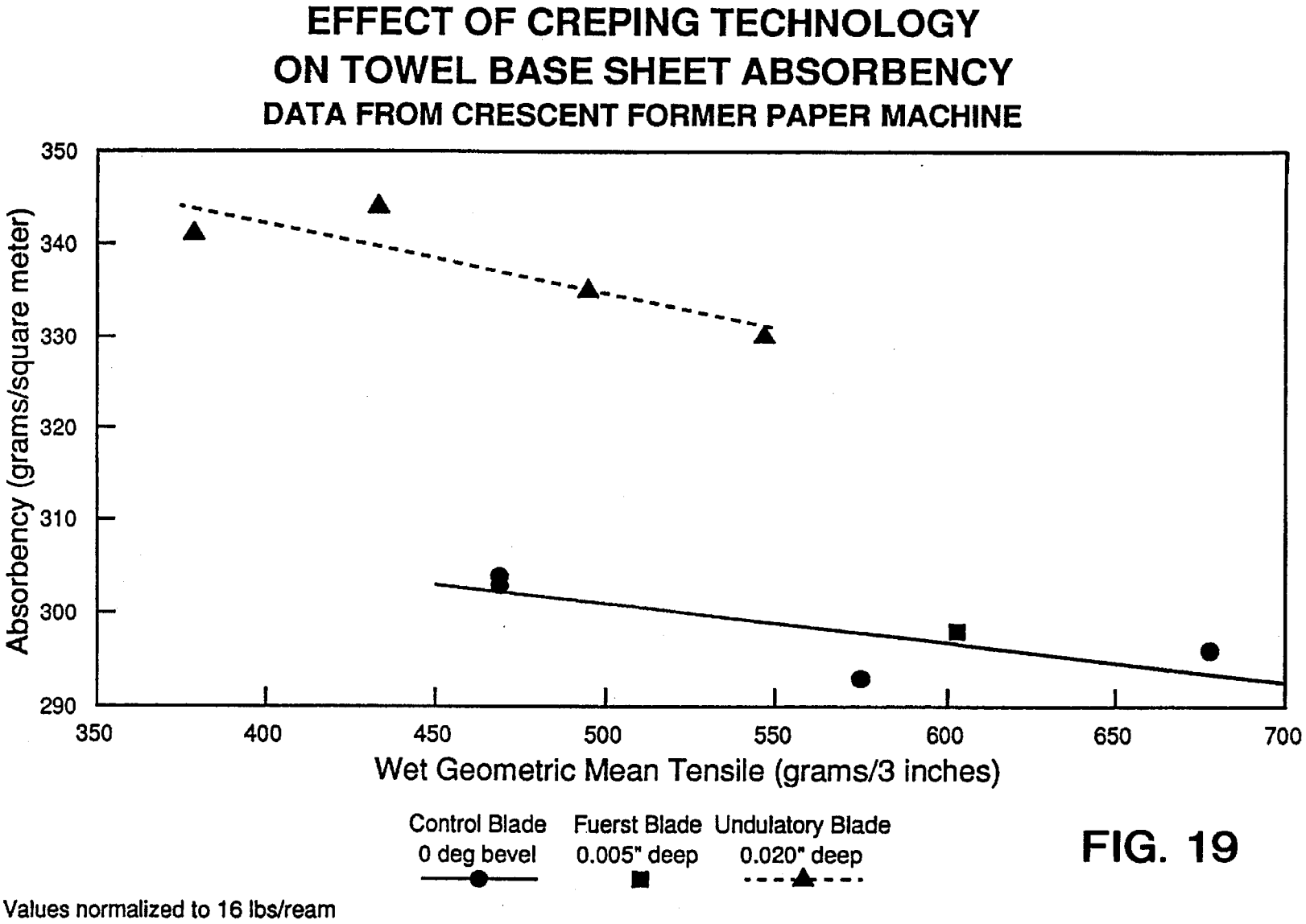
FIG. 19 illustrates the increase in absorbency values obtained when using the undulatory creping blade over the conventional blade and the blade following the teachings of Fuerst, U.S. Pat. No. 3,507,745.

The calipers of the base sheets as functions of the sheets' tensile strengths are plotted in FIG. 18. From the figure it can be seen that the base sheet made using the crepe blade described in the Fuerst patent resulted in little or no increase in specific caliper versus the control product. On the other hand, the base sheets made using the undulatory creping blade exhibited caliper values 15 to 20 percent higher than those of the control. FIG. 19 shows the absorbency of the three products as a function of their wet tensile strength. The plot indicates that the sheet made using the blade described in the Fuerst patent has an absorbency value that is similar to those exhibited by the control products. The towel base sheets made using the undulatory creping blade, on the other hand, exhibit about a 10% gain in absorbency.

Tissue base sheets were made at a targeted weight of 18 lbs/ream from the same furnish using the three creping technologies. Both uncalendered and calendered sheets were produced. The calendered sheets were all calendered at the same calender loading—10.9 pli (lbs. per lineal inch). The sheets were all made using 23% reel crepe. The physical properties of the uncalendered and calendered base sheets are shown Table 1.

TABLE 1

Physical Properties of Tissue Base Sheets

| Creping Blade Type | Control | | Fuerst | | Undulatory | |
|---|---|---|---|---|---|---|
| Calendering (pli) | — | 10.9 | — | 10.9 | — | 10.9 |
| Basis Weight (lbs/ream) | 17.65 | 17.44 | 18.24 | 17.93 | 17.63 | 17.20 |
| Caliper (mils/8 sheets) | 56.5 | 45.1 | 65.6 | 48.6 | 83.6 | 54.0 |
| | 83.6 | | | | | |
| Specific Caliper (mils/8 sheets/lb basis weight) | 3.20 | 2.59 | 3.60 | 2.71 | 4.74 | 3.14 |
| MD Tensile (grams/3 inches) | 1275 | 1386 | 1224 | 1140 | 981 | 893 |
| CD Tensile (grams/3 inches) | 972 | 1049 | 868 | 913 | 740 | 639 |
| MD Stretch (%) | 34.4 | 31.3 | 33.7 | 31.5 | 32.3 | 30.6 |
| CD Stretch (%) | 4.1 | 4.1 | 3.8 | 4.3 | 6.2 | 5.8 |
| Tensile Modulus (grams/inch/%) | — | 26.0 | — | 24.5 | — | 19.5 |
| Friction Deviation | — | 0.236 | — | 0.222 | — | 0.206 |

As can be seen from the table, the uncalendered product produced using the blade made according to the Fuerst patent had a higher uncalendered caliper than did the control sheet. However, after calendering, the sheet made using the Fuerst crepe blade exhibited only a small (approximately 5%) gain in caliper over the caliper of the control product. The product made using the undulatory creping blade, on the other hand, not only exhibits a gain in caliper over the control for the uncalendered sheet, but maintains a substantial (almost 20%) gain in caliper even after calendering. The product made using the undulatory blade is, however, at lower strength than is the control.

Tissue base sheets of a lower basis weight were also made on the pilot paper machine from the same furnish. The sheets were all made using a 36% crepe and were calendered at a calender loading of 10.9 pli. Uncalendered samples were also made. The three different crepe blades described above in Example 1 were used to crepe the product from the Yankee dryer. The physical properties of the uncalendered and calendered base sheets are shown in Table 2.

As was the case for the 18 lb/ream sheets, the tissue made using a blade described in the Fuerst patent exhibits a higher uncalendered caliper than does the control; however, this advantage is substantially negated by calendering. The calendered sheet made using the undulatory creping blade, on the other hand, had a caliper approximately 20% higher than that of the control, even after calendering. Also, the tissue base sheet made using the blade described in the Fuerst patent exhibits a friction deviation value that is approximately 35% higher than that measured for either the control or sheets produced using an undulatory creping blade. This higher friction deviation value will adversely impact the perceived surface softness of products produced from this base sheet.

TABLE 2

Physical Properties of Tissue Base Sheets

| Creping Blade Type | Control | | Fuerst | | Undulatory | |
|---|---|---|---|---|---|---|
| Calendering (pli) | — | 10.9 | — | 10.9 | — | 10.9 |
| Basis Weight (lbs/ream) | 11.57 | 11.37 | 11.68 | 11.16 | 11.08 | 11.15 |
| Caliper (mils/8 sheets) | 47.8 | 34.9 | 55.3 | 36.4 | 70.6 | 41.7 |
| Specific Caliper (mils/8 sheets/lb basis weight) | 4.13 | 3.07 | 4.75 | 3.26 | 6.37 | 3.74 |
| MD Tensile (grams/3 inches) | 368 | 428 | 322 | 389 | 310 | 290 |
| CD Tensile (grams/3 inches) | 466 | 641 | 477 | 615 | 462 | 428 |
| MD Stretch (%) | 49.4 | 45.7 | 49.3 | 45.3 | 47.8 | 42.4 |
| CD Stretch (%) | 3.1 | 4.3 | 3.3 | 4.5 | 6.7 | 5.8 |

TABLE 2-continued

| Physical Properties of Tissue Base Sheets | | | | | | |
|---|---|---|---|---|---|---|
| Creping Blade Type | Control | | Fuerst | | Undulatory | |
| Tensile Modulus (grams/inch/%) | — | 13.4 | — | 12.3 | — | 8.0 |
| Friction Deviation | — | 0.185 | — | 0.260 | — | 0.192 |

Uncalendered base sheet samples of the towel and tissues produced using the undulatory creping blade and those made using the Fuerst blade were tested using Fourier analysis. In this analysis, a sample of base sheet measuring 5.88 cm square was illuminated using low-angle lighting along the sheet's cross direction. The image of the shadows cast on the sheet by this lighting were then analyzed using discrete two-dimensional Fourier transforms to detect the presence of any periodic structures in the sheet. Because of the direction of the illumination, structures in the sheets' machine direction are highlighted.

The results of this analysis are shown in FIG. 51. FIGS. 51A, 51B and 51C show the frequency spectra for the towel, high-weight tissue, and low-weight tissue samples respectively that were creped using the undulatory creping blade, while FIGS. 51D, 51E and 51F show the frequency spectra for the same products that were produced using the Fuerst blade. All three products creped using the undulatory creping blade show a dominant peak at a frequency in the range of 0.00075 to 0.0008 cycles/micron. This frequency is equivalent to about 19 to 20 cycles/inch which corresponds to the blade's undulation frequency of 20 undulations/inch. The spectra for the products produced using the Fuerst blade, on the other hand, show little or no evidence of a dominant frequency. Instead, the results of the analysis indicate a sheet that is more-or-less uniform in the cross direction, similar to the results that would be expected from a sheet creped using a standard creping blade. This analysis again demonstrates the differences in tissue sheets produced using the undulatory creping blade of the present invention to those creped using blades of the prior art.

EXAMPLE 2

Effect of Blade Parameters on Product Properties

To properly choose an undulatory creping blade for an application, the principal blade parameters that should be specified include the undulation depth, the undulation frequency, and the blade bevel angle. The choice of the blade parameter combination will depend on the desired properties for the particular product being made. In general, the base sheet specific caliper of a product will increase with increasing undulation depth. This effect can be seen in FIGS. 21 and 22 which plot the uncalendered specific caliper of the single-ply tissue base sheets as function of the base sheets' strength. It can be seen that increasing the undulation depth from 0.010 to 0.020 inches has resulted in a specific caliper increase for base sheets made using both a 15° and a 25° beveled blade. However, it has been found that, at large undulation depths, the specific caliper of the base sheet may actually decrease as the undulation depth increases. It is believed that at these extreme undulation depths, the loss of strength resulting from use of the undulatory creping blade begins to overcome its caliper-enhancing features.

Table 3 illustrates this point. Two-ply base sheets made from a furnish containing 60% Southern Hardwood Kraft, 30% Northern Softwood Kraft, and 10% Broke were produced on a pilot paper machine which is a crescent former. The products were all made at the same targeted basis weight and to the same targeted strength. Both a standard 0° creping blade and several undulatory creping blades of various configurations were employed in the creping operation. After creping, the sheets were calendered to the same targeted caliper.

TABLE 3

| Properties of Two-Ply Tissue Base Sheets | | | | | | | |
|---|---|---|---|---|---|---|---|
| Blade Bevel (degrees) | 0 | 15 | 15 | 35 | 35 | 15 | 25 |
| Undulation Frequency (lines/inch) | 0 | 12 | 30 | 12 | 30 | 12 | 20 |
| Undulation Depth (inches) | 0 | 0.010 | 0.010 | 0.010 | 0.010 | 0.030 | 0.020 |
| Basis Weight (lbs/ream) | 9.40 | 9.31 | 9.11 | 9.33 | 9.41 | 9.38 | 9.37 |
| Caliper (mils/8 sheets) | 27.9 | 28.0 | 27.2 | 28.1 | 28.2 | 29.4 | 28.6 |
| Specific Caliper (mils/8 sheets/lb basis weight) | 2.97 | 3.01 | 2.99 | 3.01 | 3.00 | 3.13 | 3.05 |
| GM Tensile (grams/3 in) | 388 | 387 | 411 | 362 | 397 | 386 | 371 |
| Calender Loading (pli) | 9.3 | 10.9 | 12.1 | 10.9 | 12.1 | 12.1 | 15.1 |

Table 3 shows that, for all of the undulatory creping blades employed, the calender pressure loading required to obtain the caliper target was greater than that required for calendering the control sheet, indicating that the uncalendered sheets made using the undulatory creping blade were thicker than the uncalendered control sheet. It can also be seen from the table that increasing the undulation frequency from 12 to 30 undulations/inch or increasing the undulation depth from 0.010" to 0.020" or even "0.030" resulted in a higher calender pressure being needed to bring the sheet to the targeted caliper. It Should also be noted that the change in blade bevel does not seem to have significantly affected the calender pressure needed to achieve the desired sheet thickness.

The trend of increased specific caliper with increased undulation depth, however, is not seen when the depth is increased to 0.030 inches from 0.020 inches. For this change, the calender pressure needed to bring the base sheet to the targeted level actually decreased and was more similar to that needed for the sheets made using an undulatory creping blade having an undulation depth of 0.010 inches, indicating that the two sheets' uncalendered calipers are similar.

Figure 26:
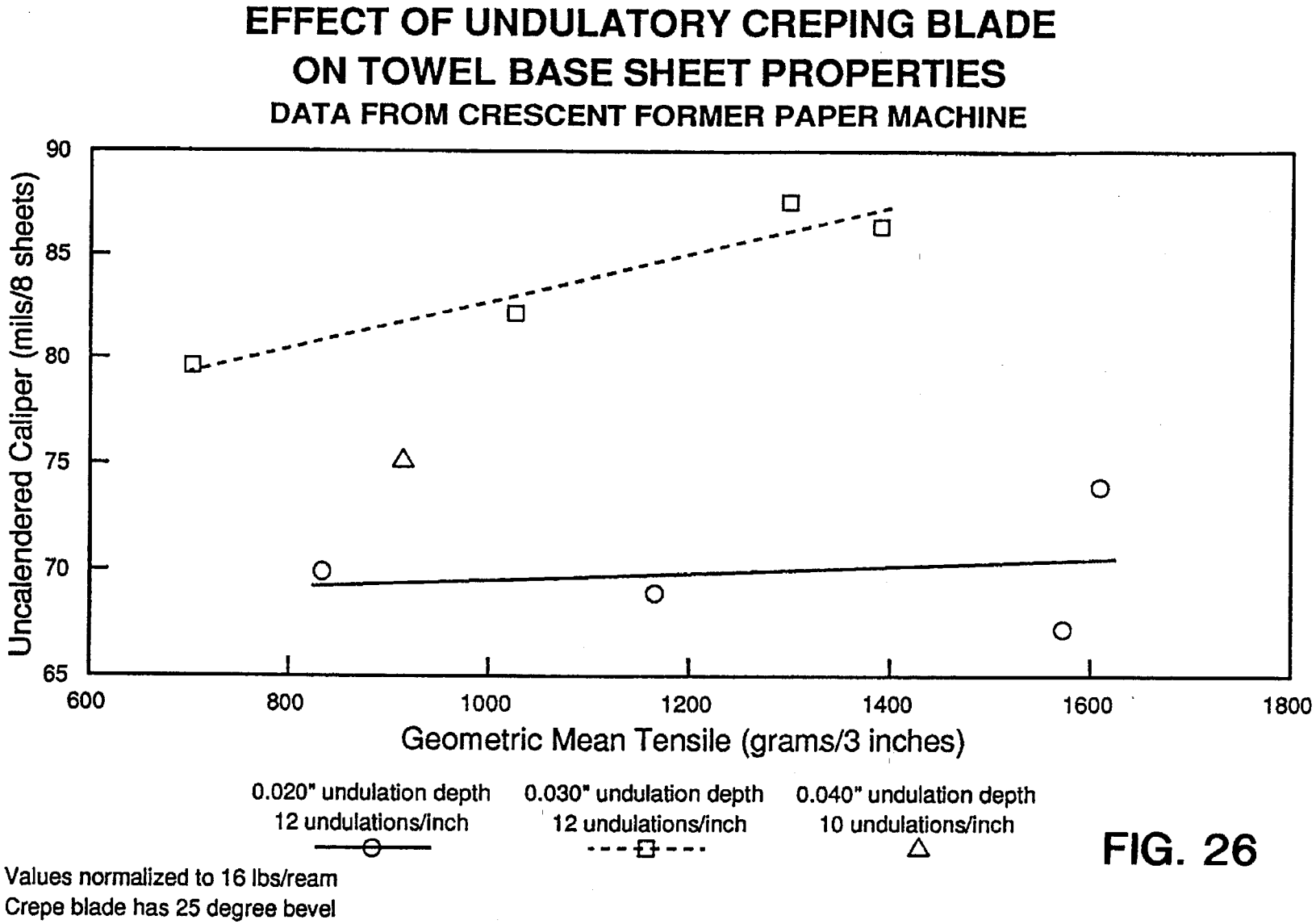
FIGS. 26 through 30 compare the physical properties of base sheets and embossed products made using undulatory creping blades having a variety of configurations.

This same effect can also be seen in FIG. 26, which plots uncalendered calipers of towel base sheets as a function of their tensile strength. These base sheets were made to a targeted basis weight of 16 lbs/ream. The furnish was 70% Southern Hardwood Kraft, 30% Southern Softwood Kraft. Twelve pounds of wet strength resin per ton of pulp was added to the furnish.

As can be seen from FIG. 26, increasing the undulation depth from 0.020 inches to 0.030 inches resulted in an increase in the base sheet specific caliper. However, when the undulation depth was further increased to 0.040 inches, the sheet's specific caliper actually fell below that seen for a sheet of similar strength made using a 0.030-inch undulation depth. It should be noted that the sheet made using the 0.040-inch undulation depth has ten undulations per inch as opposed to the 12 undulations per inch for the products made at 0.020- and 0.030-inch depths. However, it is not believed that this small difference in undulation frequency will have a significant effect on specific caliper, and, in any case, any specific caliper loss due to a decreased undulation frequency would be expected to be more than compensated for by the increased undulation depth.

Figure 27:
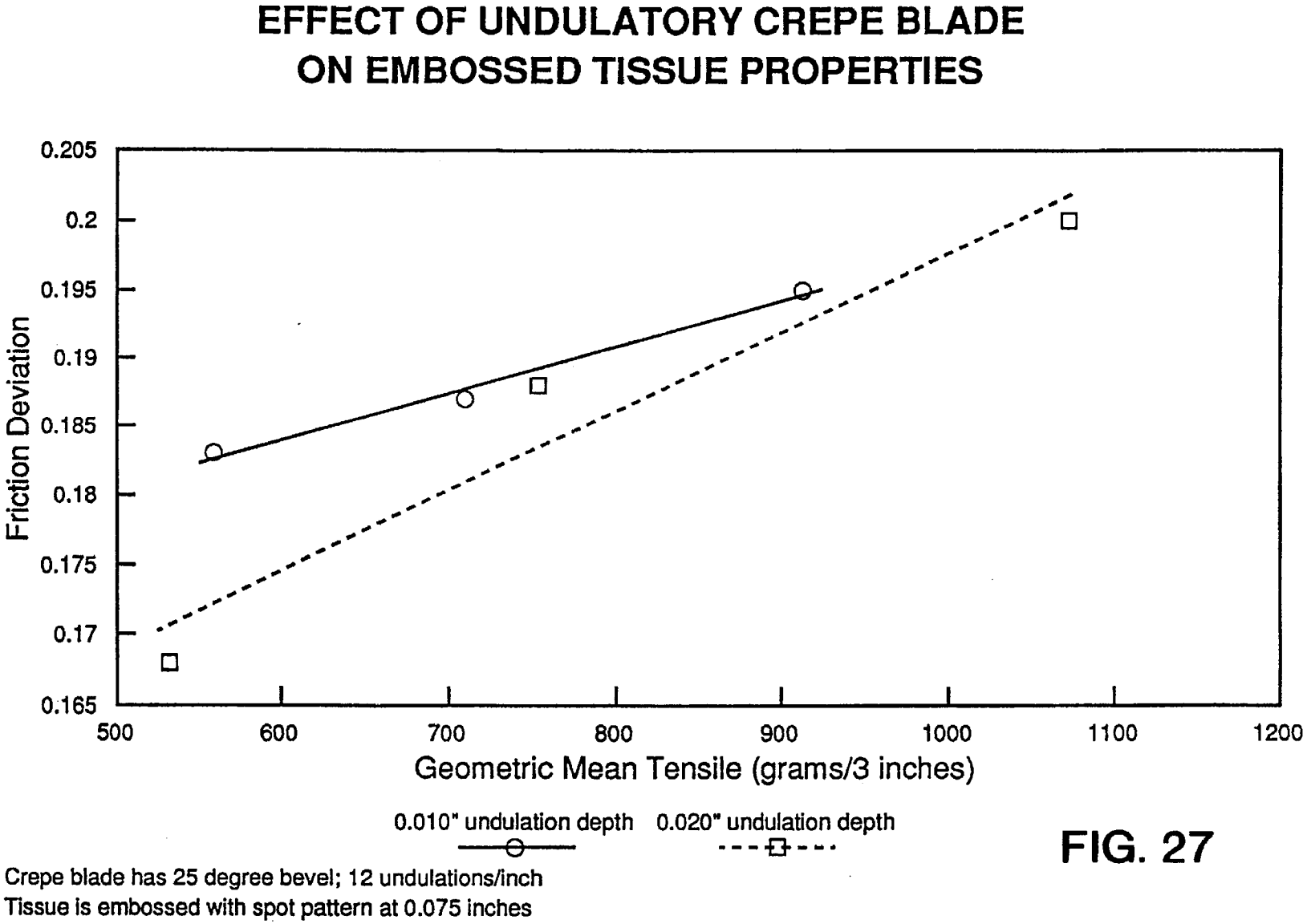

As additional evidence of the effect of undulation depth on tissue properties, it has been found that, for single-ply CWP tissue products, an increase in the blade's undulation depth can correspond to a reduction in the friction deviation of the embossed finished product. This reduction, which correlates to an increase in surface softness, can be seen in FIG. 27, which plots the products friction deviation as a function of the tissue's strength. These tissues were made from a furnish consisting of 50% Northern Softwood Kraft, 50% Northern Hardwood Kraft and were all calendered using a calender pressure of 10.8 pli. The base sheets were then embossed using a spot emboss pattern at an emboss depth of 0.075 inches. It can be seen that the products made using the undulatory creping blade having a 0.020-inch undulation depth have lower friction deviations, and thus better surface softness properties than do the products made using a blade that had an undulation depth of 0.010 inches. This improvement in product softness is probably due to the additional calendering action applied to the increased caliper of the base sheet made using the 0.020-inch depth blade.

The undulation frequency also has an impact on the properties of the towel and tissue products made using the undulatory creping blade. As was noted above, fox the two-ply tissue base sheets, increasing the number of undulations per inch from 12 to 30 necessitated an increase in calendering pressure to achieve a targeted caliper level.

Figure 28:
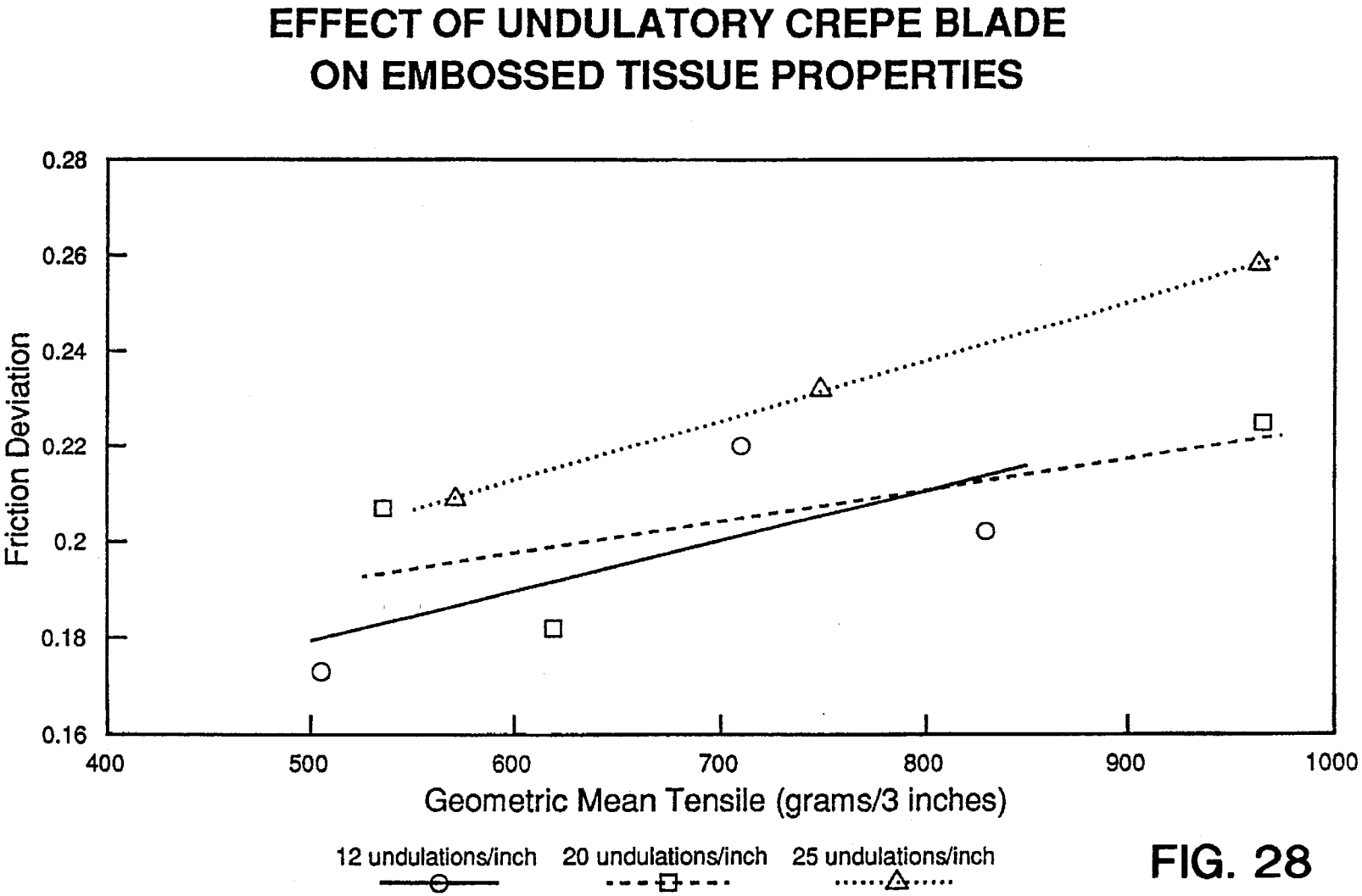

For the single-ply tissue product described above, changing the undulation frequency had no substantial impact on the base sheet specific caliper. However, other tissue properties were affected. Tissue sheets were made at an undulation depth of 0.010 inches having several undulation frequencies. The base sheets were all calendered at the same level (10.8 pli) and embossed using a spot emboss at a 0.075-inch emboss depth. FIG. 28 shows the friction deviation of the embossed products as a function of the product strength. Although there is scatter in the data, it can be seen that increasing the undulation frequency from 12 to 25 undulations per inch seems to have resulted in an increase in product friction deviation, correlating to a decrease in surface softness.

Another important product aspect that will be impacted by the undulation frequency is that of appearance. Even after calendering and embossing operations, the machine direction ridges produced by the undulatory creping blade can be seen in the product. The pattern produced in the product by the undulatory blade, especially when overlaid by an emboss pattern, will impact the product's appearance and may influence its acceptance by consumers.

Figure 29:
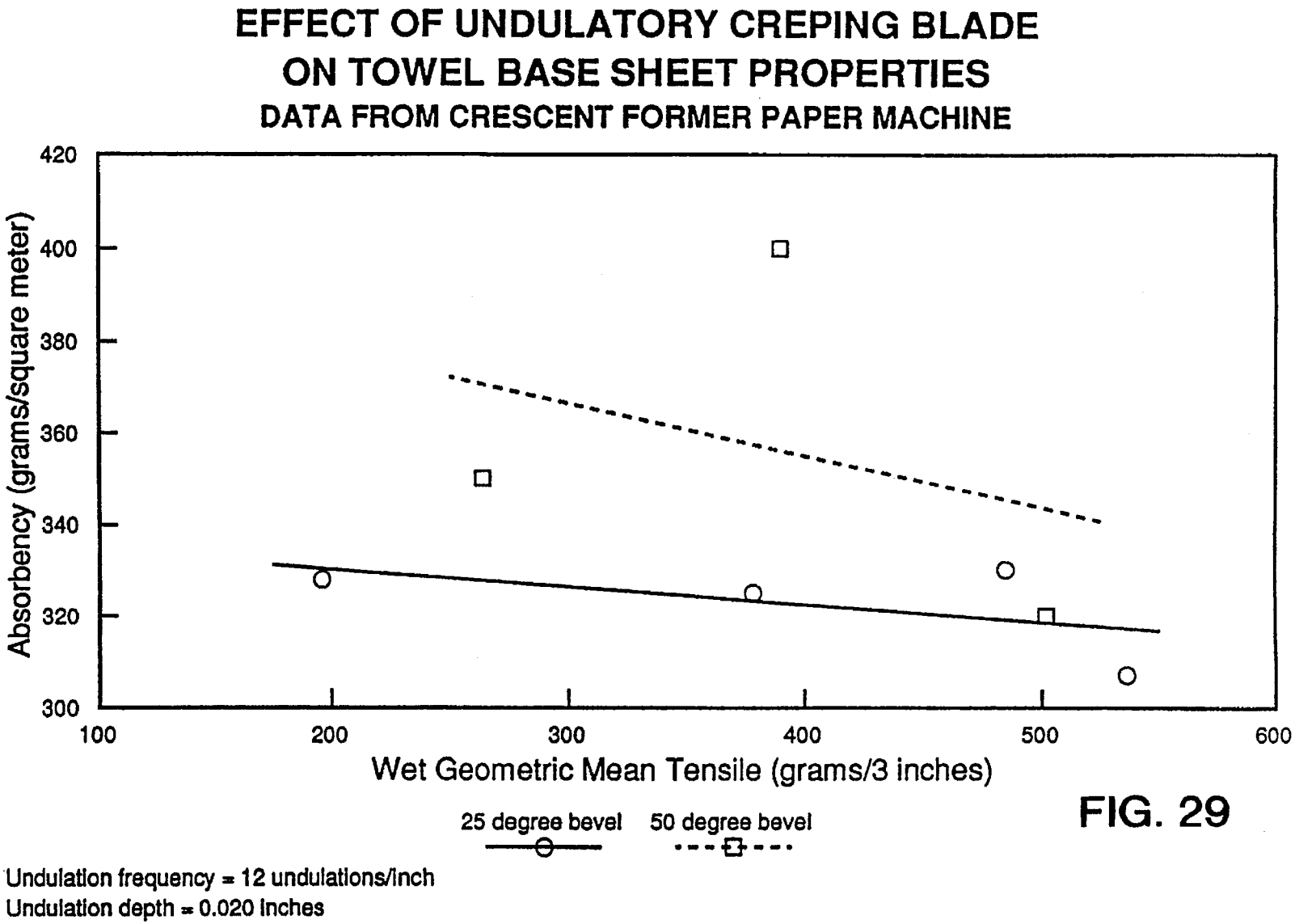
Figure 30:
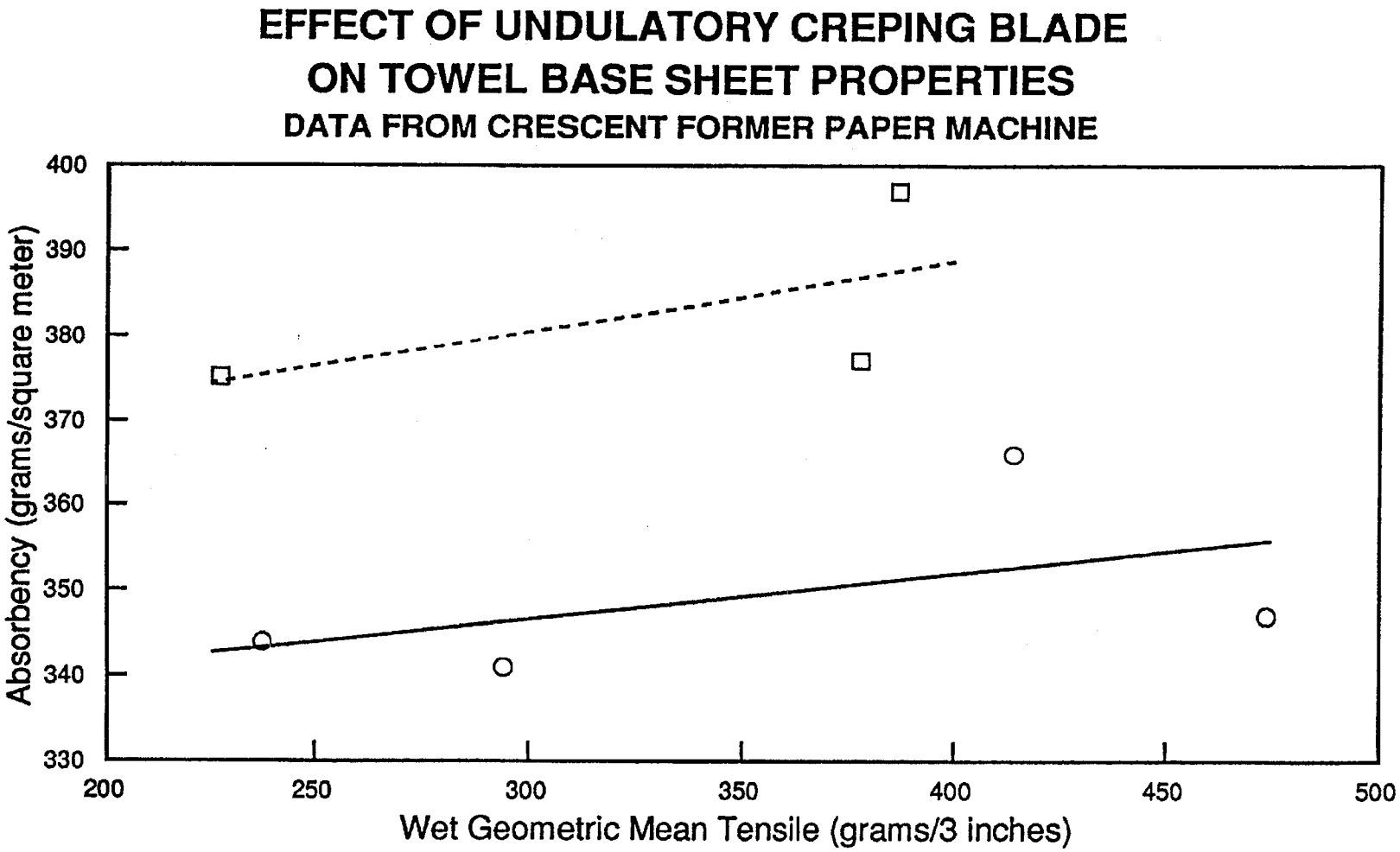

The other important blade parameter, blade bevel, has been shown to impact the absorption properties of towel base sheets. FIGS. 29 and 30 illustrate the finding that increasing the blade bevel from 25° to 50° has resulted in an increase in absorptive capacity of the towel base sheets for undulatory creping blades having undulation depths of 0.020 and 0.030 inches.

Changing the blade bevel appears to have less of an effect on single- and two-ply tissues' thickness and softness properties. However, the choice of blade bevel will have an impact on the ease with which a blade having a desired undulation depth and frequency can be made. Especially at the deeper undulation depths, the serrulation or knurling process is facilitated by use of blades having a greater bevel angle, as it is necessary to deform and displace less metal during the serrulation process.

It should also be noted that the choice of blade bevel can also impact the ease with which a particular product can be made. For the two-ply base sheets discussed above, it was noted that tissue sheets were made using a blade having a 15° bevel, an undulation depth of 0.030 inches, and an undulation frequency of 12 undulations per inch. An attempt was made to produce a similar product using a blade having the same undulation depth and frequency, but a blade bevel of 35°. This attempt was unsuccessful as the sheet produced by this blade had numerous holes, with resulting low strength and poor runnability. Thus, as described herein, for some products, certain combination of blade parameters will prove less practical as they will either fail to easily produce product or will manufacture sheets of inferior quality. Desirable combinations of blade parameters may be easily identified by routine experimentation guided by the principles taught herein.

From the above discussion, it can be seen that the particular combination of undulation frequency, undulation depth, and crepe blade bevel angle that is chosen for a particular application will depend on the particular product being made (tissue, towel napkin, etc), the basis weight of the product, and what properties (thickness, strength, softness, absorbency) are most important for that application. For most tissue and towel products, it is believed that blade bevels in the range of 0° to 50°, undulation frequencies of 10 to 50 undulations/inch, and undulation depths of 0.008 to 0.050 inches will be most suitable.

EXAMPLE 3

This example illustrates the use of an undulatory creping blade where the serrulations are cut at a side relief angle of about 35°. Tissue base sheets were made from a furnish containing 50% Northern Softwood Kraft, 50% Northern Hardwood Kraft. The sheets were creped from the Yankee dryer at 20% crepe using undulatory crepe blades. The blades both had a bevel angle of 25°, an undulation frequency of 16 undulations/inch and an undulation depth of 0.025 inches. For one of the blades, the undulations were perpendicular to the back surface of the blade yielding what we prefer to call right angle serrulations, i.e. the axes of symmetry of the serrulations were substantially perpendicular to the relief face of the blade as shown in FIG. 5F; for the other blade, the undulations were cut at a side relief angle of 35° as shown in FIG. 5G. The physical properties of the uncalendered sheets produced using these blades are shown in Table 4. For reference, a base sheet at approximately the same strength using a control (square) crepe blade is also included.

TABLE 4

Physical Properties of Tissue Base Sheets

| Blade Type | Control | Undulatory | Undulatory |
|---|---|---|---|
| Side Relief Angle (°) | — | 0 | 35 |
| Basis Weight (lbs/ream) | 17.42 | 16.6 | 17.13 |
| Caliper (mils/8 sheets) | 62.6 | 79.3 | 68.8 |
| Specific Caliper (mils/8 sheets/lb basis weight) | 3.59 | 4.78 | 4.02 |
| MD Tensile (grams/3 inches) | 1689 | 1711 | 1614 |
| CD Tensile (grams/3 inches) | 778 | 788 | 858 |
| MD Stretch (%) | 29.7 | 29.0 | 27.3 |
| CD Stretch (%) | 5.1 | 6.5 | 6.0 |

From the table, it is clear that use of either undulatory blade resulted in an increase in specific caliper relative to the control sheet. However, the blade having a side relief angle of 0 degrees of the blade produced a higher gain in specific caliper over the control than did the blade in which the side relief angle was 35 degrees.

EXAMPLE 4

This example illustrates higher uncalendered specific caliper obtained in sheets made using the undulatory blade. Tissue base sheets were manufactured on a crescent former papermaking machine from a furnish containing 50% Northern Softwood Kraft; 50% Northern Hardwood Kraft. The base sheets were all made at a targeted weight of 18 lbs/ream and were creped at a blade, or holder, angle $\gamma_f$ of 17°. All sheets were sprayed with 3 pounds of softener per ton of pulp. Three blade types were employed in this study: a blade having a 0° bevel, a blade having a bevel of 15°, and a blade with a 25° bevel. For each blade type, base sheets were manufactured at various strength levels that were achieved by addition of starch to the Northern Softwood Kraft portion of the furnish. Base sheets were also made using undulatory blades which had the same three blade bevel angles. The various combinations of blade bevel, number of undulations/inch, and an undulatory depth that were employed in this study are shown in Table 5.

TABLE 5

Undulatory Crepe Blades Used in Tissue Study

| Blade Bevel (deg) | Undulations/Inch | Undulation Depth (in) |
|---|---|---|
| 0 | 20 | 0.010 |
| 15 | 12 | 0.010 |
| 15 | 20 | 0.010 |
| 15 | 25 | 0.010 |
| 15 | 12 | 0.020 |
| 15 | 16 | 0.020 |
| 15 | 20 | 0.020 |
| 25 | 12 | 0.010 |
| 25 | 20 | 0.010 |
| 25 | 12 | 0.020 |
| 25 | 20 | 0.020 |

Figure 20:
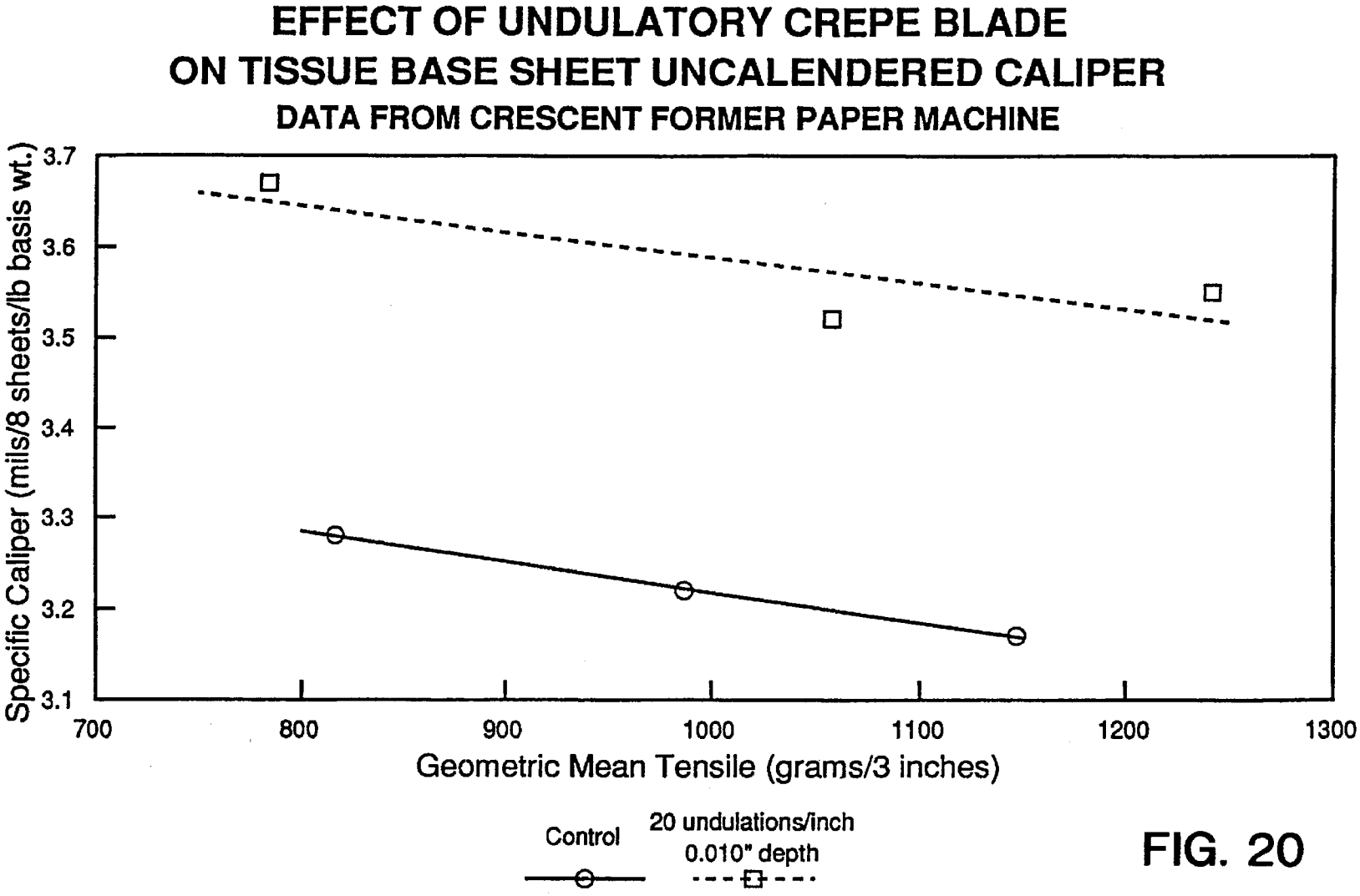
FIG. 20 shows the effect of the undulatory creping blade on base sheet uncalendered caliper as compared to caliper obtained using a conventional unbeveled creping blade.
Figure 21:
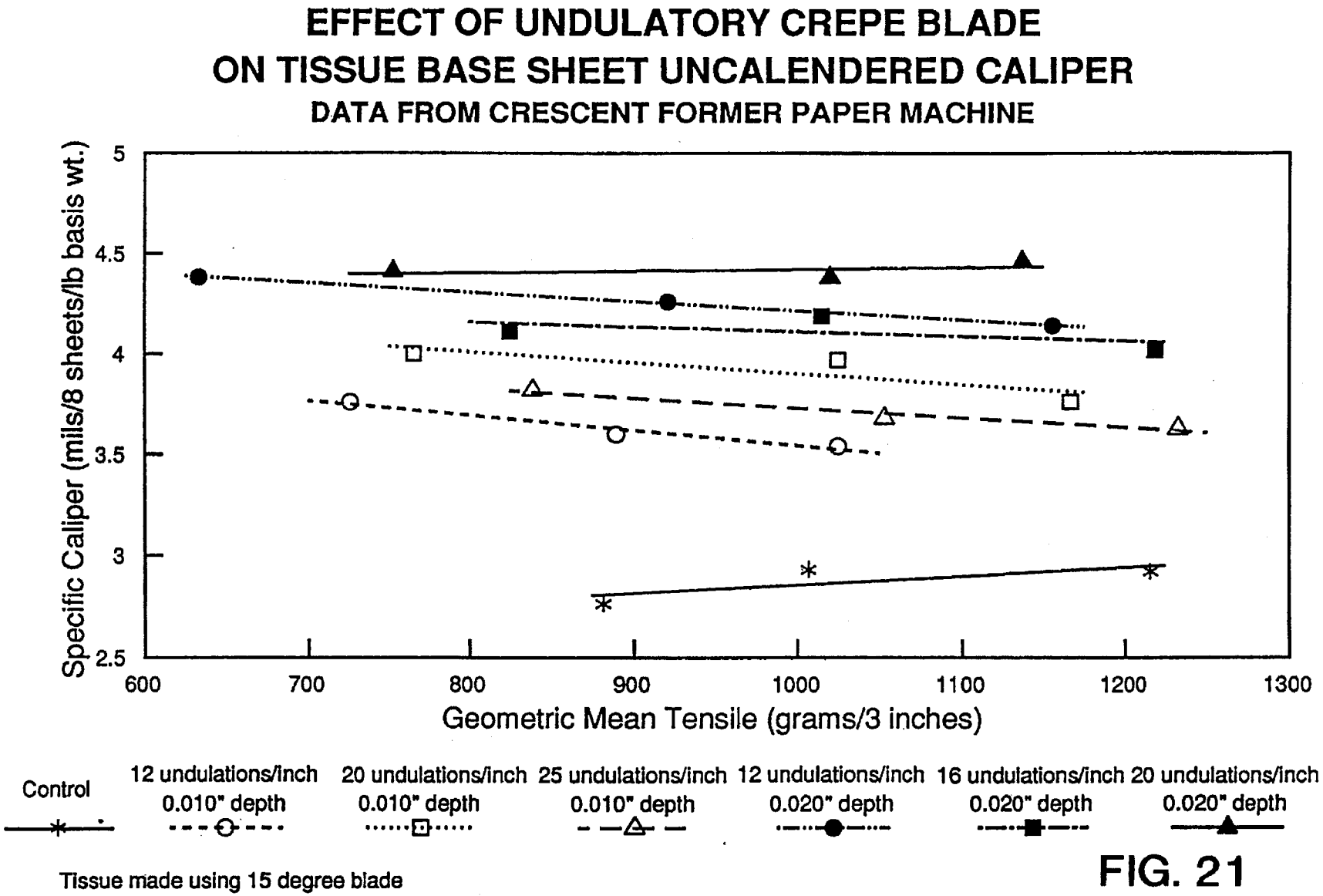
FIGS. 21 and 22 show the effect of the undulatory creping blade on base sheet uncalendered caliper using a conventional beveled blade as control.
Figure 22:
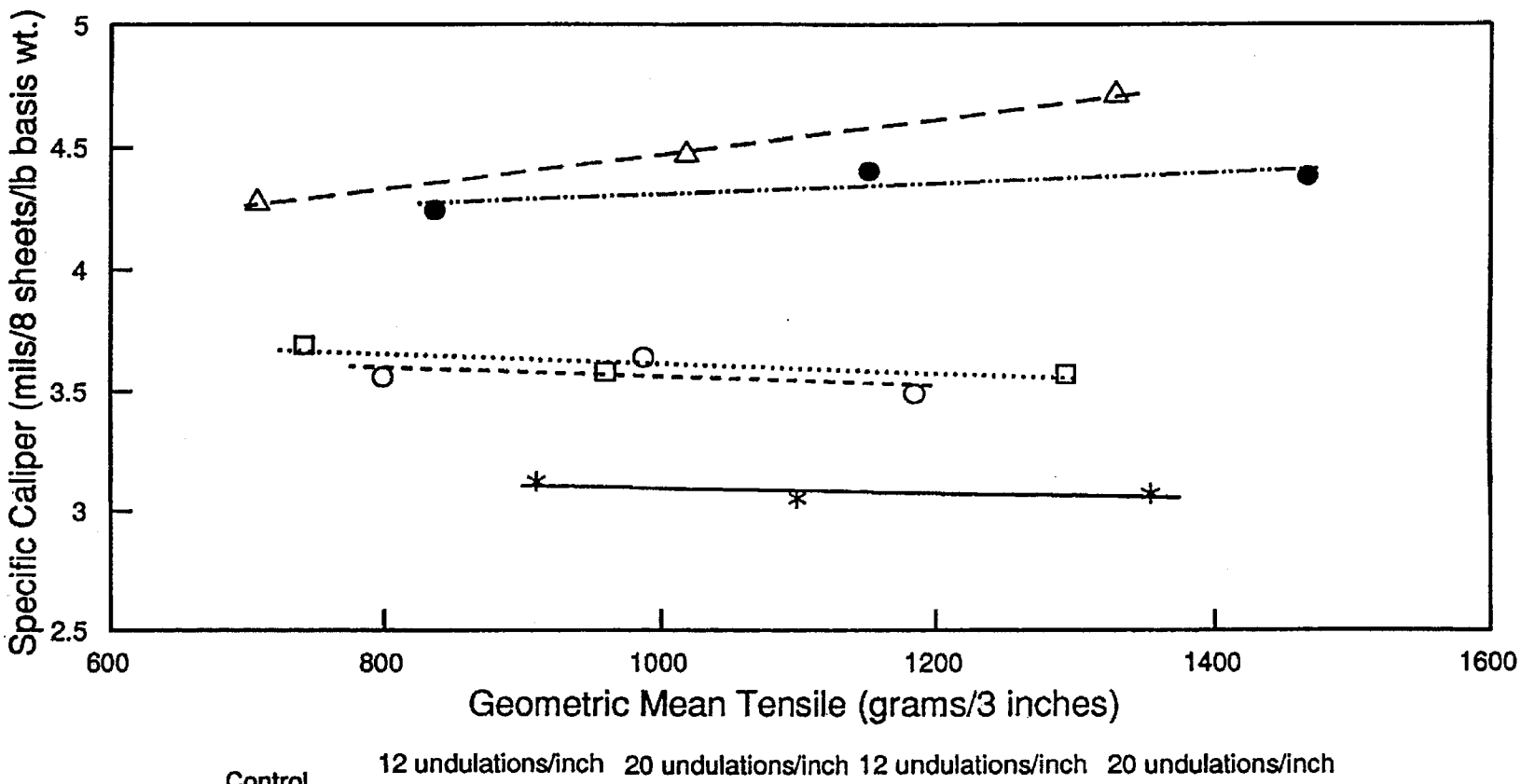

The uncalendered specific calipers of the various base sheets made using the undulatory crepe blades are shown as functions of their tensile strengths in FIGS. 20, 21, and 22. Each figure shows the results for the base sheets made at one of the three blade bevels employed in the study. As can be seen from FIGS. 20, 21 and 22, in every case, the sheets made using the undulatory creping blades exhibit a higher uncalendered specific caliper than do the sheets made using the conventional blades. In some cases, gains of 50% or more are seen.

Figure 23:
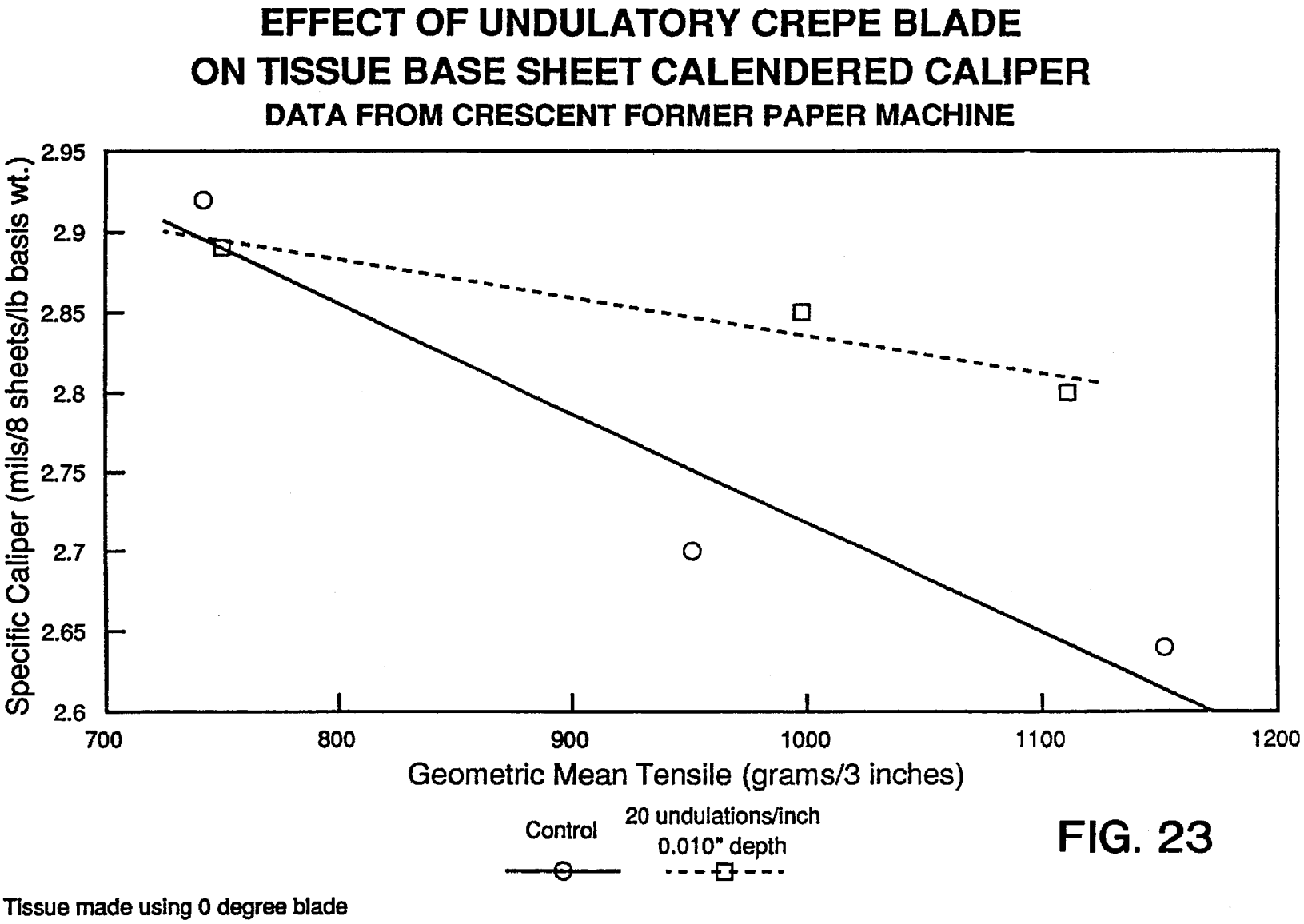
FIGS. 23 and 24 show the effect of the undulatory creping blade on base sheet calendered caliper as compared to caliper obtained using regular creping blades.
Figure 24:
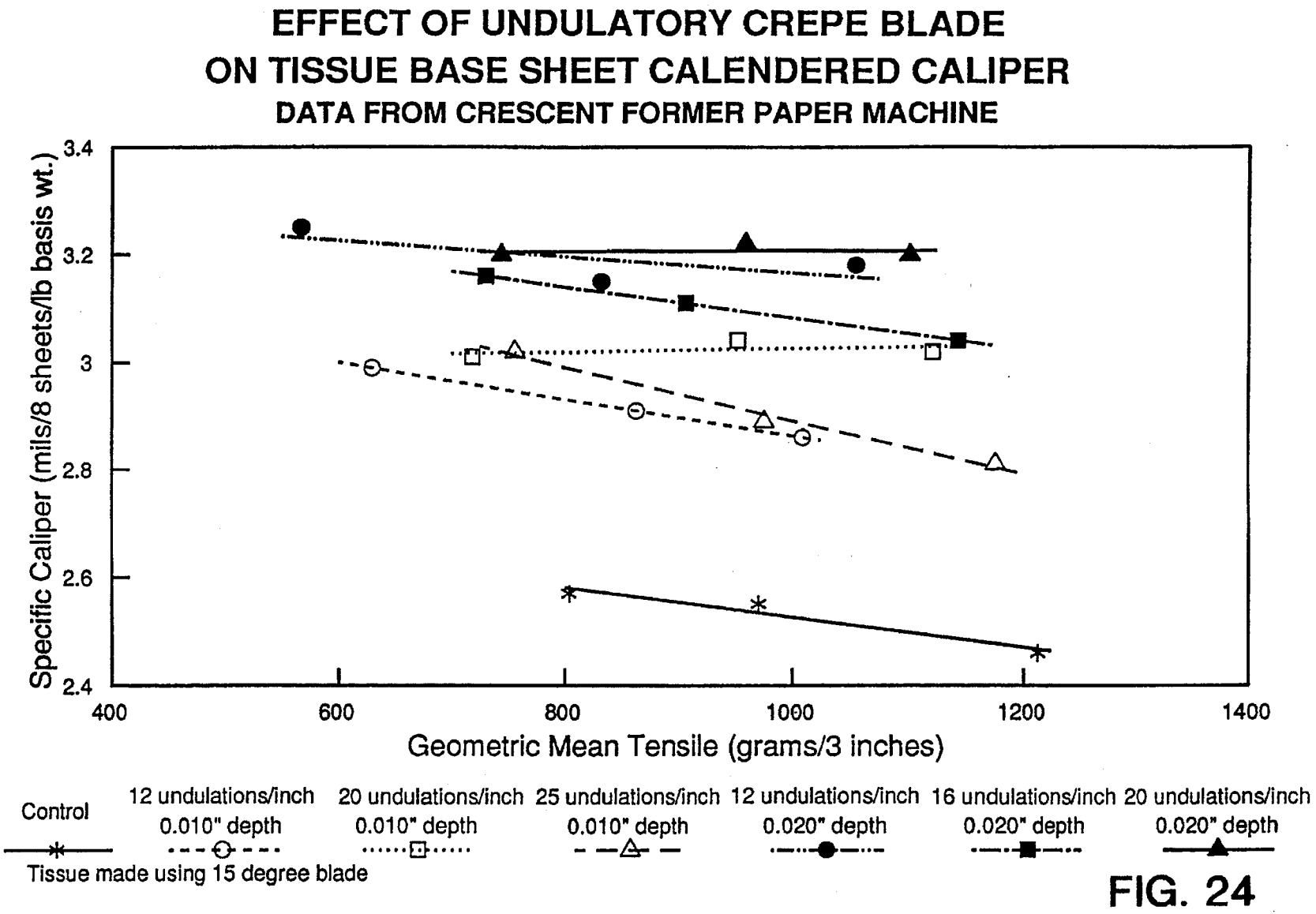
Figure 25:
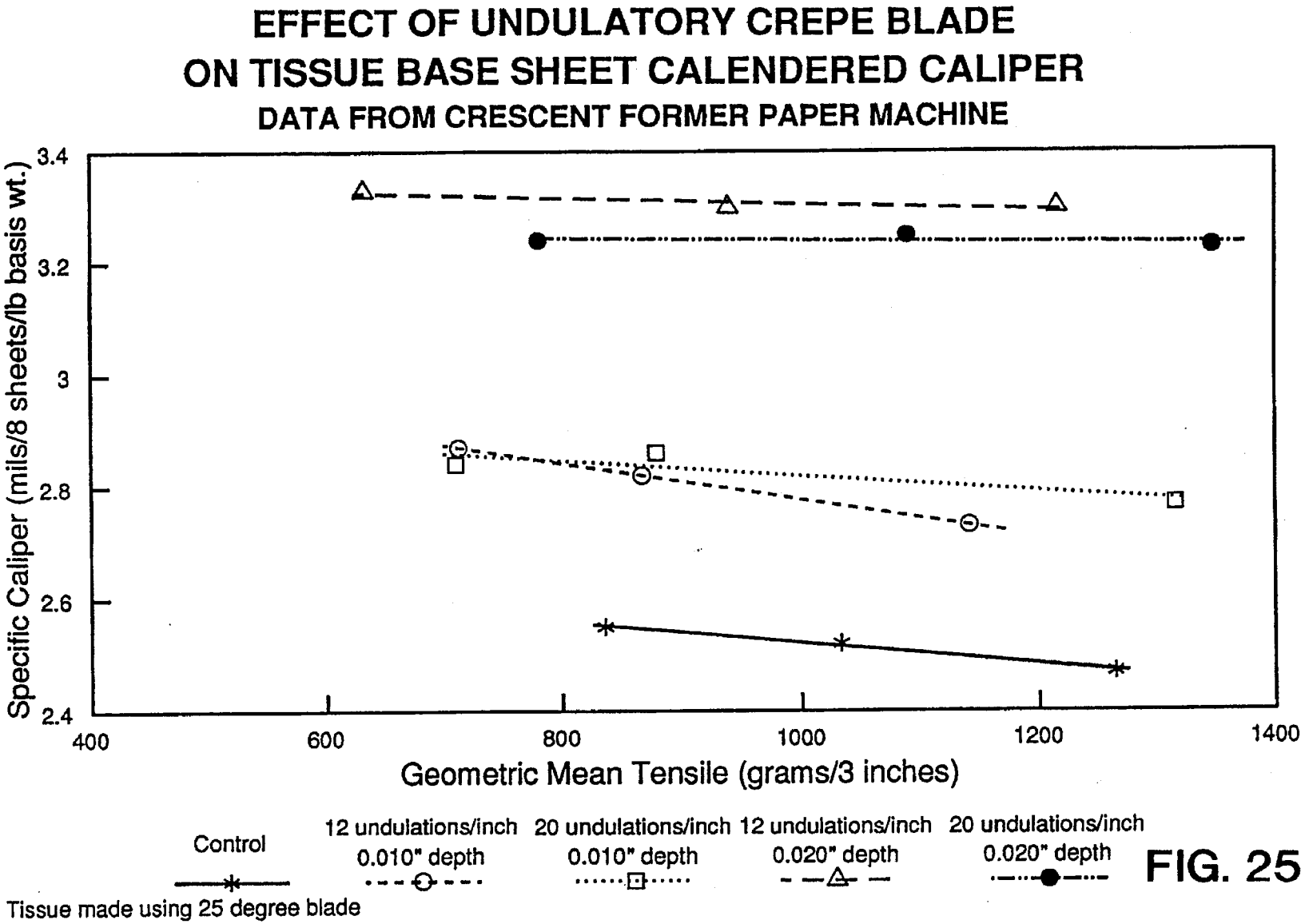
FIG. 25 illustrates the effect of an undulatory creping blade on tissue base sheet calendered caliper.

FIGS. 23, 24 and 25 show results for the calendered products made using the same crepe blades as mentioned above. The products were all calendered at a level of 10.8 pli. The products made using the square (0° bevel angle) undulatory blade do not show a large specific caliper gain with use of the undulatory crepe blade—at least not at low strength levels (FIG. 23). However, both the undulatory blades with bevel angles of 15° and 25° show large gains in calendered specific caliper with use of the undulatory crepe blade. In some cases, a gain in specific caliper of over 20 percent is observed.

EXAMPLE 5

This example illustrates that when embossing single-ply tissue made using undulatory blades of the present invention, base sheet gains in specific caliper are maintained. Calendered single-ply tissue base sheets were embossed on pilot plant embossing equipment at various emboss depths to determine the impact of embossing on tissue base sheets made using the undulatory blade creping technology. Three base sheets from the previous example were selected for this trial: a control sheet creped using a square (0°) blade that was not undulatory, and two base sheets produced using an undulatory blade. The undulatory blades were a 25° beveled blade that had been knurled at a frequency of 20 lines/inch and a depth of 0.020 inches and a 15° beveled blade that had been knurled using the same undulation frequency and depth. The base sheets were all calendered at the same level (10.8 pli). All three base sheets were embossed using a spot emboss pattern at three penetration depths: 0.060, 0.075, and 0.090 inches.

Figure 31:
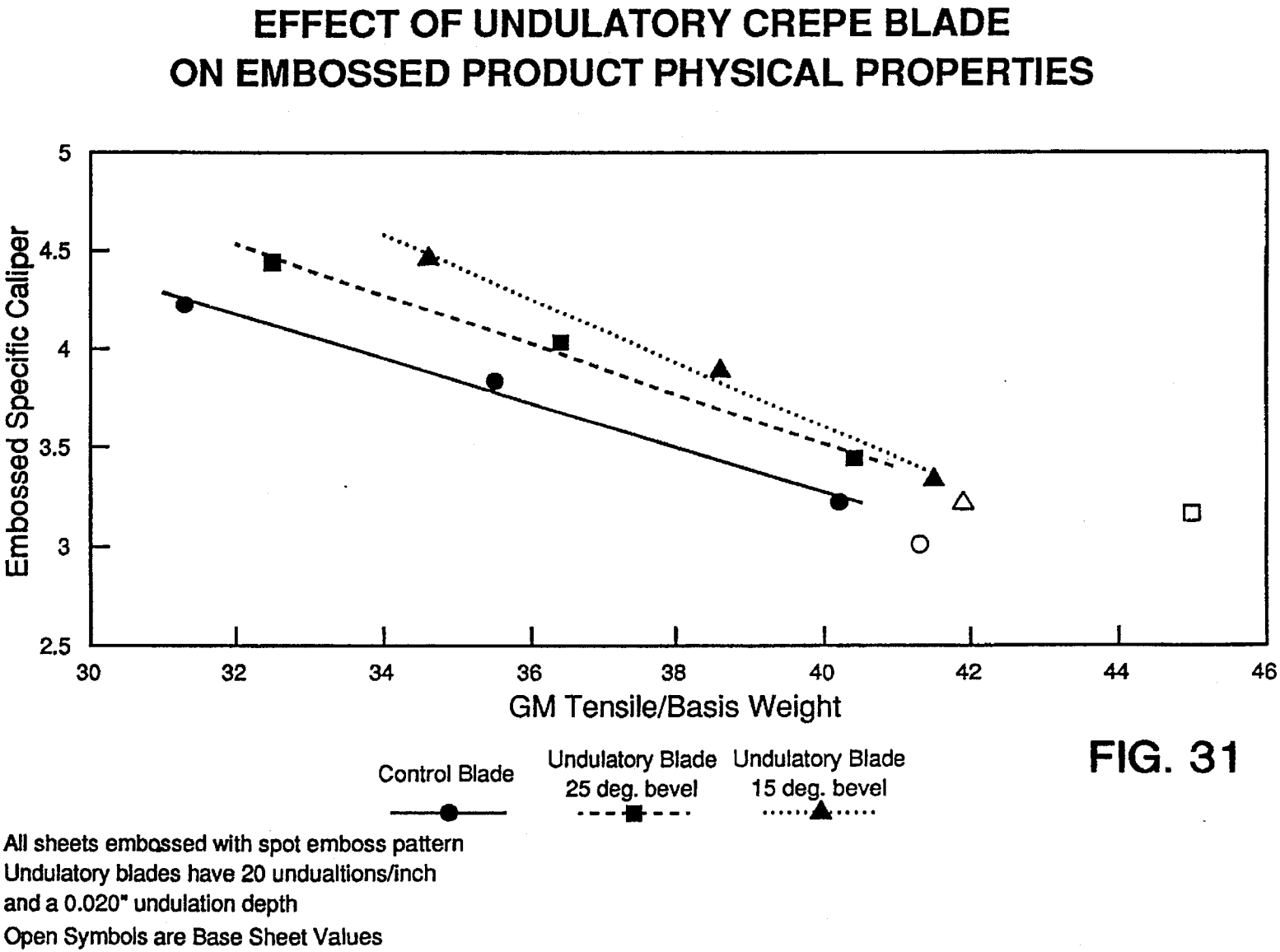
FIG. 31 illustrates the caliper obtained after embossing of sheets creped using an undulatory creping blade as compared to conventional sheets.

The results of this embossing are shown in FIG. 31, which presents embossed product caliper/basis weight as a function of GM tensile/basis weight. The values for the unembossed base sheets' caliper divided by basis weight (which we term "specific caliper") used in the trial are also shown. As can be seen from the graph, the base sheet ratio of caliper to basis weight for the two products made using the undulatory crepe blades were higher after embossing than was that of the control sheet. The graph also shows that the thickness of the embossed product is greater for the sheets made using the undulatory crepe blade for all emboss depths, indicating that the advantage in specific caliper shown by the base sheets made using the undulatory crepe blade technology is maintained throughout embossing.

EXAMPLE 6

This example illustrates the basis weight of the sheets can be reduced without affecting adversely the uncalendered caliper. Tissue base sheets were manufactured on a crescent former paper machine using a furnish containing 50% Northern Softwood Kraft/50% Northern Hardwood Kraft. Sheets were made at a basis weight of 18 lbs/ream using a conventional (0°) crepe blade at a blade angle $\gamma_F$ of 17°. Tissue base sheets were also made at a target basis weight of 14 lbs/ream from the same furnish using an undulatory crepe blade having a blade bevel of 25°. The blade had 20 undulations/inch and an undulatory depth of 0.020 inches. The blade angle $\gamma_F$ employed was 17°. For both the control and the undulatory-blade base sheets, products of different strengths were produced by addition of starch to the Northern Softwood Kraft portion of the furnish. Both calendered and uncalendered base sheet samples were produced. The base sheets were tested for basis weight, caliper, and machine direction and cross direction tensile.

Figure 32:
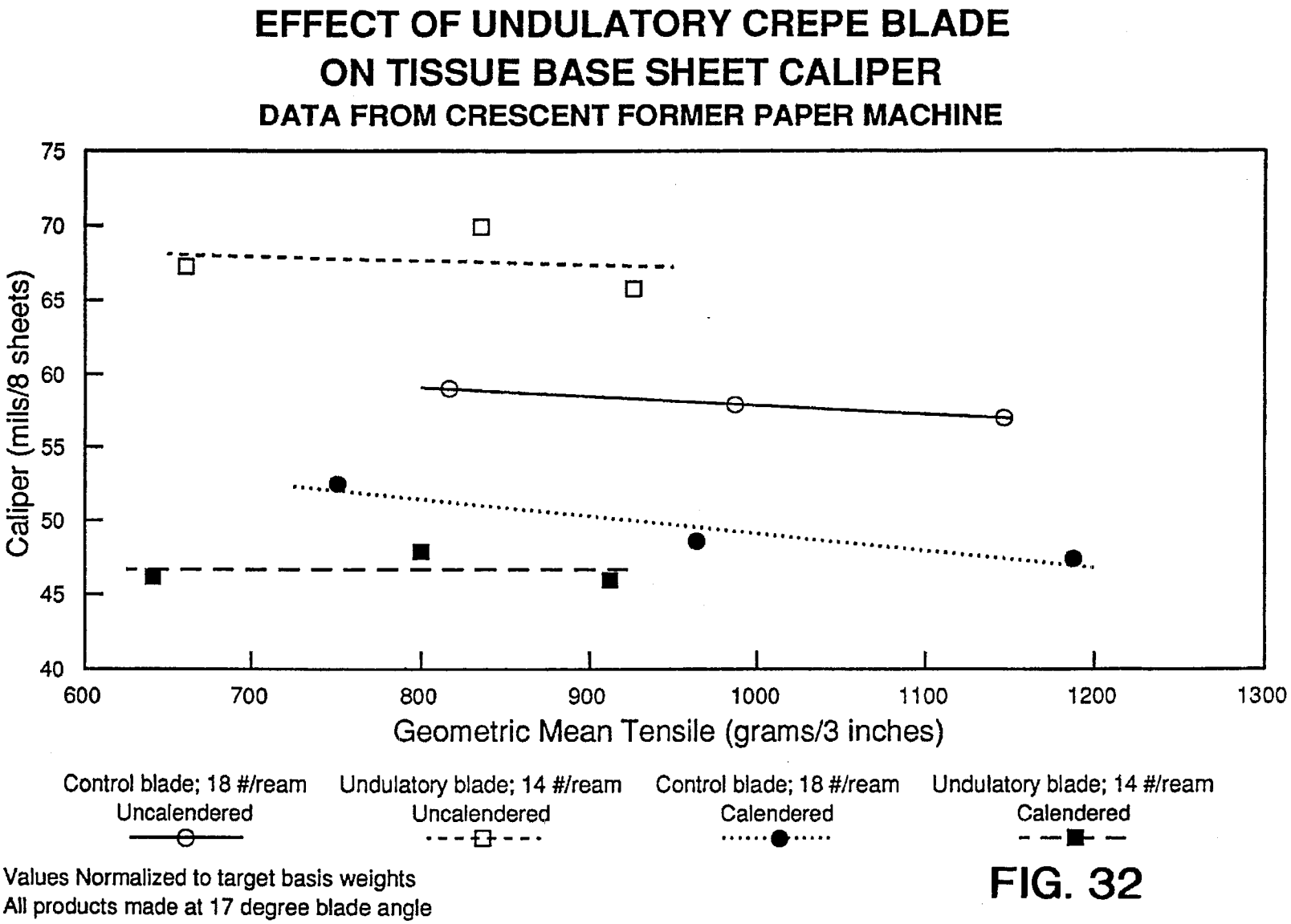
FIG. 32 illustrates caliper of calendered and uncalendered sheets of low basis weight creped using undulatory creping blades as compared to caliper achieved with conventional blades.

The results of these physical tests are summarized in FIG. 32, which shows the caliper of the calendered and uncalendered base sheets as functions of their tensile strengths. In this figure the caliper and strength values have been normalized to the targeted base sheet basis weights (18 and 14 lbs/ream). FIG. 32 shows that, even at a 22% reduction on basis weight, the sheets made at 14 lbs/ream using the undulatory blade have a higher uncalendered caliper than do the control sheets made using the conventional creping blade at a weight of 18 lbs/ream. When the sheets were calendered at a pressure of 10.8 pli, the 18 lb/ream sheets did have slightly higher calipers than did the 14 lb, undulatory blade tissues; however, the results do indicate that use of the undulatory blade technology will allow production of sheets having calipers equal to conventionally creped base sheets at a substantial reduction in basis weight.

The base sheets produced during the machine trial described above were converted into finished tissue products by embossing the base sheets with a spot emboss pattern. The embossed products were tested for physical properties including tensile modulus, which is a measure of the tissues' bulk softness, and friction deviation which is an indicator the tissue's surface softness.

Figure 33:
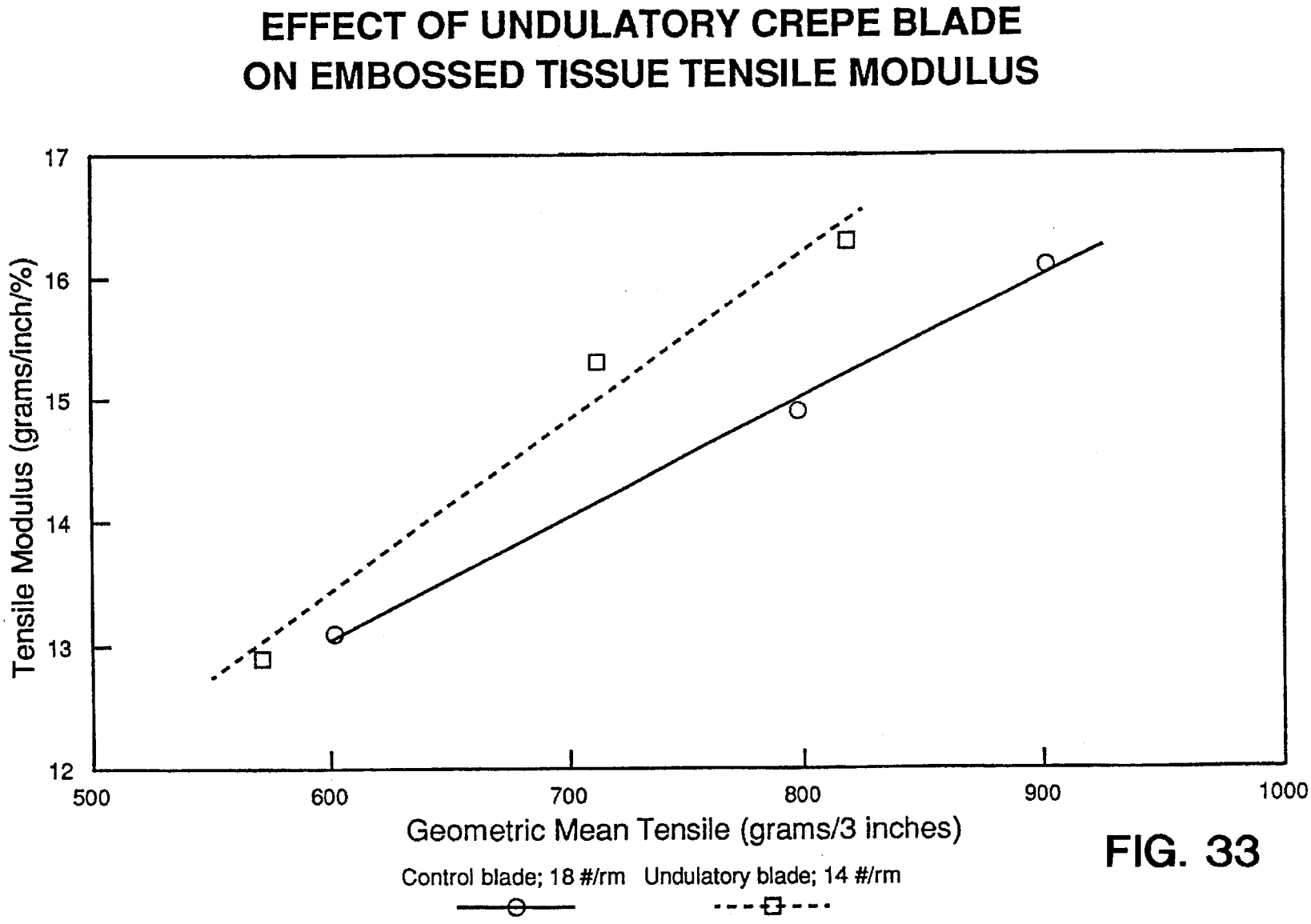
FIG. 33 shows tensile modulus of single-ply embossed tissue creped using an undulatory creping blade.
Figure 34:
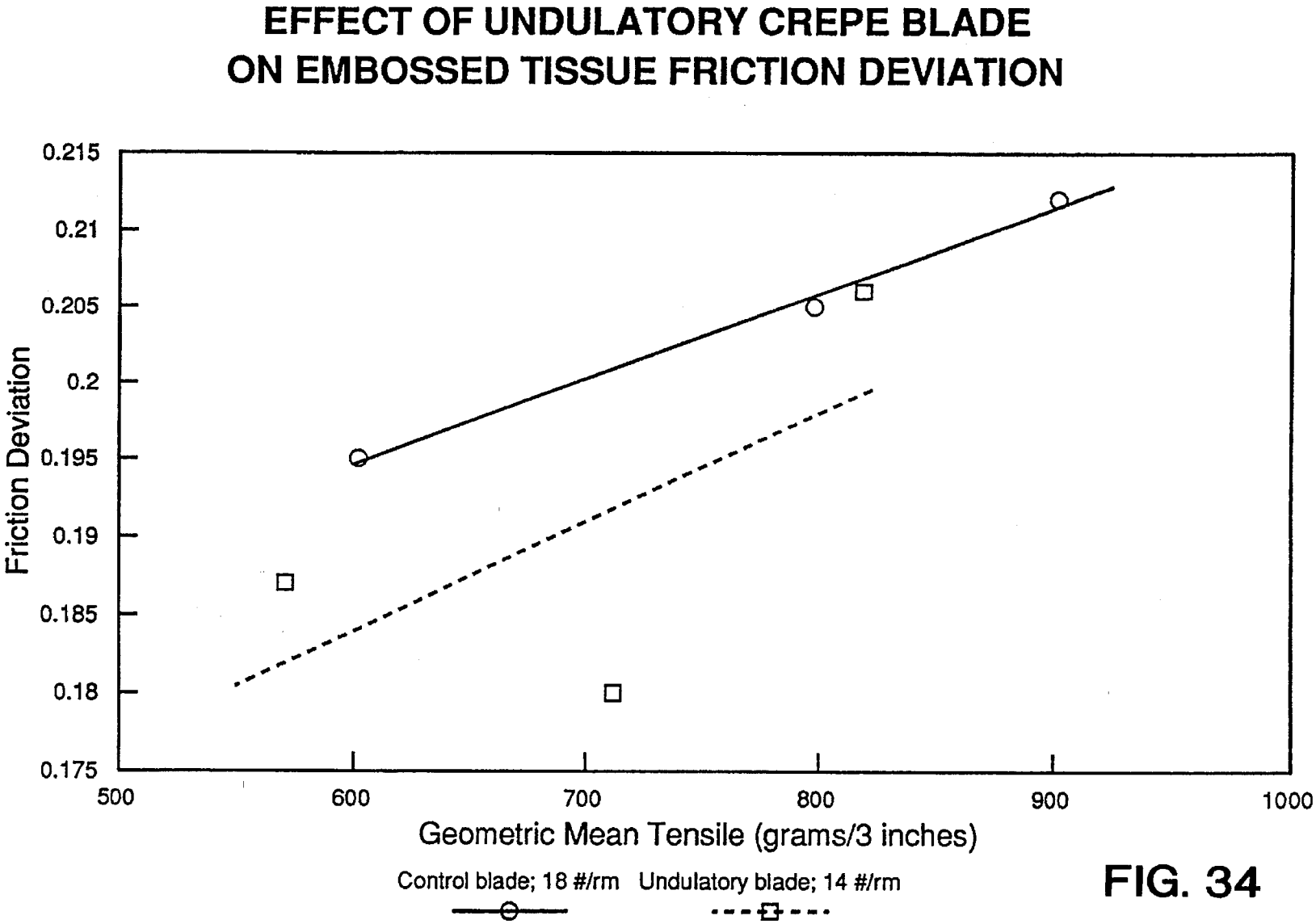
FIG. 34 shows friction deviation of single-ply embossed tissue creped using an undulatory creping blade.

The results of these tests are indicated in FIGS. 33 and 34, which plot the tensile modulus and friction deviation respectively against the embossed product's strength. From the graphs it appears that, in general, at similar strength levels, the lighter-weight product made using the undulatory crepe blade has a slightly higher tensile modulus and a lower friction deviation than does the control product. These results indicate that the tissue made at the lower weight using the undulatory crepe blade has a slightly lower bulk softness and a somewhat higher surface softness than does the higher-weight, conventionally creped tissue.

EXAMPLE 7

This example illustrates that when using the undulatory blade, a softer single-ply tissue can be obtained. A tissue base sheet was made on a commercial paper machine using the undulatory crepe blade. The blade employed had a blade bevel of 25°, an undulation frequency of 20 per inch and a undulation depth of 0.020 inches. The base sheet was stratified with the Yankee-side layer making up 30% of the sheet and the air-side layer containing the remaining 70%. The Yankee-side layer was composed of 100% West Coast Softwood Kraft, while the air side layer contained 36% West Coast Softwood Kraft, 36% Eucalyptus, and 28% Broke. The base sheet was made using a crepe of 17.5%. The base sheet's physical properties are shown in Table 6. The properties of a conventional base sheet, made on the same machine using the same furnish, but employing a conventional (square) creping blade, are also shown in Table 6. This sheet, however, was produced using 19.0% crepe. Both base sheets were gap calendered using the same gap settings. It can be seen that the specific calipers of the base sheet made using the undulatory blade is greater than is that of the sheet made using conventional creping, despite the fact that the sheet made using the undulatory blade was run at a lower creping level; a change that normally serves to decrease the base sheet's specific caliper.

The two base sheets were embossed using a spot emboss pattern and were tested for physical properties. The results of these tests are also shown in Table 6. From Table 6, it can be seen that the weight, caliper, and strength of the two embossed products are quite similar. However, the product made using the undulatory crepe blade has a lower friction deviation value, indicative of a sheet with higher surface softness.

The two products were also submitted to a sensory panel for testing of their sensory softness and bulk. The results of these panel tests are shown in Table 6. Values that differ by 0.4 are considered statistically significant at 95% confidence level. These results indicate that the tissue made using the undulatory blade is preferred over the product made using the standard creping technology for softness by a statistically significant margin. The two products are not significantly different for bulk perception.

TABLE 6

Physical Properties of Base Sheets and Embossed Products

| | Base Sheet | | Embossed Product | |
|---|---|---|---|---|
| | Crepe Blade | | | |
| | Standard | Undulatory | Standard | Undulatory |
| Basis Weight (lbs/ream) | 17.9 | 18.3 | 17.92 | 17.72 |
| Caliper (mils/8 sheets) | 47.8 | 50.7 | 57.2 | 56.9 |
| Specific Caliper (mils/8 sheets/lb basis weight) | 2.67 | 2.77 | 3.19 | 3.21 |
| MD Tensile (grams/3 inches) | 1245 | 1287 | 949 | 928 |
| CD Tensile (grams/3 inches) | 657 | 565 | 390 | 372 |
| Perf Tensile (grams/3 inches) | — | — | 356 | 333 |
| MD Stretch (%) | 21.0 | 19.6 | 19.5 | 16.8 |
| Tensile Modulus (grams/inch/%) | — | — | 14.4 | 13.9 |
| Friction Deviation | — | — | 0.190 | 0.171 |
| Sensory Softness | — | — | 16.47 | 16.95 |
| Sensory Bulk | — | — | 0.16 | 0.00 |

In addition to tests of their physical properties, the two products were examined to determine their free-fiber end (FFE) count. Some workers consider the free-fiber end count to be important in characterizing a tissue based on the premise that high FFE values correlate with perceived surface softness. In this test, the surface of the tissue samples is mechanically disrupted in a manner that emulates the disruption imparted to the tissue during a softness panel examination. The samples are then mounted and imaged microscopically. Image analysis is then used to determine the number and size of the fibers that are raised from the tissue surface. The test reports the average number of free-fiber ends over several measurements of a 1.95 mm length of tissue. For the two tested tissues, the number of free-fiber ends for the product made using the undulatory blade was 12.5 as compared to 9.9 for the control product.

The two products were tested in Monadic Home-Use tests. In this type of test, consumers test a single product and are then asked to rate its overall performance as well as its performance in several attribute categories. These attributes can be ranked as Excellent, Very Good, Good, Fair, or Poor. Results from this test are summarized in Table 7. For tabulation purposes, each response was assigned a numerical value ranging from 5 for a rating of Excellent to 1 for a Poor rating. A weighted average rating for the tissues' Overall Rating as well as each attribute was then calculated. The Monadic Home-Use tests are described in the Blumenship and Green textbook "State of The Art Marketing Research," NTC Publishing Group Lincolnwood, Ill., 1993.

TABLE 7

Monadic Hut Results for One-Ply Tissue Products

| | Crepe Blade Type | |
|---|---|---|
| | Control | Undulatory |
| Overall Rating | 3.41 | 3.50 |
| Being Soft | 3.57 | 3.85 |
| Being Strong | 3.65 | 3.65 |
| The Thickness of the Sheet Itself | 3.33 | 3.43 |
| Being Absorbent | 3.60 | 3.76 |
| Being Comfortable to Use | 3.48 | 3.65 |
| Not Being Irritating | 3.84 | 3.95 |
| Cleansing Ability | 3.70 | 3.70 |

As can be seen from the table, the performance of the product made using the undulatory crepe blade equals or exceeds that of the control product for these important tissue attributes.

EXAMPLE 8

This example illustrates that significant variation in blade angle $\gamma_f$ may be tolerated when using the undulatory blade to manufacture single-ply tissue while retaining substantially enhanced specific caliper. Tissue base sheets were made from a furnish containing 50% Northern Softwood Kraft and 50% Northern Hardwood Kraft using the undulatory blade having a 15° blade bevel, an undulation frequency of 20 per inch, and an undulation depth of 0.020 inches. The sheets were made with a blade angle $\gamma_f$ of 17°. The sheets were made at three strength levels, with sheet strength being controlled by addition of starch to the SWK portion of the furnish. Tissue sheets were also made using the same furnish and a similar undulatory crepe blade; however the blade angle $\gamma_f$ for these sheets was 25°. These sheets were also made at three strength levels by using addition of starch to control sheet strength.

Figure 35:
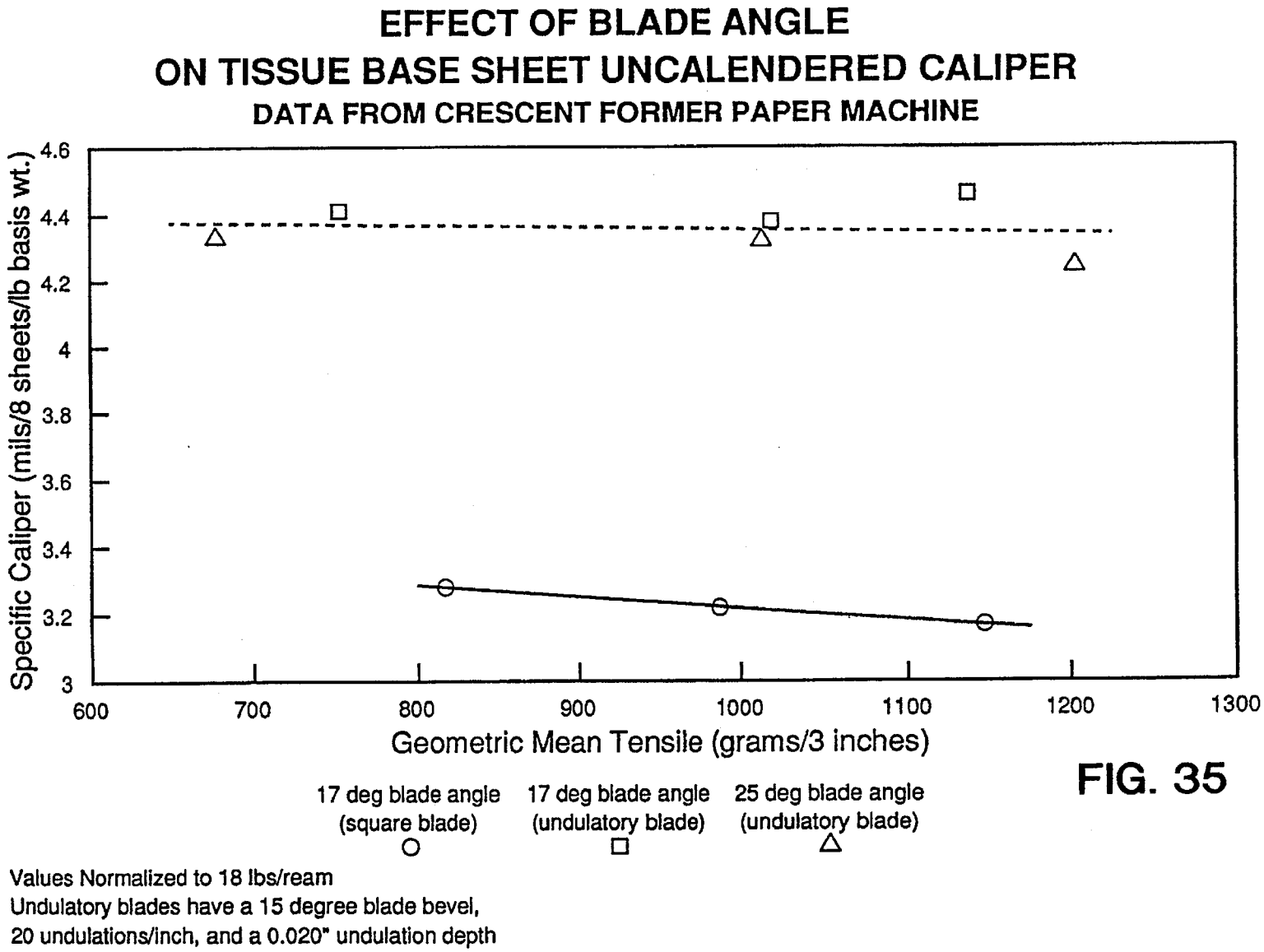
FIG. 35 shows the effect of blade angle on caliper of a base sheet creped using an undulatory creping blade.

The physical properties of the various base sheets were measured and compared. FIG. 35 shows the results of these tests. Results from similar base sheets made using a conventional (square) creping blade are also shown. It can be appreciated that the uncalendered specific caliper of the base sheets made using the undulatory blades at the two creping angles both have specific calipers that are much greater than that of the control sheet and that the sheets made using the undulatory blade are, at a similar strength level, essentially equal and can be represented by a single regression line. This latter result is unexpected as with conventional creping blades such a change in blade angle $\gamma_f$ would be expected to result in a more substantial difference in base sheet properties, especially specific caliper. The tissue base sheets made using the higher blade angle $\gamma_f$ would be expected to have significantly higher specific calipers than would the sheets made using the lower angle.

Since the base sheet specific caliper is relatively insensitive to blade angle $\gamma_f$ with use of the undulatory crepe blade, it is often possible to manufacture similar tissue products on machines that have different blade angle $\gamma_f$. Use of the undulatory crepe blade can not only provide a base sheet with improved specific caliper over that which can be obtained with a conventional creping blade, but can also make it easier to manufacture similar products on machines that have different creping geometries.

EXAMPLE 9

This example illustrates the effect of varying blade angle $\gamma_f$ of an undulatory crepe blade in a process for creping for two-ply tissue. Two-ply tissue base sheets were made using an undulatory crepe blade having a bevel angle of 25°, an undulation depth of 0.020 inches, and an undulation frequency of 20 undulations/inch. The base sheets were made using two different blade angle $\gamma_f$, 18° and 25°. For both tissues the furnish was 60% Southern Hardwood Kraft, 30% Northern Softwood Kraft, and 10% Broke. The two tissues both employed the same refining levels (3.5 Hp-days/ton).

The physical properties of the base sheets made using the two blade angles are shown in Table 8. From the table, it can be seen that the properties are very similar, indicating that use of the undulatory crepe blade results in a process for providing tissue which is relatively insensitive to blade angle, $\gamma_f$.

TABLE 8

Physical Properties of Two-ply Tissue Base Sheet Made at Different Blade Angles

| | Blade Angle (°) | |
|---|---|---|
| | 18 | 25 |
| Basis Weight (lbs/ream) | 9.37 | 9.50 |
| Caliper (mils/8 sheets) | 28.6 | 27.7 |
| Specific Caliper (mils/8 sheets/lb basis weight) | 3.05 | 2.92 |
| MD Tensile (grams/3 inches) | 547 | 553 |
| CD Tensile (grams/3 inches) | 251 | 254 |
| MD Stretch (%) | 16.1 | 14.5 |
| Friction Deviation | 0.164 | 0.159 |

EXAMPLE 10

This example illustrates the improvement in modulus resulting from the use of an undulatory blade of the present invention to produce base sheet for two-ply tissue as compared to the modulus obtained when a conventional blade is used. Two-ply tissue base sheets were made on a crescent former tissue machine. The sheets were made from a furnish consisting of 60% Southern Hardwood Kraft, 30% Southern Softwood Kraft, and 10% Broke. Both a control product, which was creped using a conventional square crepe blade, and a product that employed an undulatory crepe blade were produced. The undulatory crepe blade had a blade bevel angle of 25°, an undulation frequency of 20 undulations/inch, and an undulation depth of 0.020 inches. The two sheets were made to the same target basis weight, caliper, and tensile levels. Table 9 summarizes the physical properties of the two base sheets.

TABLE 9

Two-Ply Tissue Base Sheet Properties

| | Crepe Blade Type | |
|---|---|---|
| | Control | Undulatory |
| Basis Weight (lbs/ream) | 9.40 | 9.37 |
| Caliper (mils/8 sheets) | 27.9 | 28.6 |
| Specific Caliper (mils/8 sheets/lb basis weight) | 2.97 | 3.05 |
| MD Tensile (grams/3 inches) | 572 | 547 |
| CD Tensile (grams/3 inches) | 263 | 251 |
| MD Stretch (%) | 17.4 | 16.1 |
| CD Stretch (%) | 6.3 | 8.7 |
| MD Tensile Modulus (grams/inch/%) | 27.8 | 29.5 |
| CD Tensile Modulus (grams/inch/%) | 43.9 | 27.2 |
| GM Tensile Modulus (grams/inch/%) | 34.9 | 28.2 |
| Friction Deviation | 0.147 | 0.151 |

It can be seen from the table that the tissue base sheet made using the undulatory crepe blade has a lower geometric mean tensile modulus than does the tissue sheet made using the standard crepe blade. This lower GM modulus is in turn due to a lower CD modulus that, at least in part, results from the higher CD stretch that results from use of the undulatory crepe blade. Lower tensile modulus has been shown to correlate with tissue softness, thus the lower modulus value exhibited by the base sheet creped using the undulatory crepe blade should aid in producing a softer tissue product.

EXAMPLE 11

This example illustrates the physical properties of a two-ply tissue base sheet produced using an undulatory blade of the present invention as compared to tissue produced using a conventional square blade. Two-ply tissue base sheets were made from a furnish containing 30% Northern Softwood Kraft, 60% Southern Hardwood Kraft, and 10% Broke. Three products were produced: a control product which was creped with a standard square crepe blade, and two products which were made using the undulatory crepe blade. The undulatory crepe blade had a bevel of 25°, 20 undulations per inch, and an undulation depth of 0.020 inches. The control base sheet was calendered at a pressure of 5 pli to produce a base sheet having a caliper targeted at approximately 29 mils/8 sheets. One of the undulatory-blade base sheets was calendered at 15 pli, to produce a base sheet having approximately the same caliper as the control product. The other sheet made using the undulatory crepe blade was calendered at a very light level (approximately 3 pli), to produce a sheet with increased base sheet caliper. The physical properties of the three base sheets are listed in Table 10. It can be appreciated that the undulatory blade can be used to provide base sheet for tissue having very desirable combinations of specific caliper and softness.

TABLE 10

Two-Ply Base Sheet Properties

| | Crepe Blade Type | | |
|---|---|---|---|
| | Standard | Undulatory | Undulatory |
| Calender Loading (pli) | 5 | 3 | 15 |
| Basis Weight (lbs/ream) | 9.3 | 9.4 | 9.4 |
| Caliper (mils/8 sheets) | 28.3 | 42.6 | 29.1 |
| Specific Caliper (mils/8 sheets/lb basis weight) | 3.04 | 4.53 | 3.10 |
| MD Tensile (grams/3") | 631 | 560 | 536 |
| CD Tensile (grams/3") | 234 | 234 | 226 |
| MD Stretch (%) | 17.2 | 19.9 | 16.6 |
| CD Stretch (%) | 6.5 | 9.6 | 9.5 |
| Tensile Modulus (grams/inch/%) | 19.6 | 2.3 | 12.7 |
| Friction Deviation | 0.166 | 0.216 | 0.146 |

EXAMPLE 12

This example illustrates the results achieved when embossing the two-ply base sheets prepared in Example 11. The three base sheet types were two-ply embossed at an emboss depth of 0.085 inches. The physical properties of the two-ply embossed products are shown in Table 11. The products were submitted to a sensory panel for evaluation of their overall softness and bulk. The results from this panel are also shown in Table 11. For comparisons between products in sensory panel tests, a difference of 0.40 units is statistically significant at the 95% confidence level.

The results of these panel tests show that the undulatory crepe blade technology can be used either to produce products having roughly equal softness but superior bulk perception to that of the control, or, on the other hand, a product having substantially equal bulk perception but superior softness.

TABLE 11

Properties of Embossed Two-Ply Products

| | Crepe Blade Type | | |
|---|---|---|---|
| | Standard | Undulatory | Undulatory |
| Calender Loading (pli) | 5 | 3 | 15 |
| Emboss Depth (in) | 0.085 | 0.085 | 0.085 |
| Basis Weight (lbs/ream) | 18.1 | 18.4 | 18.4 |
| Caliper (mils/8 sheets) | 71.3 | 78.4 | 66.6 |
| Specific Caliper (mils/8 sheets/lb basis weight) | 3.94 | 4.26 | 3.62 |
| MD Tensile (grams/3") | 1070 | 952 | 997 |
| CD Tensile (grams/3") | 375 | 405 | 385 |
| Perf Tensile (grams/3") | 489 | 421 | 447 |
| MD Stretch (%) | 13.1 | 15.6 | 14.7 |
| CD Stretch (%) | 8.0 | 8.9 | 9.2 |
| Tensile Mod. (grams/in/%) | 19.5 | 21.1 | 19.5 |
| Friction Deviation | 0.180 | 0.162 | 0.160 |
| Sensory Softness | 17.63 | 17.30 | 18.56 |
| Sensory Bulk | 0.07 | 1.01 | 0.22 |

EXAMPLE 13

This example is similar to Example 12 except that a different emboss pattern is employed to combine base sheets as prepared in Example 11. Control base sheets and base sheets made using the undulatory crepe blade that were calendered at the 15 pli calender setting were paired and embossed. The emboss depth for both products was 0.085 inches. The physical properties of the two embossed products are shown in Table 12.

TABLE 12

Physical Properties of Two-Ply Tissue

| | Crepe Blade Type | |
|---|---|---|
| | Standard | Undulatory |
| Emboss Depth (inches) | 0.085 | 0.085 |
| Basis Weight (lbs/ream) | 18.5 | 18.3 |
| Caliper (mils/8 sheets) | 68.5 | 67.9 |
| Specific Caliper (mils/8 sheets/lb basis weight) | 3.70 | 3.71 |
| MD Tensile (grams/3 inches) | 1053 | 934 |
| CD Tensile (grams/3 inches) | 373 | 364 |
| Perf Tensile (grams/3 inches) | 478 | 466 |
| MD Stretch (%) | 14.0 | 13.3 |
| CD Stretch (%) | 7.4 | 9.1 |
| Tensile Modulus (grams/in/%) | 19.0 | 16.7 |
| Friction Deviation | 0.197 | 0.190 |

EXAMPLE 14

This example sets forth sensory panel test results for tissue produced according to the procedure of Example 13. The two products were submitted to a sensory panel for comparison of the products' softness, thickness, bulk, and stiffness. The results of the panel for the various tissue properties are shown in Table 13. The numerical values listed are the number of panelists (out of 40) that judge a particular product to have more of a given property than does the other product. In the case of panelists who judged the two products to be equal for a certain attribute, the responses have been evenly divided between the two products. It should be noted that for all properties, except stiffness, a higher number of respondents corresponds to a preferred product. From the results, it can be seen that the product made using the undulatory crepe blade equals or exceeds the control product in all attributes tested.

TABLE 13

Sensory Panel Results - Two Ply Tissue

| | Crepe Blade Type | |
|---|---|---|
| | Standard | Undulatory |
| Overall Softness | 5 | 35 |
| Top Surface Softness | 10.5 | 29.5 |
| Bottom Surface Softness | 9 | 31 |
| Bulk | 18.5 | 21.5 |
| Thickness | 18.5 | 21.5 |
| Stiffness | 29.5 | 10.5 |

EXAMPLE 15

This example demonstrates use of an undulatory blade to obtain improved caliper, modulus and absorbency at equal weight for two-ply towel base sheets. Towel base sheets were made from a furnish consisting of 70% Southern Hardwood Kraft, 30% Southern Softwood Kraft. Twelve lbs of wet strength resin was added for each ton of pulp. The base sheets were made at various strength levels with refining being used to vary the sheet strength. The towel base sheets were made at two basis weight targets, 16 lbs/ream and 14 lbs/ream. Control sheets were creped using a 0° (square) crepe blade; in addition sheets were made using undulatory crepe blades having various combinations of blade bevel, undulation depth, and undulation frequency.

Figure 36:
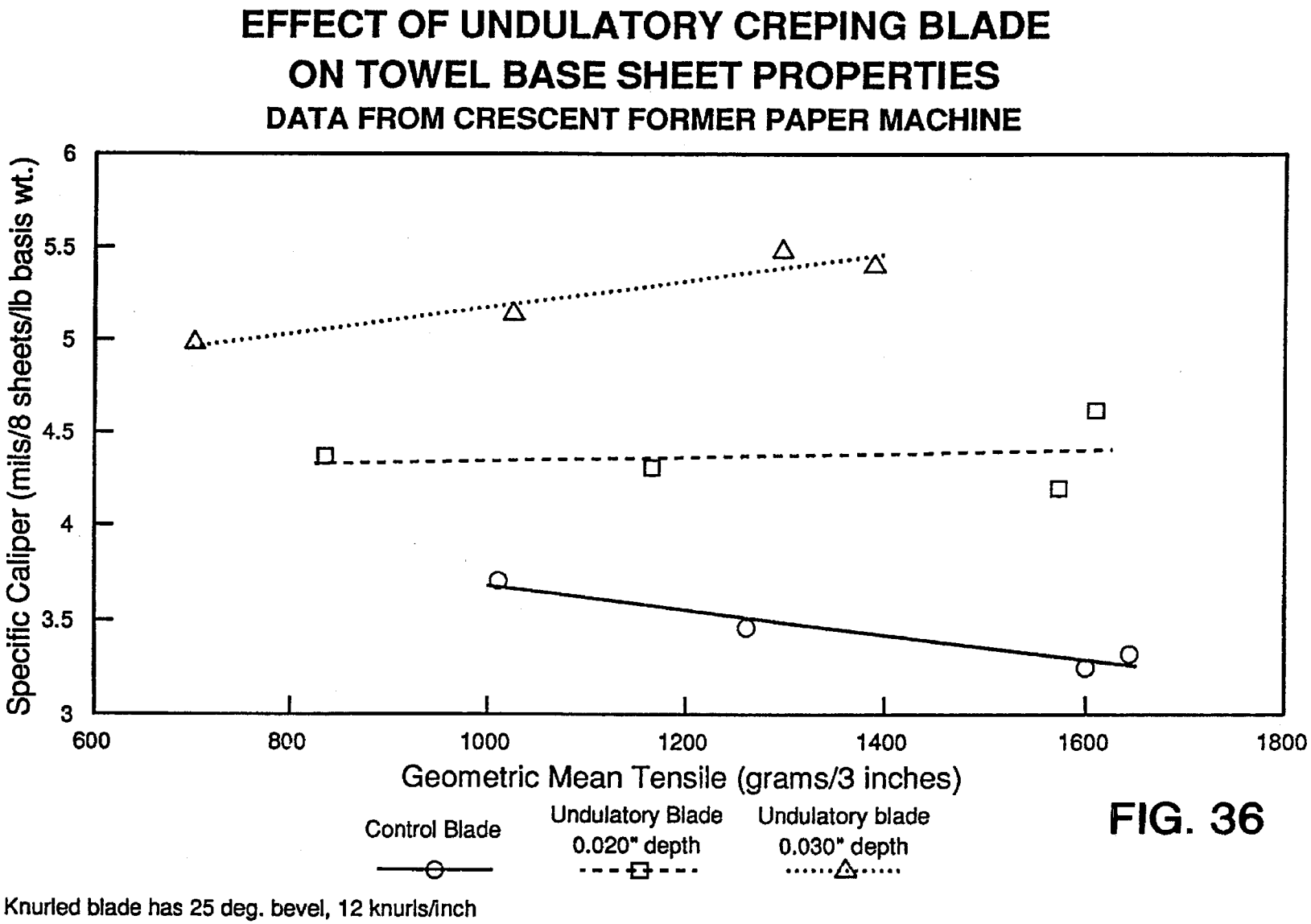
FIGS. 36 through 38 show the effect of the undulatory creping blade on towel base sheet properties.
Figure 37:
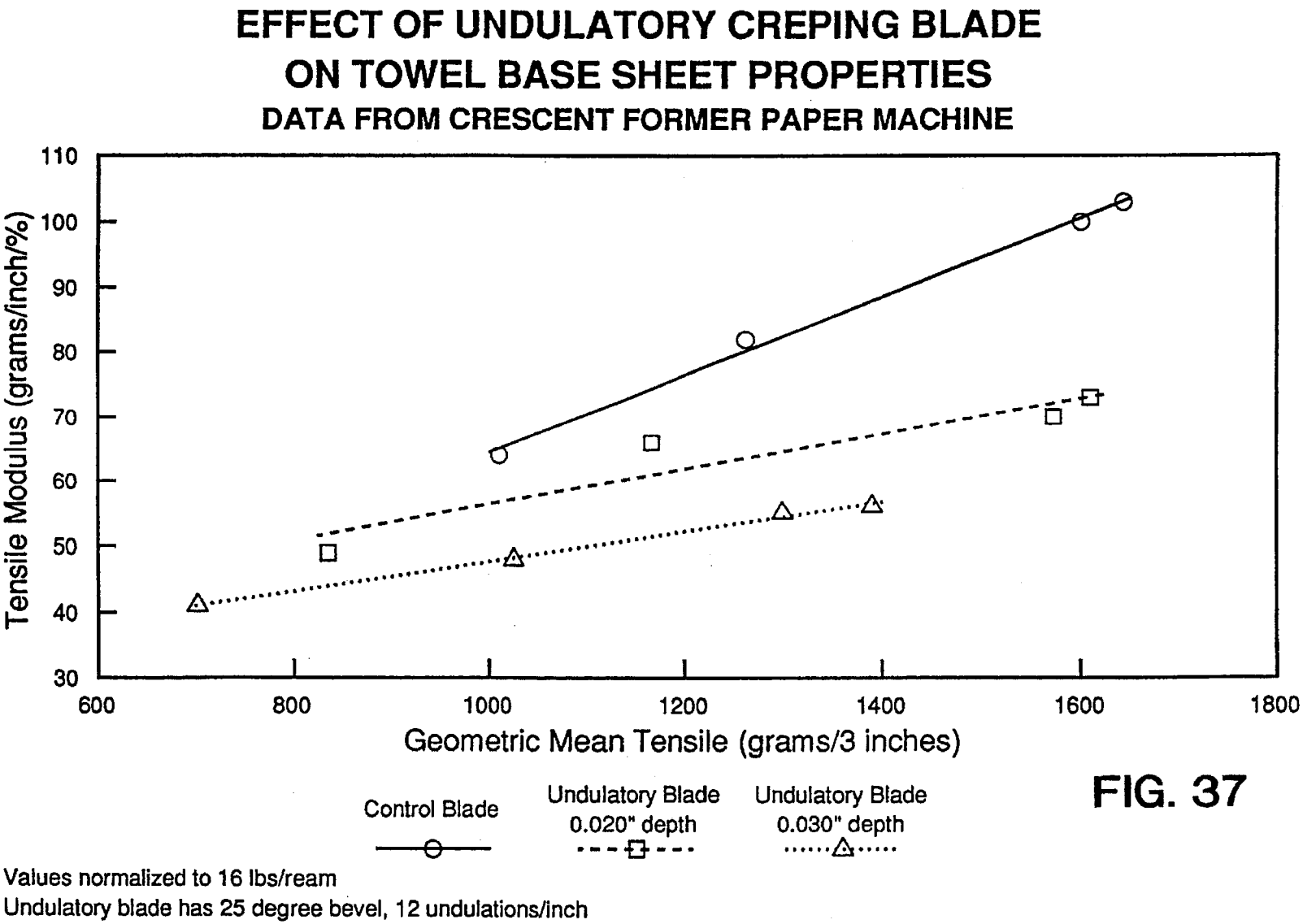
Figure 38:
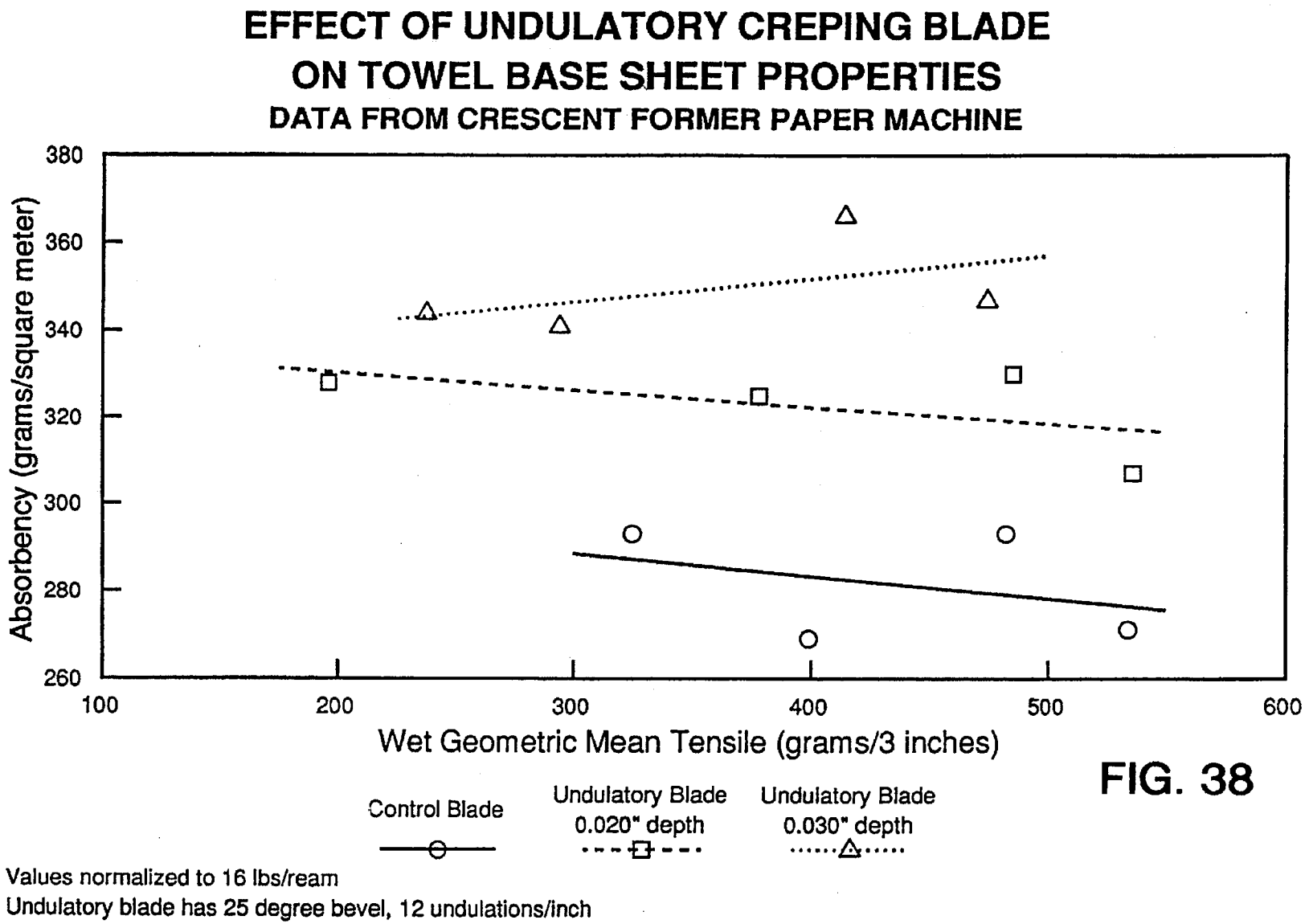

FIGS. 36, 37 and 38 show a comparison of the control and undulatory crepe blades for the properties of caliper, tensile modulus, and absorbency. For caliper and tensile modulus, the properties are graphed as functions of the sheet's dry tensile strength; absorbency is graphed as a function of wet tensile. In all three graphs, the property values have been normalized to their target (16 lbs/ream) basis weight.

The graphs show that the base sheets made using the undulatory crepe blades have specific caliper, modulus, and absorbency values that surpass those exhibited by the control sheets. It should be remembered that tensile modulus correlates negatively with product softness and thus a lower value is preferred.

Figure 39:
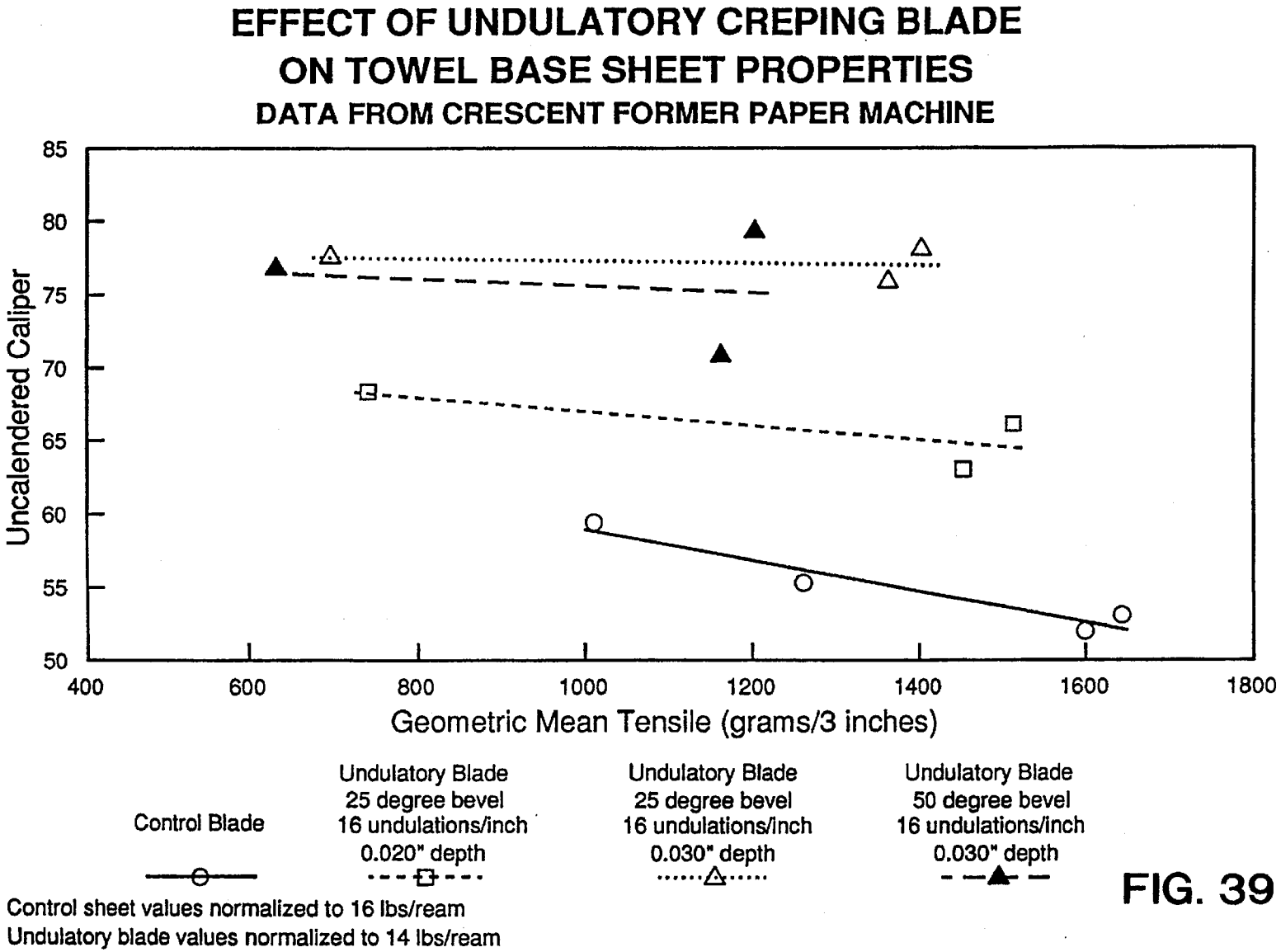
FIGS. 39 through 41 illustrate, respectively, caliper, tensile modulus and absorbency properties of low weight towel base sheet creped using an undulatory creping blade.
Figure 40:
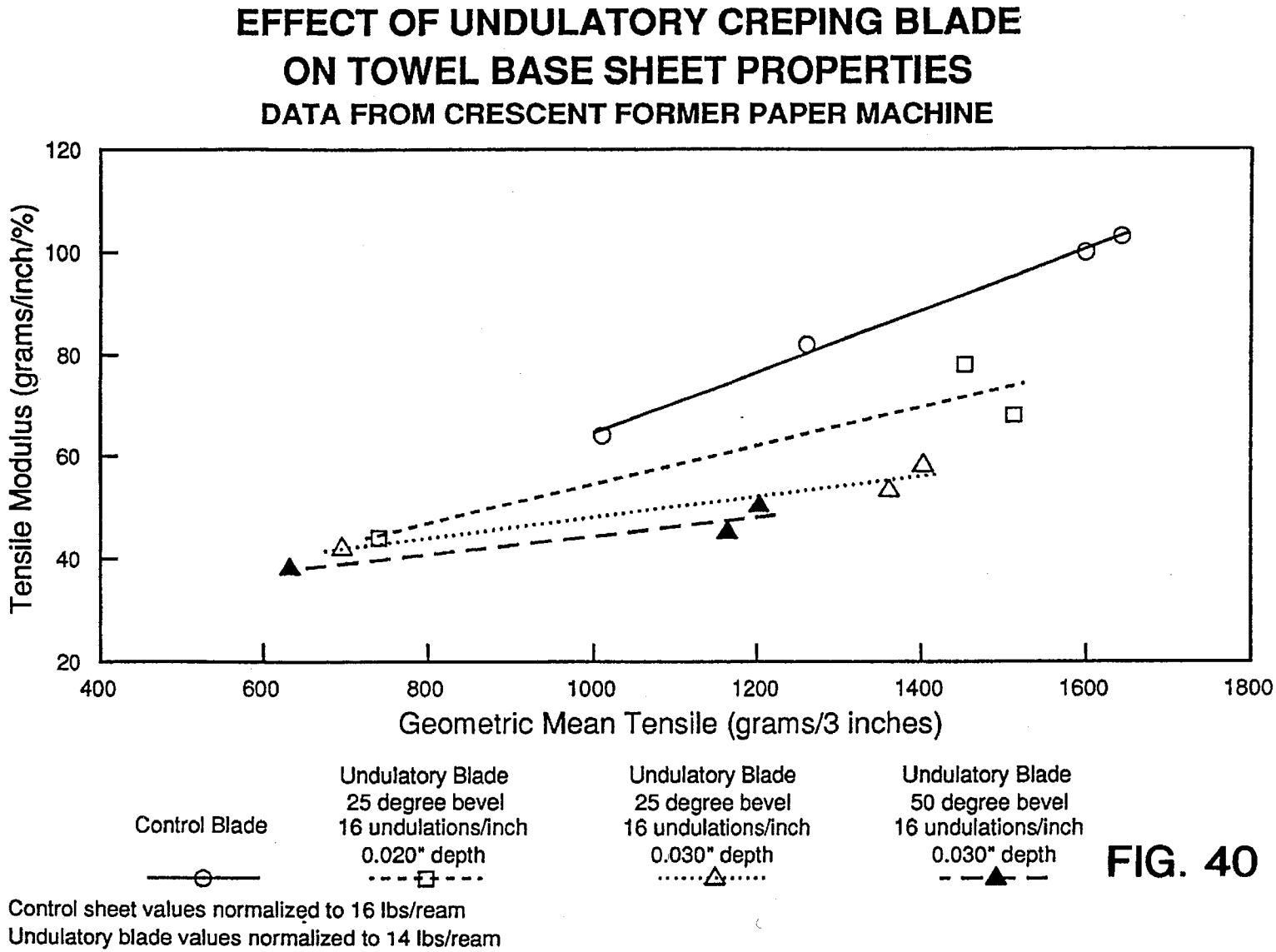
Figure 41:
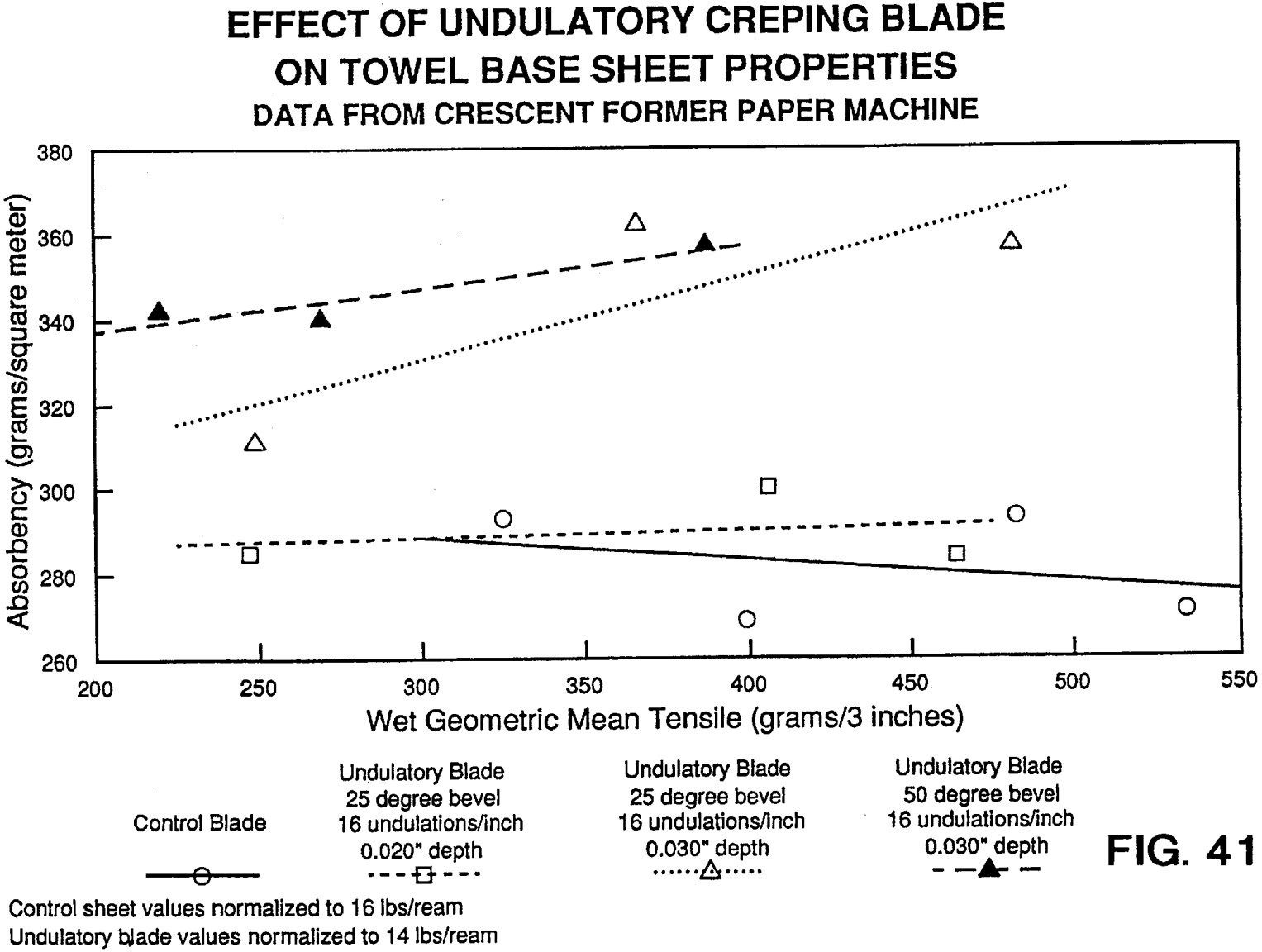

FIGS. 39, 40 and 41 compare the control sheets at 16 lbs/ream to biaxially undulatory base sheets that were made at a targeted weight of 14 lbs/ream. These figures show the base sheets caliper, modulus, absorbency values as function of either their dry or wet tensile strength. As can be seen from the graph, the lighter-weight sheets made using the undulatory crepe blades equal or surpass those of the control sheet in all three properties, despite the control sheet's 14% advantage in basis weight.

EXAMPLE 16

This example illustrates that use of the undulatory crepe blade technology may result in an extended crepe blade life. An undulatory crepe blade having a 25° bevel, an undulation frequency of 20 undulations/inch, and an undulation depth of 0.020 inches was installed on a crescent former paper machine running at a Yankee speed of 3465 ft/min. The blade angle $\gamma_f$ was 17°. The tissue sheet was composed of 60% Southern Hardwood Kraft, 30% Northern Softwood Kraft and 10% Broke. The strength of the sheet was adjusted to the target level by refining of the entire furnish. Tissue sheets were made at two levels of calendering; a heavily calendered sheet made using a calender pressure of 15 pli and a lightly calendered sheet made at a 3 pli calender pressure. The physical properties of these sheets are shown in Table 14. The run lasted for four hours (three hours at high calendering level, one at lower level), with the same crepe blade being used throughout. On a second paper machine run, with the same machine speed and furnish as above, the same undulatory crepe blade was reinserted into the blade holder and used to crepe the product. The product was run for three hours using a 17° blade angle $\gamma_f$, after which time the blade angle $\gamma_f$ was increased to 25°. The product was made using this second blade angle for one and one-half hours, after which the blade was removed. The physical properties of the products made during the second run are also shown in Table 14.

TABLE 14

Physical Properties of Tissue Base Sheet

| | Run Number | | | |
|---|---|---|---|---|
| | 1 | 1 | 2 | 2 |
| Refining level (HP-day/ton) | 5.43 | 5.43 | 5.20 | 5.20 |
| Calender Pressure (pli) | 15 | 3 | 15 | 15 |
| Blade Angle (°) | 17 | 17 | 17 | 25 |
| Basis Weight (lbs/ream) | 9.4 | 9.4 | 9.4 | 9.5 |

TABLE 14-continued

Physical Properties of Tissue Base Sheet

| | Run Number | | | |
|---|---|---|---|---|
| | 1 | 1 | 2 | 2 |
| Caliper (mils/8 sheets) | 29.1 | 42.6 | 28.6 | 27.7 |
| Specific Caliper (mils/8 sheets/lb basis weight) | 3.10 | 4.53 | 3.04 | 2.92 |
| MD Tensile (grams/3 in) | 536 | 560 | 547 | 553 |
| CD Tensile (grams/3 in) | 226 | 234 | 251 | 254 |
| MD Stretch (%) | 16.6 | 19.9 | 16.1 | 14.5 |

As can be seen from the values in the table, the physical properties of the base sheets remained relatively constant throughout both of the machine runs, despite the fact that all of the sheets were creped using a single creping blade. The total run time of this single blade was eight and one-half hours. This time contrasts with the normal blade life of a standard blade, which, on this machine, is typically about four hours.

EXAMPLE 17

Figure 42:
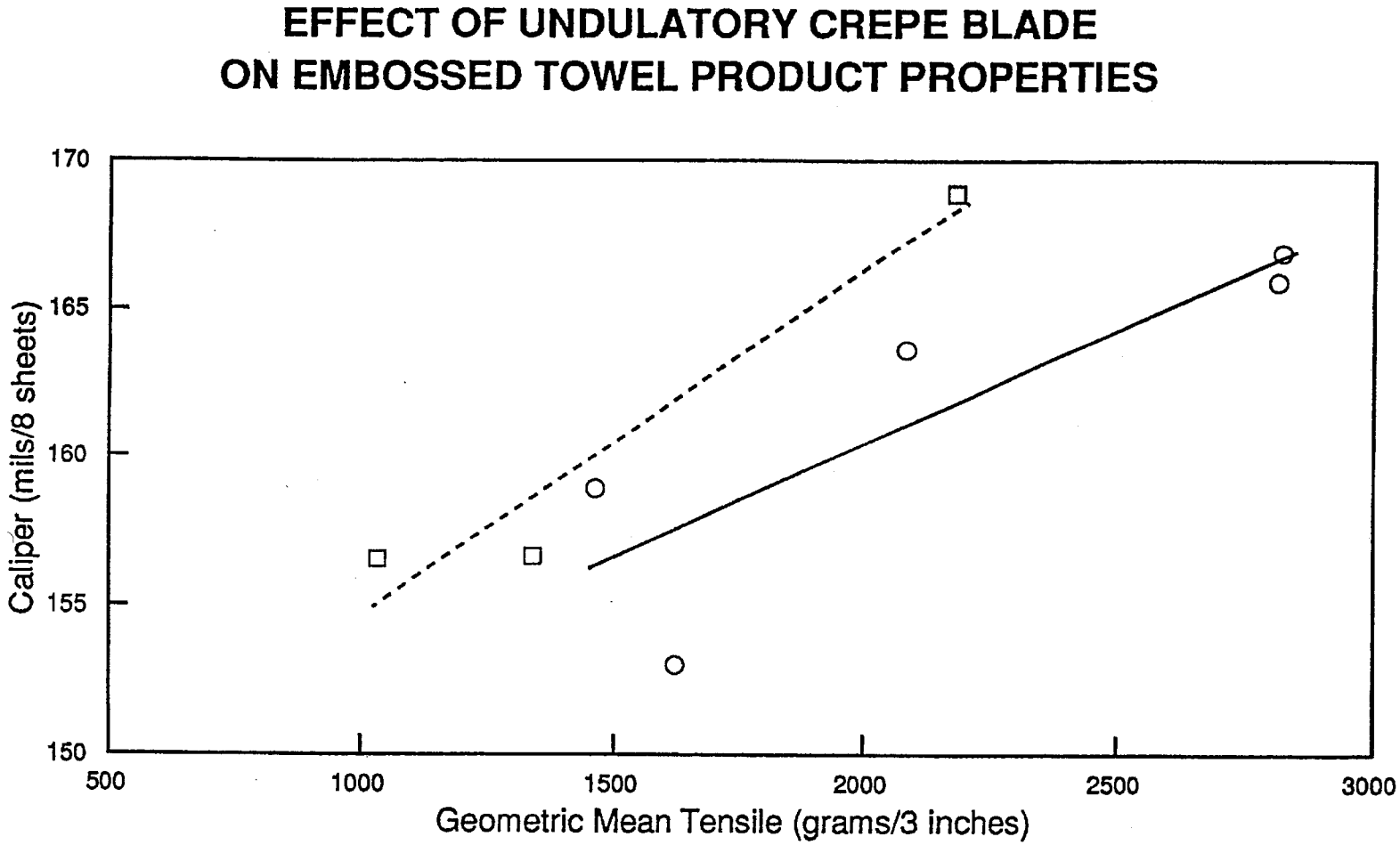
FIGS. 42 through 44 illustrate, respectively, after embossing, caliper, tensile modulus and absorbency properties of creped towel using an undulatory creping blade.
Figure 43:
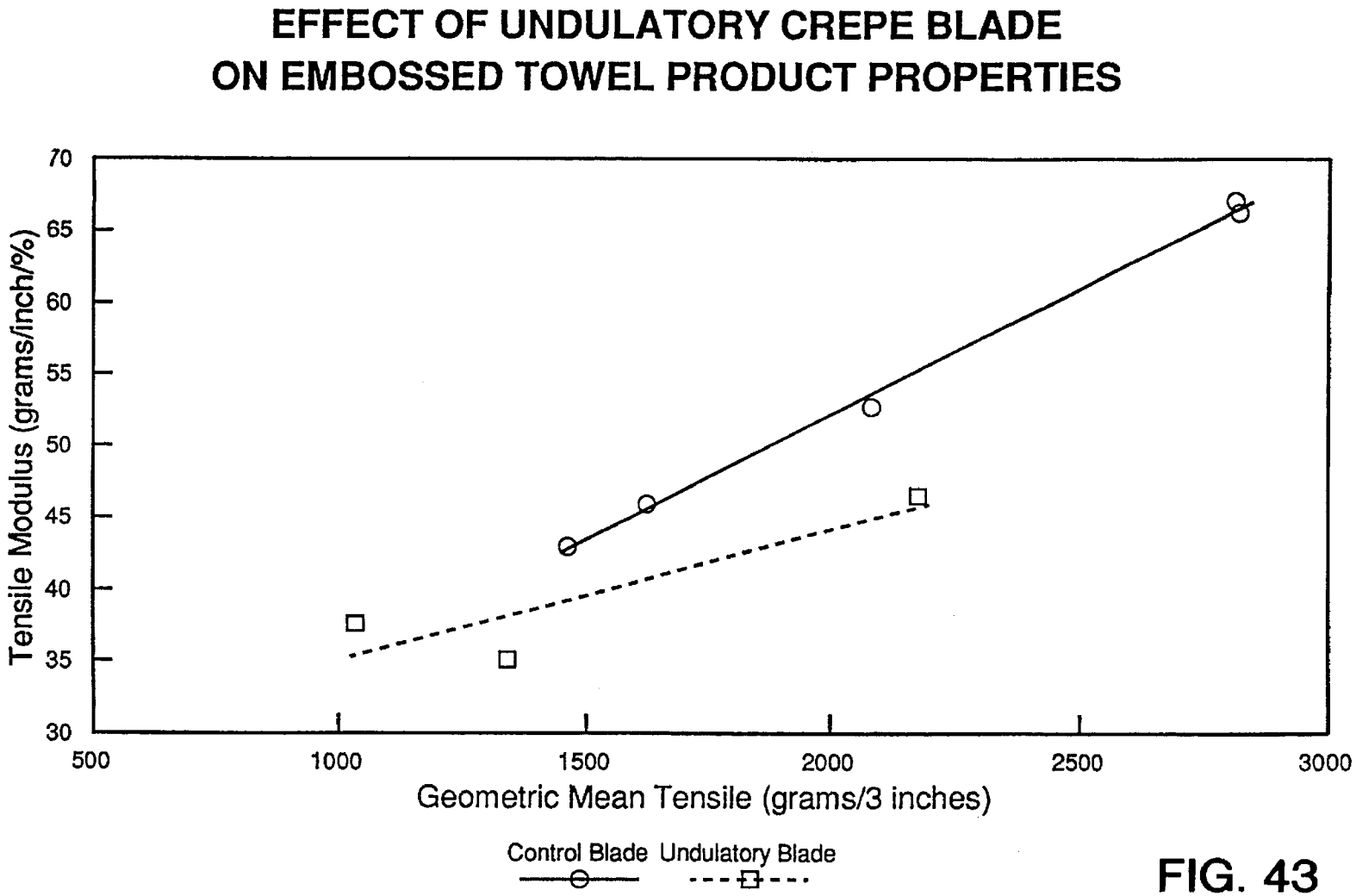
Figure 44:
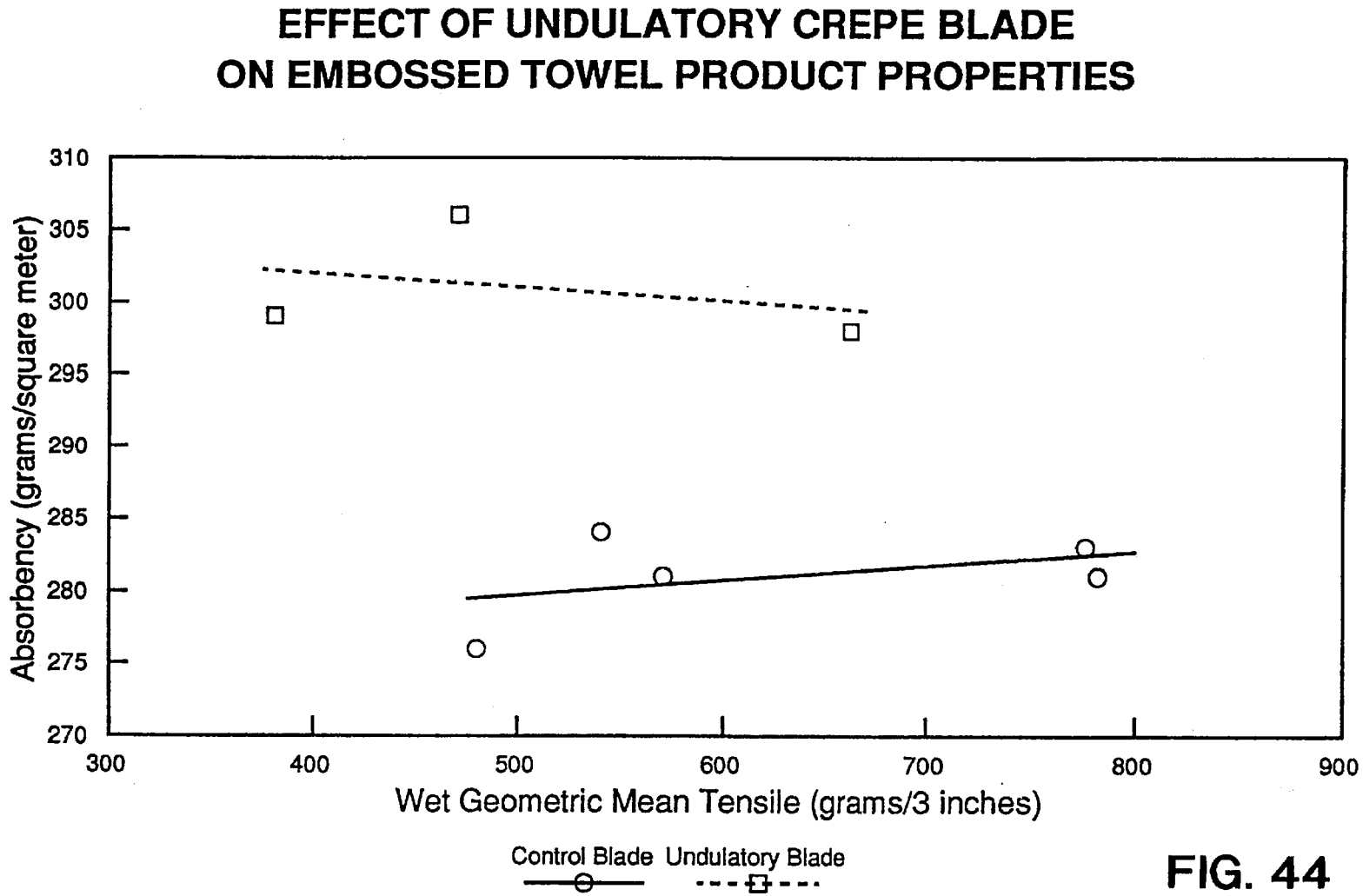

Control towel base sheets from example 15 were selected for converting into two-ply finished towel products. Base sheets produced using an undulatory crepe blade were also chosen for converting. These base sheets were produced on the same paper machine and had the same furnish and same concentration of wet strength resin as did the control sheets. The undulatory blade employed had a blade bevel of 50°, an undulation frequency of 16 undulations/inch and an undulation depth of 0.030 inches. The average physical properties for the base sheets that were paired for converting are shown in Table 15. The base sheets produced by both creping methods were embossed using a nested emboss configuration and an emboss depth of 0.080 inches. FIGS. 42–44 compare the embossed product properties of the control and undulatory blade products. FIG. 42 plots the product caliper as a function of product dry strength. The towels' tensile modulus is plotted against dry strength in FIG. 43. FIG. 44 shows absorbency of the two products as a function of their wet tensile strength. As can be seen from the graphs, the product made using the undulatory creping blade tends to have higher caliper, lower modulus, and higher absorbency at a given wet or dry strength than does the control product. All three of these differences are in the preferred direction.

TABLE 15

Physical Properties of Towel Base Sheets Used in Converting Trial

| Crepe Blade Type | Cntrl | Cntrl | Cntrl | Cntrl | Cntrl | Und | Und | Und |
|---|---|---|---|---|---|---|---|---|
| Blade Bevel (°) | 0 | 0 | 0 | 0 | 0 | 50 | 50 | 50 |
| Undulation Frequency (undulations/inch) | — | — | — | — | — | 16 | 16 | 16 |
| Undulation Depth (inches) | — | — | — | — | — | 0.030 | 0.030 | 0.030 |
| Basis Weight (lbs/ream) | 15.94 | 15.88 | 15.92 | 16.40 | 16.10 | 16.16 | 16.06 | 15.98 |
| Caliper (mils/8 sheets) | 59.0 | 55.5 | 59.3 | 54.1 | 52.2 | 78.2 | 75.7 | 80.6 |
| Specific Caliper (mils/8 sheets/lb basis weight) | 3.70 | 3.49 | 3.72 | 3.30 | 3.24 | 4.84 | 4.71 | 5.04 |
| MD Dry Tensile (grams/3 in.) | 1296 | 1549 | 1211 | 2007 | 1948 | 1096 | 802 | 1692 |
| CD Dry Tensile (grams/3 inches) | 828 | 1060 | 856 | 1389 | 1948 | 621 | 602 | 992 |
| MD Stretch (%) | 25.0 | 24.9 | 25.2 | 24.2 | 25.7 | 23.6 | 21.4 | 22.9 |
| CD Stretch (%) | 4.4 | 4.0 | 4.0 | 4.3 | 4.3 | 6.6 | 5.5 | 6.6 |
| MD Wet Tensile (grams/3 in.) | 482 | 516 | 402 | 724 | 610 | 426 | 231 | 586 |
| CD Wet Tensile (grams/3 in.) | 259 | 309 | 262 | 421 | 338 | 426 | 231 | 586 |
| Absorbency (grams/sq. meter) | 284 | 270 | 293 | 274 | 294 | 340 | 332 | 378 |
| Tensile Modulus (grams/inch/%) | 43.3 | 81.9 | 63.5 | 104.3 | 100.3 | 64.0 | 49.3 | 60.5 |

EXAMPLE 18

This example illustrates increased specific caliper and absorbency for unembossed towel prepared using the undulatory blade. Towel base sheets were made on a crescent former pilot paper machine at a Yankee speed of 2000 ft/min and a percent crepe of 20%. The furnish for the sheet was 30% Southern Softwood Kraft; 70% Southern Hardwood Kraft. Fourteen lbs/ton of wet strength resin, Kymene 557H, was added to the furnish to provide wet strength. The base sheets were produced using both a conventional (square) and an undulatory crepe blade. The undulatory crepe blade had a bevel angle of 25°, an undulation frequency of 16 undulations/inch and an undulation depth of 0.020 inches. The physical properties of these sheets are shown in Table 16. Each of the physical properties reported are the average of two base sheets. From the table, it can be seen that the sheets made using the undulatory crepe blades provided, at approximately the same or higher cross directional wet tensile strength, both improved base sheet caliper and increased water absorbency.

TABLE 16

Physical Properties of Towel Base Sheets

| | Blade Type | |
|---|---|---|
| | Standard | Undulatory |
| Blade Bevel | 0 | 25 |
| Lines/inch | — | 16 |
| Notch Depth | — | 20 |
| Basis Weight (lbs/ream) | 16.94 | 16.95 |
| Caliper (mils/8 sheets) | 55.3 | 76.2 |
| Specific Caliper (mils/8 sheets/basis weight) | 3.26 | 4.50 |
| MD Dry Ten. (grams/3 in) | 1814 | 1535 |
| CD Dry Ten. (grams/3 in) | 1126 | 1072 |
| CD Wet Ten. (grams/3 in) | 314 | 352 |
| Absorbency (grams/square meter) | 296 | 381 |

EXAMPLE 19

This example illustrates that when the towel base sheets described in Example 18 were embossed in a point-to-point configuration lower emboss depth was required. For all base sheets, the embossed towel product was produced with the air sides of the base sheets on the outside of the converted product. Each ply of the control base sheet was embossed at a penetration depth of 0.095" prior to the two sheets being joined together to form the two-ply finished product. For the base sheets made using the undulatory crepe blade, the penetration depth was 0.050" for one sheet and 0.090" for the other. Because of the higher-caliper base sheet resulting from use of the undulatory crepe blade, it was possible to create an embossed towel having a similar finished caliper and roll diameter to that of the control product using a lower penetration depth. Table 17, which lists the physical properties of the two embossed towels, shows that the lower emboss depth allowed by the undulatory blade, has resulted in a towel having higher strength (both wet and dry) than that of the more heavily embossed control.

TABLE 17

Physical Properties of Embossed Towel Products

| | Blade Type | |
|---|---|---|
| | Standard | Undulatory |
| Blade Bevel | 0 | 25 |
| Lines/inch | — | 16 |
| Notch Depth | — | 20 |
| Emboss Depth (in) | 0.095/0.095 | 0.050/0.090 |
| Basis Weight (lbs/ream) | 32.16 | 33.08 |
| Caliper (mils/8 sheet) | 148.9 | 150.0 |
| Specific Caliper (mils/8 sheets/lb basis weight) | 4.63 | 4.53 |
| MD Dry Ten. (grams/3 in) | 2391 | 2654 |
| CD Dry Ten. (grams/3 in) | 1119 | 1823 |
| MD Wet Ten. (grams/3 in) | 714 | 801 |
| CD Wet Ten. (grams/3 in) | 347 | 518 |
| Absorbency (grams/square meter) | 291 | 337 |
| Roll Diameter (inches) | 4.33 | 4.31 |
| Roll Compression (%) | 19.0 | 19.7 |

EXAMPLE 20

This example illustrates the improved properties obtained when using the undulatory blade in the manufacture of towels comprising up to 30% anfractuous fiber. Towel base sheets were made from a furnish containing 40% Southern Hardwood Kraft, 30% Southern Softwood Kraft, and 30% HBA. HBA is commercially available Softwood Kraft pulp from Weyerhauser Corporation that has been rendered anfractuous by physically and chemically treating the pulp such that the fibers have permanent kinks and curls imparted to them. Inclusion of these fibers in a towel base sheet will serve to improve the sheet's bulk and absorbency. A control base sheet made from this furnish was creped using a standard creping blade having a 5° bevel. Base sheets having similar strength were also made employing an undulatory crepe blade having a 25° bevel, 20 undulations per inch, and an undulation depth of 0.020 inches. Both base sheets contained 20 lbs of wet strength resin and 7 lbs of carboxymethyl cellulose per ton of pulp as additives.

The physical properties of the towel base sheets are shown in Table 18. Each value represents the average of two base sheet values. Both products have similar strength levels, both wet and dry. However, the sheet made using the undulatory crepe blade exhibits higher specific caliper and absorbency than does the control sheet, indicating that even products containing substantial amounts of bulking fiber can have their properties enhanced by use of the undulatory crepe blade.

TABLE 18

Physical Properties of HBA-Containing Base Sheet

| | Product | |
|---|---|---|
| | Control | Undulatory Blade |
| Basis Weight (lbs/ream) | 15.13 | 15.32 |
| Caliper (mils/8 sheets) | 66.68 | 78.18 |
| Specific Caliper (mils/8 sheets/lb basis weight) | 4.41 | 5.10 |
| MD Dry Tensile (grams/3 in) | 1102 | 1149 |
| CD Dry Tensile (grams/3 in) | 886 | 852 |
| MD Stretch (%) | 24.9 | 22.6 |
| CD Stretch (%) | 5.3 | 6.4 |
| MD Wet Tensile (grams/3 in) | 442 | 406 |
| CD Wet Tensile (grams/3 in) | 289 | 269 |
| Absorbency (grams/sq. meter) | 386 | 438 |

EXAMPLE 21

Figures 9A, 9B, 9C, 9D, 9E, 9F:
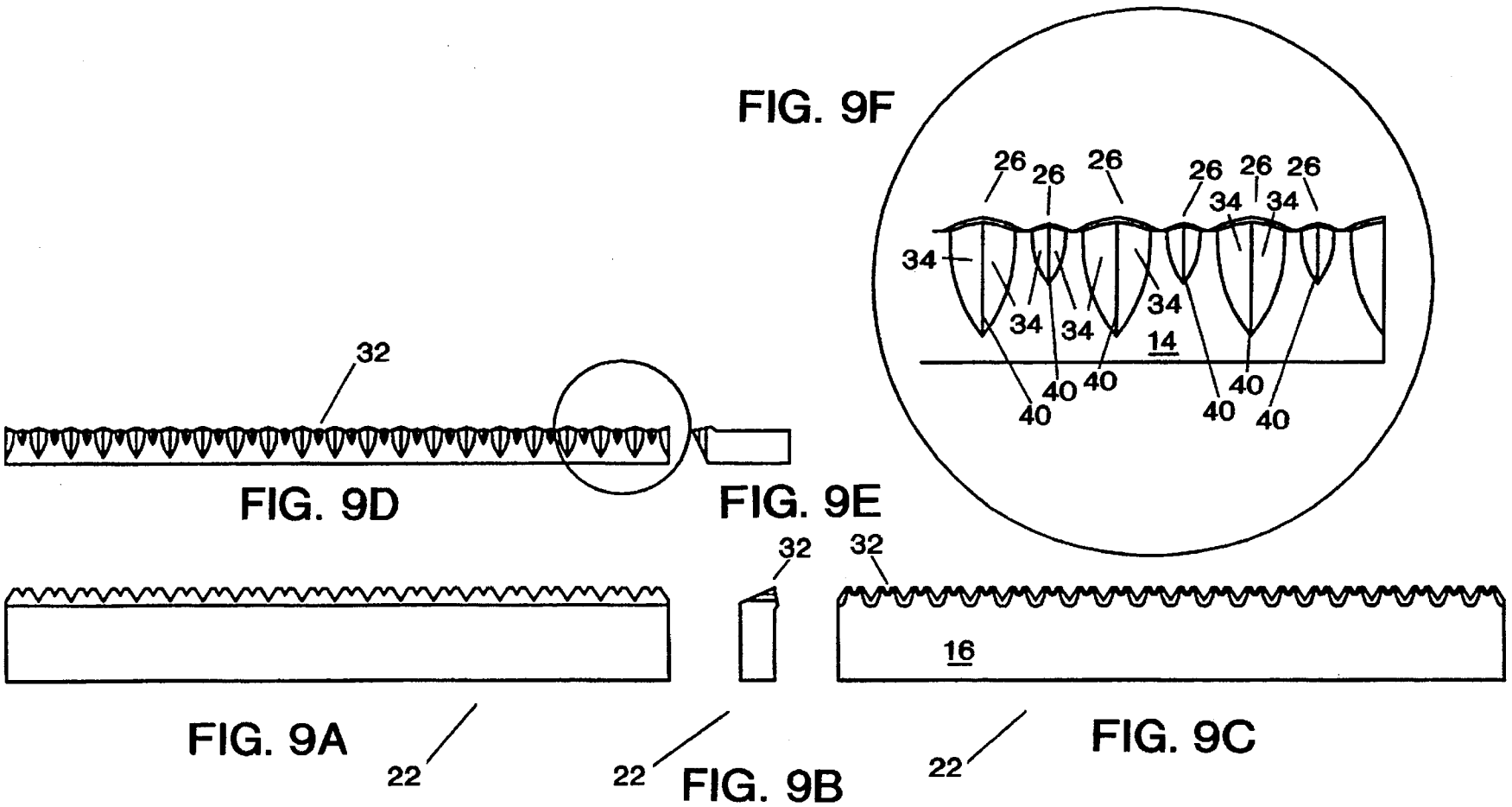
FIGS. 9A–9F are schematic elevations illustrating an alternating irregular undulatory creping blade of the present invention.
Figure 10G:
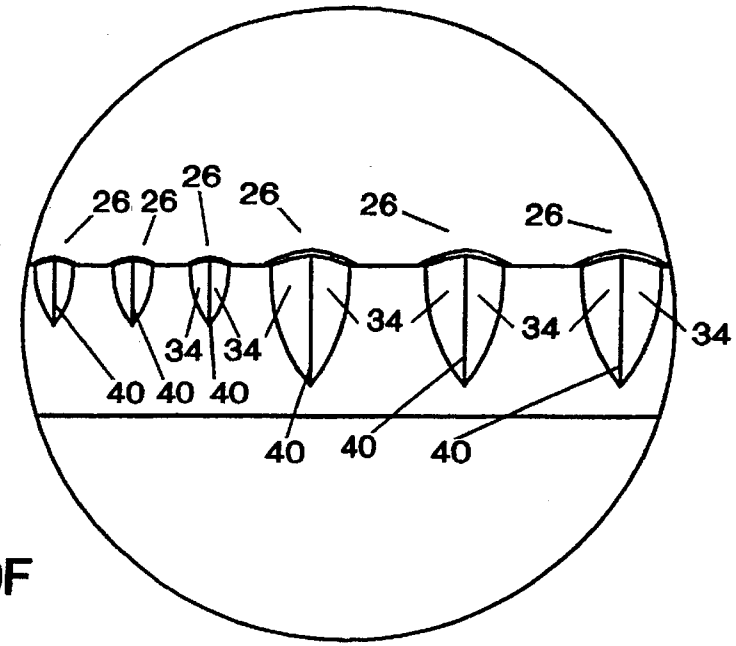
FIG. 10G is a detailed view of the circled part of FIG. 10E showing the presence of dividing surface 40 making it easy to visualize the nature of indented undulatory rake surface 34 and the lowest portion of each serrulation 26.
Figure 10F:
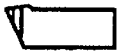
FIGS. 10A–10F are schematic elevations illustrating an interleaved irregular undulatory creping blade of the present invention.
Figure 10E:
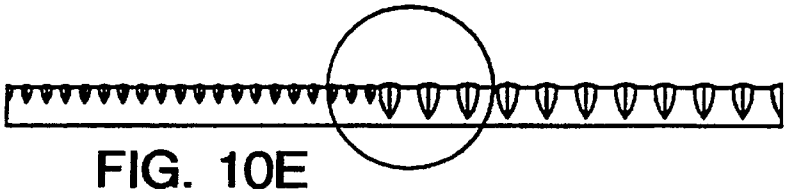
Figure 10D:
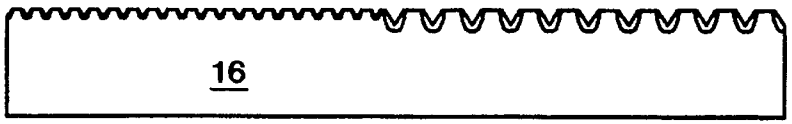
Figure 10C:
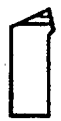
Figure 10B:
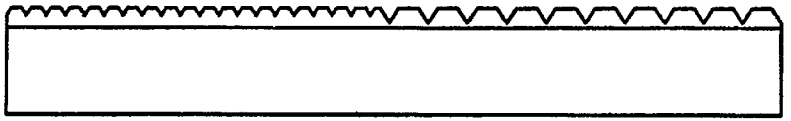
Figure 10A:
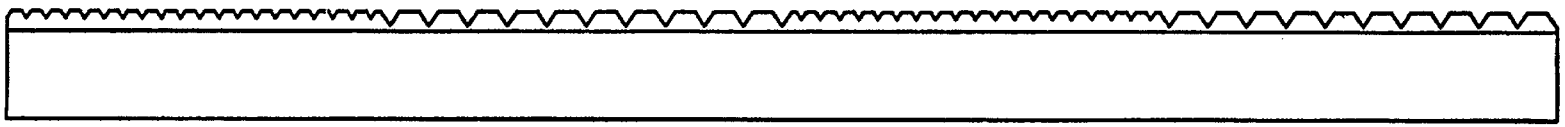

This example illustrates the manufacture of towel base sheets using blades having alternating undulatory patterns. Towel base sheets were made from a furnish containing 50% Northern Softwood Kraft, 50% Northern Hardwood Kraft. Sixteen pounds of wet strength resin per ton of pulp was added to the furnish. Base sheets were made at several strength levels, with the strength being controlled by refining of the total furnish. In addition to control sheets, which were made by creping the tissue from the Yankee dryer using a square (0° bevel) crepe blade, towel products were also made using several undulatory crepe blades. All of the undulatory blades had a blade bevel of 25°. One of the blades had an undulation frequency of 20 undulations/inch and an undulation depth of 0.020 inches. Alternative undulating patterns were employed in making the other two undulatory crepe blades. One of the blades had 40 undulations/inch with undulation depths of 0.020 and 0.009 inches alternating. This blade is shown schematically in FIG. 9. The other alternatively undulatory blade used during the trial contained half-inch sections along the length of the blade that alternated between sections that exhibited an undulation frequency of 20 undulations/inch and an undulation depth of 0.020 inches and sections having a 40 undulation/inch undulation frequency and a 0.009 inch undulation depth. A schematic of this blade is shown in FIG. 10. Throughout the examples in this specification, it should be understood that the generators of the indented rake surface are generally perpendicular to the relief surface of the blade unless indicated to the contrary.

Figure 45:
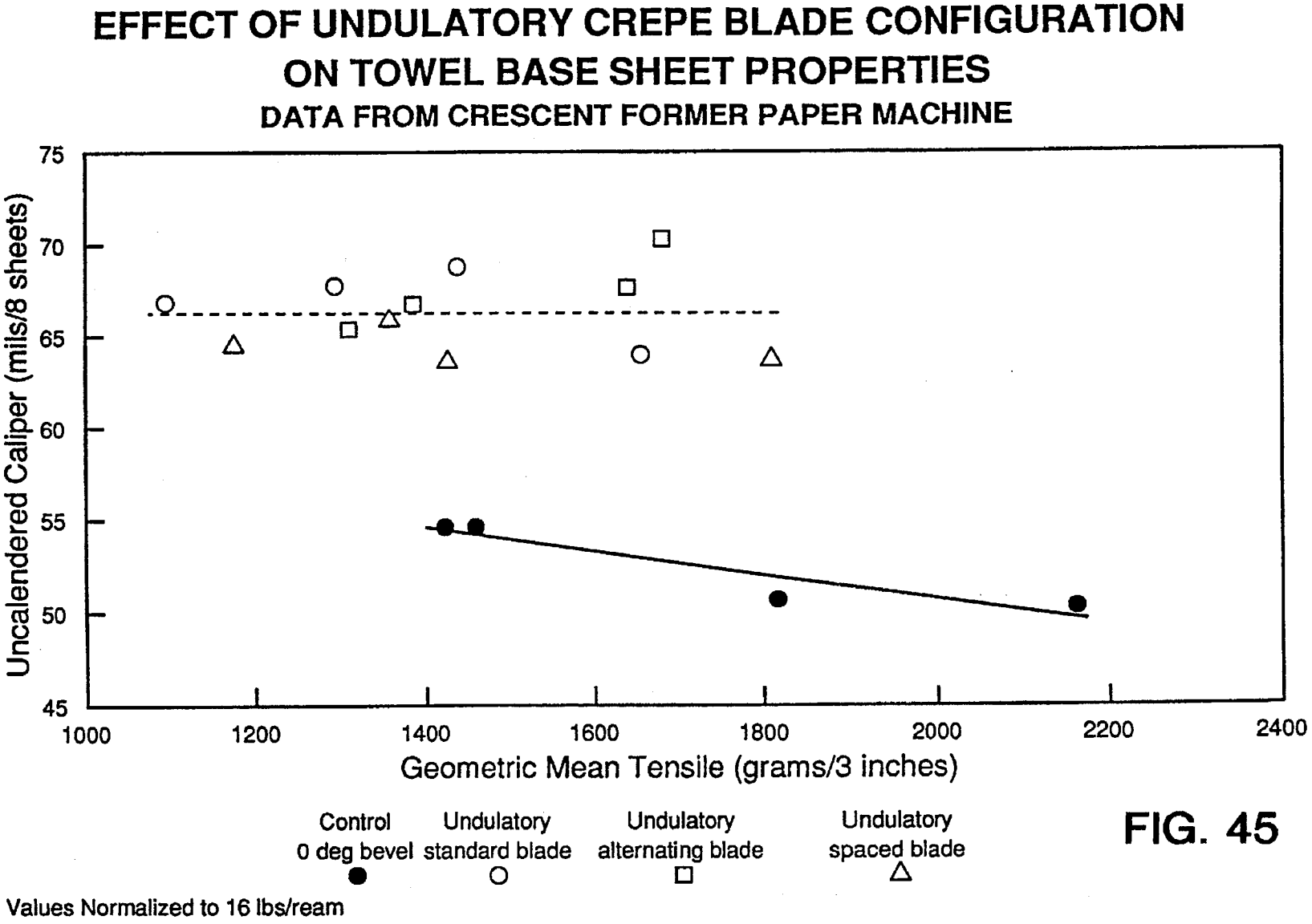
FIGS. 45 and 46 illustrate, respectively, caliper, and absorbency properties of towel base sheet creped using an irregular undulatory creping blade.
Figure 46:
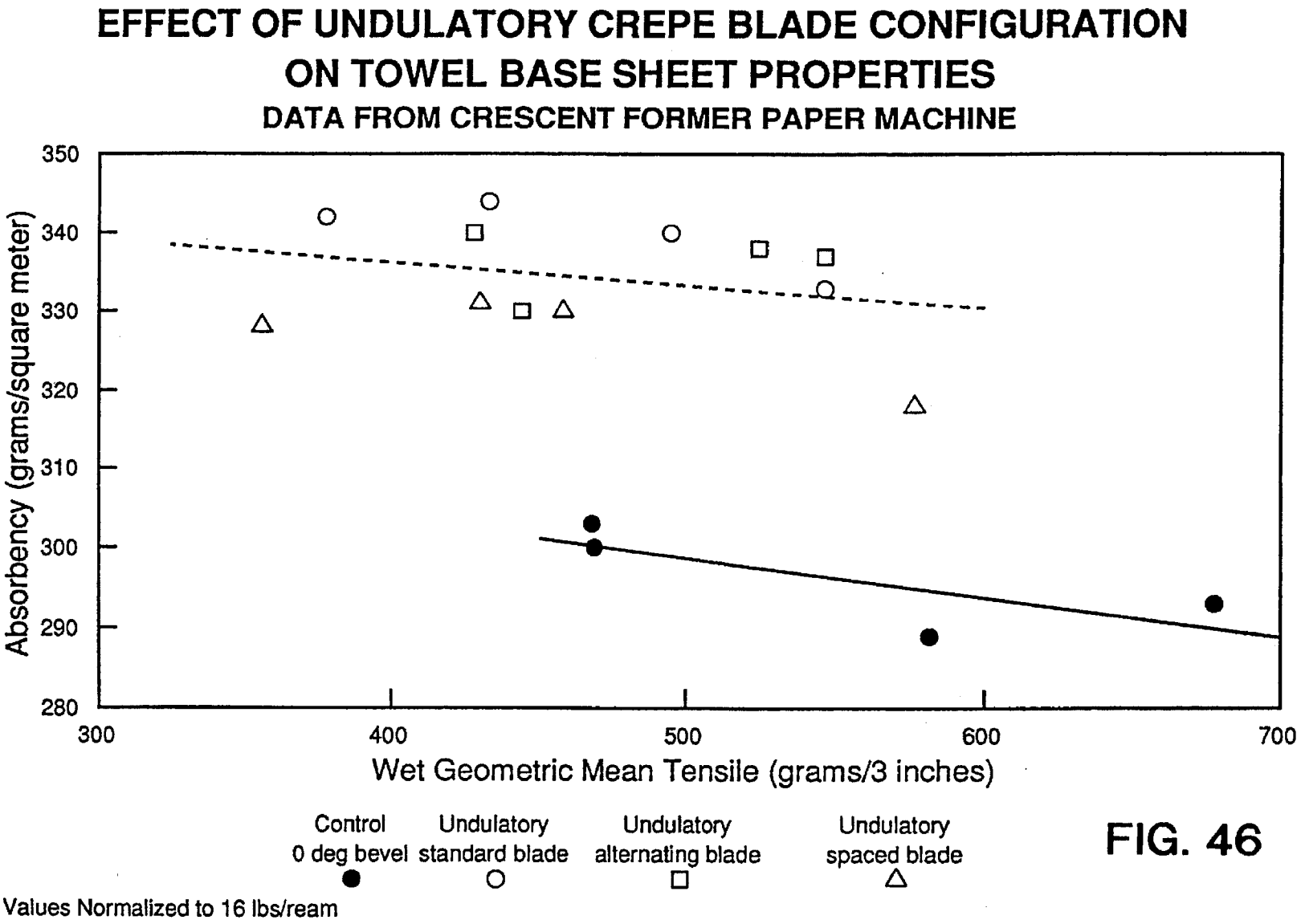

The properties of the base sheets produced by use of these various crepe blades are shown in FIGS. 45 and 46. FIG. 45 shows the base sheet caliper of the products as functions of their dry tensile strengths, while FIG. 46 plots the base sheet's absorbencies against its wet tensile strengths. As the figures show, the base sheets made using the various undulatory crepe blades all have calipers and absorbencies well above those exhibited by the control base sheet at a given level of wet or dry strength. It can also be seen that the sheets produced by the three undulatory crepe blades have similar bulk and absorbency properties, despite the differences in blade geometry.

Figure 47:
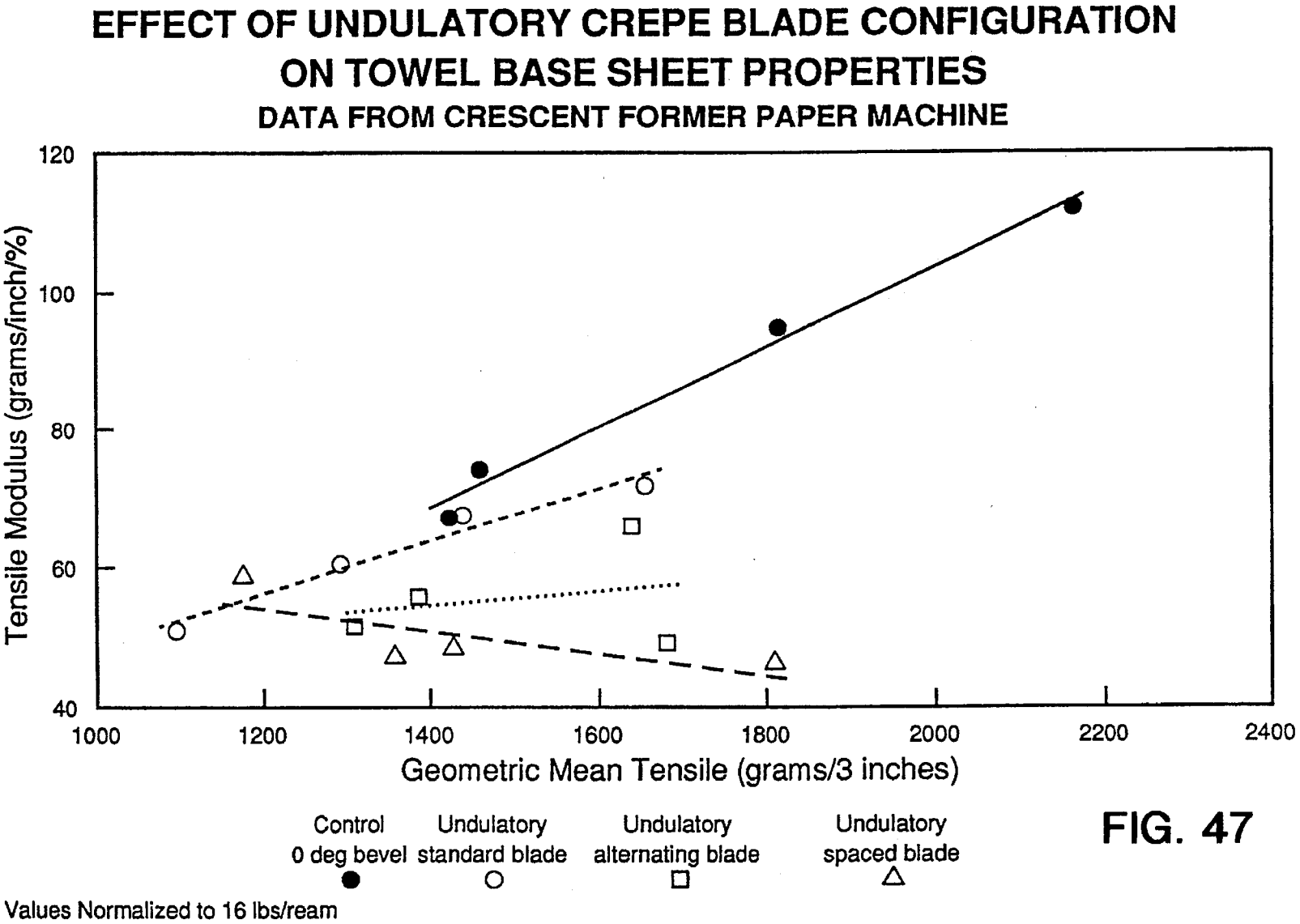
FIGS. 47 and 48 illustrate tensile modulus and friction deviation of towel base sheets. The results show that using an alternating or interleaved irregular undulatory creping blade, soft base sheets are produced without the loss of thickness or absorbency.
Figure 48:
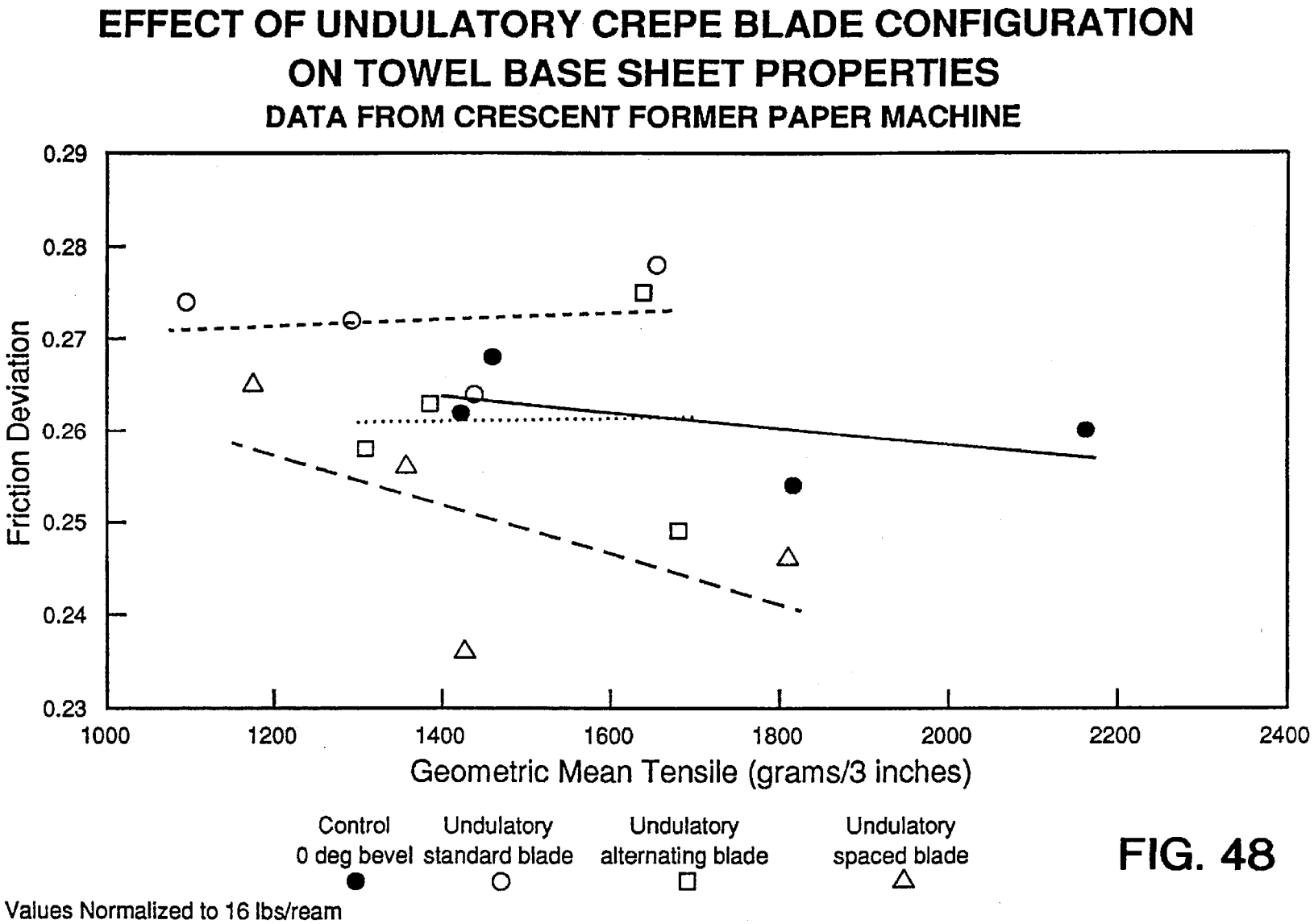

FIGS. 47 and 48 show the values of tensile modulus and friction deviation of the sheets made using the control and undulatory blades as functions of their tensile strength. In FIG. 47 it can be seen that the base sheets made using the undulatory blades all tend to have tensile moduli equal to or less than those made using the standard blade, and that the lowest modulus values are achieved by base sheets creped using the undulatory blades employing the alternating undulatory pattern. In FIG. 48 it can be seen that the base sheet made using the undulatory blade with a 20 undulation/inch frequency and 0.020-inch undulation depth has a slightly higher friction deviation than the control, while the blades made using the alternating undulatory pattern geometry produce base sheets that have friction deviation values that are essentially equal to or lower than those produced by the control blade.

efite pulp. Twelve pounds of wet strength resin per ton of fiber was added to the furnish. The sheets were made at a machine (Yankee) speed of 50 ft/min and a 15% crepe. The target basis weight was 24 lbs/ream. The base sheets were partially dried to one of several selected levels on the Yankee dryer, creped in the partially dried state, and dried to the final desired solids level using conventional can dryers.

Three crepe blades were used in creping the product; a conventional 15° blade and two undulatory blades. Both of the undulatory blades had a 15° blade bevel. One of the undulatory blades had 20 undulations per inch and an undulation depth of 0.020 inches. The other undulatory blade had 12 undulations per inch at an undulation depth of 0.025 inches. Both of these blades were dressed (as shown in FIG. 6B) such that the blade's "foot" was completely removed, leaving a flat surface on the back (Yankee) side of the blade.

The physical properties of the base sheets are shown in Table 19. From the table, it can be seen that use of the undulatory blades results in increased base sheet caliper for the sheets creped at 67 and 76% solids. It is our experience that absorbency in this type of product generally follows caliper. Although no gain in specific caliper was seen for the sheets creped at 54% solids using the undulatory crepe blade, machine direction ridges resulting from the sheet's contact with the blade's undulations were observed in the sheet. It can be seen from the table that the gain in specific caliper resulting from use of the undulatory crepe blade increases with increasing creped solids content.

TABLE 19

Wet-Crepe Towel Trial Using Undulatory Crepe Blade

| Crepe Blade Type | Pulp Freeness CSF | % Solids at Crepe Blade | Caliper/ Basis Weight | Dry GM Tensile/ Basis Weight | Wet GM Tensile/ Basis Weight |
|---|---|---|---|---|---|
| Standard: 15 deg bevel | 470 | 54 | 2.36 | 248.2 | 72.7 |
| Undulatory: 15 deg bevel, 20 undulations/inch, 0.020" deep | 470 | 54 | 2.38 | 243.2 | 72.9 |
| Undulatory: 15 deg bevel, 12 undulations/inch, 0.025" deep | 470 | 54 | 2.30 | 236.5 | 70.7 |
| Standard: 15 deg bevel | 580 | 67 | 2.47 | 185.1 | 54.5 |
| Undulatory: 15 deg bevel, 20 undulations/inch, 0.020" deep | 580 | 67 | 2.75 | 169.2 | 52.9 |
| Undulatory: 15 deg bevel, 12 undulations/inch, 0.025" deep | 580 | 67 | 2.93 | 179.0 | 52.7 |
| Standard: 15 deg bevel | 380 | 76 | 1.82 | 296.7 | 87.5 |
| Undulatory: 15 deg bevel, 20 undulations/inch, 0.020" deep | 380 | 76 | 2.25 | 262.8 | 78.7 |
| Undulatory: 15 deg bevel, 12 undulations/inch, 0.025" deep | 380 | 76 | 2.57 | 272.7 | 83.0 |

As both tensile modulus and friction deviation are inversely related to sheet softness, the results of this trial suggest that use of these alternating undulatory patterns may be used to produce softer base sheets without sacrificing thickness or absorbency.

EXAMPLE 22

This example illustrates the preparation and properties of wet crepe towel base sheet. Towel base sheets were made using the wet crepe process. The furnish contained 60% secondary fiber, 20% Western Softwood Kraft, 20% magn- Two of these sheets were analyzed for free-fiber ends (FFE) in the same manner as described in Example 7. The first was the sheet creped using the control blade that had been dried to 76% solids prior to creping. The second was the sheet creped using the undulatory blade having 12 undulations/inch which had been dried to 76% solids prior to creping. The results of this analysis showed a FFE count of 4.3 free-fiber ends/1.95 mm length of tissue for the base sheet made using the undulatory blade versus a count of 3.2 free-fiber ends/1.95 mm for the sheet made using the standard creping blade. This larger number of free-fiber ends for the product made using the undulatory crepe blade might be considered to aid the surface softness perception of the towel product.

Photomicrographs (16× magnification) of both sheet surfaces of the two base sheets that were analyzed for FFE are shown in FIG. 14. FIGS. 14A and 14B show the Yankee and air sides respectively of the sheets made using the undulatory crepe blade, while the Yankee and air sides of the sheet made using the control crepe blade are shown in FIG. 14C. These figures clearly show the machine-direction ridges present in the sheet creped using the undulatory blade. The crepe frequency for the two base sheets can be seen in FIGS. 14A and 14C, which show the sheets' Yankee sides. From the figures it can be seen that the spacing of crepe lines for both sheets is similar, indicating the use of the undulatory crepe blade did not significantly alter the sheet's crepe frequency.

EXAMPLE 23

This example illustrates the applicability of the undulatory blade creping process to through air drying (TAD) processes for the manufacture of tissue and towel. Tissue and towel base sheets were made on a pilot paper machine. The furnish for both products was 50% Northern Softwood Kraft, 50% Northern Hardwood Kraft. The tissue sheets were made at a target basis weight of 18 lbs/ream. The weight target for the towel sheets was 15 lbs/ream. Wet strength resin was added to the towel furnish at a level of 12 lbs of resin per ton of fiber. The dry strength of the tissue base sheets was controlled by addition of starch to the furnish. Refining of the entire furnish was used to control the towel furnish strength.

The sheets were formed on an inclined wire former, transferred to a through-air-drying fabric, partially dried using a through-air-dryer (TAD), and then pressed onto a Yankee dryer for completion of drying. The fabric used to transport the sheet through the TAD and press it against the Yankee dryer had a weave of 44 strands/inch in the machine direction by 38 strands in the cross direction. The machine direction strands were 0.01375 inches in diameter while the diameter of the cross direction strands was 0.01575 inches. Use of this fabric to transfer the sheet to the Yankee dryer resulted in a non-uniform pressing of the sheet against the dryer. The moisture level of the sheets exiting the TAD was in the range of 29 to 38 percent for the towel product, 38 to 47 percent for the tissue sheets.

Most of the sheets were creped from the Yankee dryer using a standard crepe blade having a bevel of 8°. For some of the products, an undulatory crepe blade was also employed. A blade having a 15° blade bevel, 20 undulations/inch, and an undulation depth of 0.020" was employed on one of the towel base sheets. For the tissue sheets, this same blade and another undulatory crepe blade, having a blade bevel of 15°, an undulation frequency of 12 undulations/inch, and a 0.032" undulation depth were employed.

Figure 49:
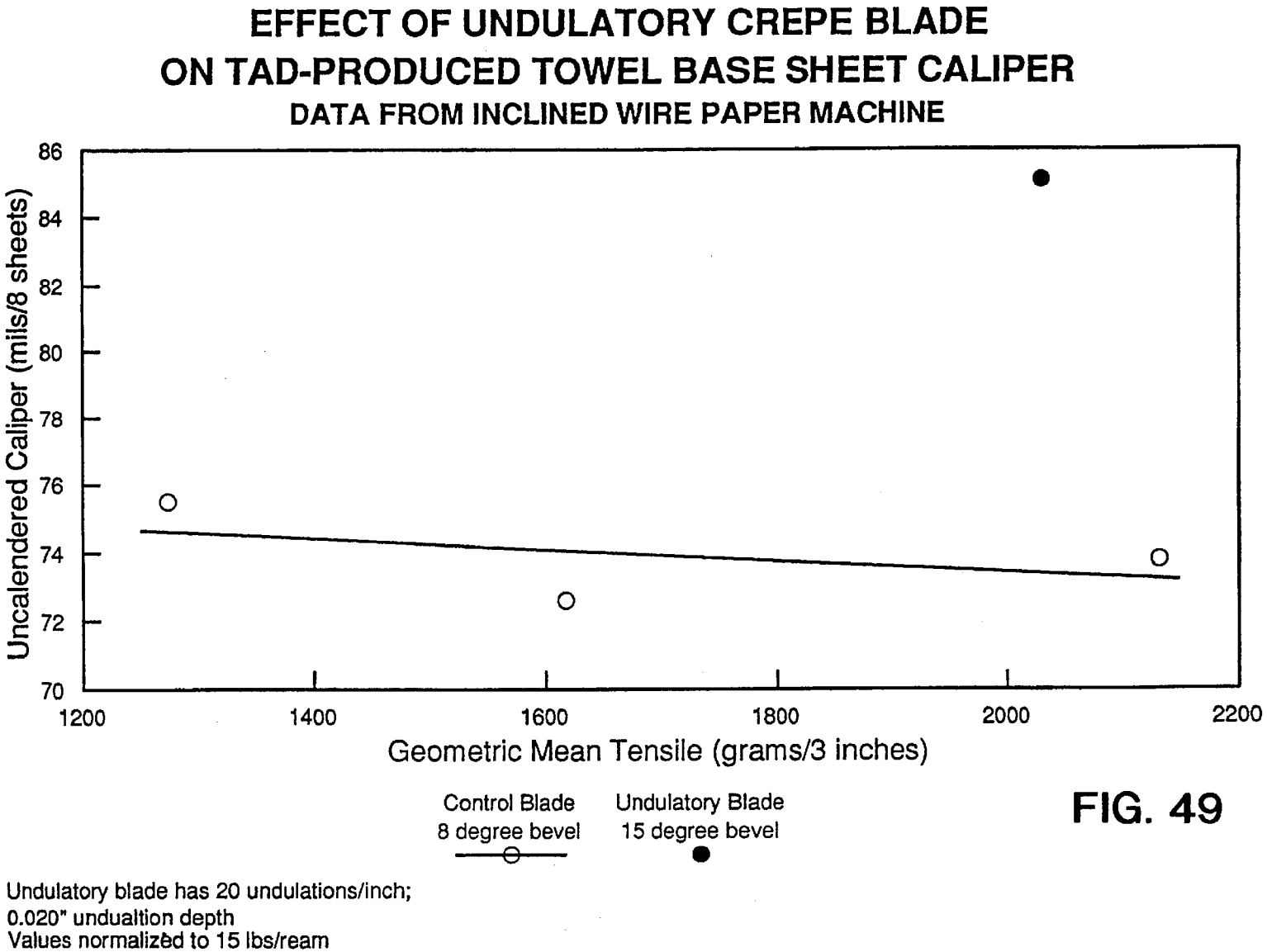
FIG. 49 illustrates the caliper of towel base sheet manufactured using the Through Air Drying (TAD) process and creped using an undulatory creping blade in comparison to towel creped using a conventional blade.
Figure 50:
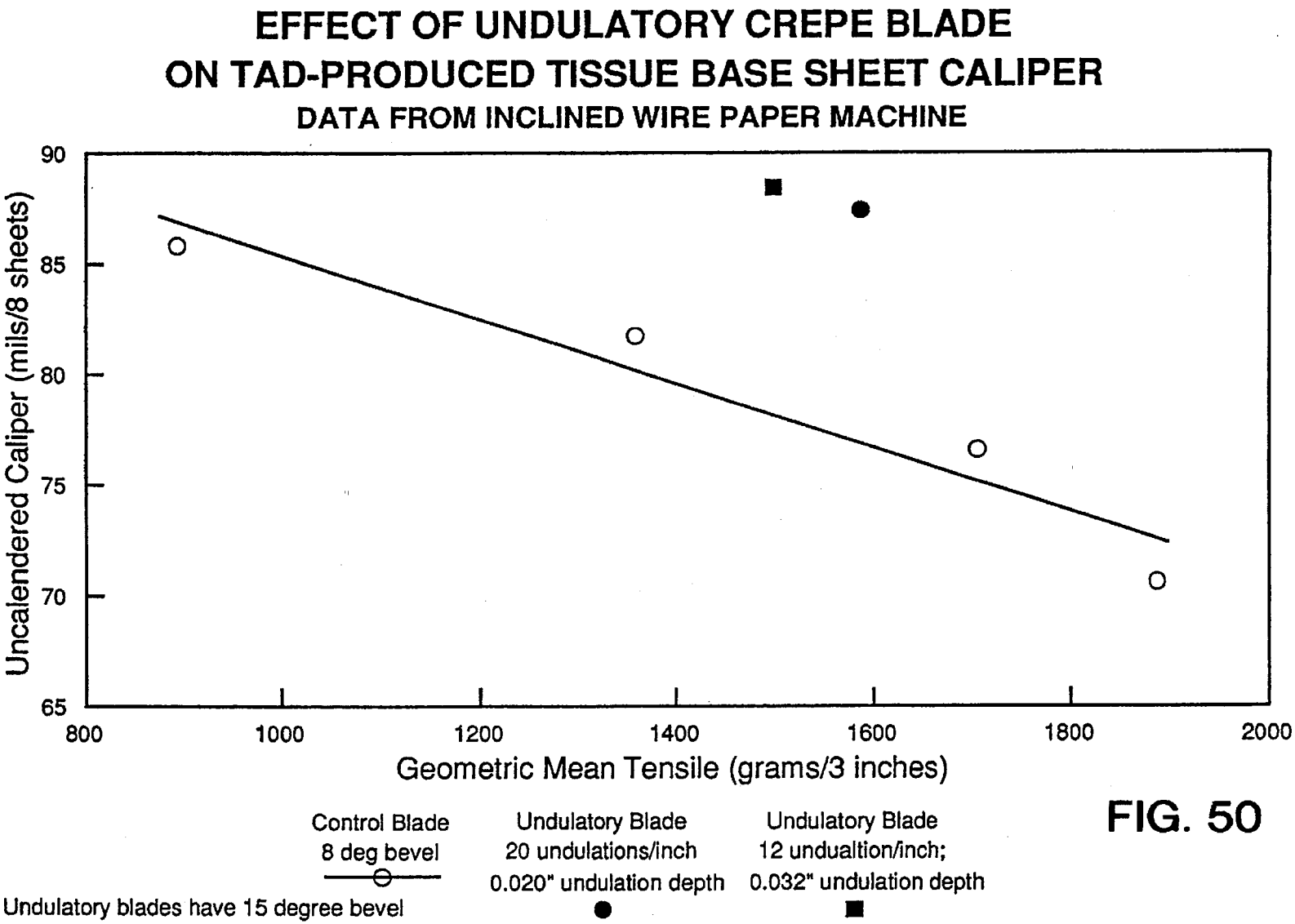
FIG. 50 shows the effect of undulatory creping blade on a TAD tissue produced base sheet.
Figure 51A:
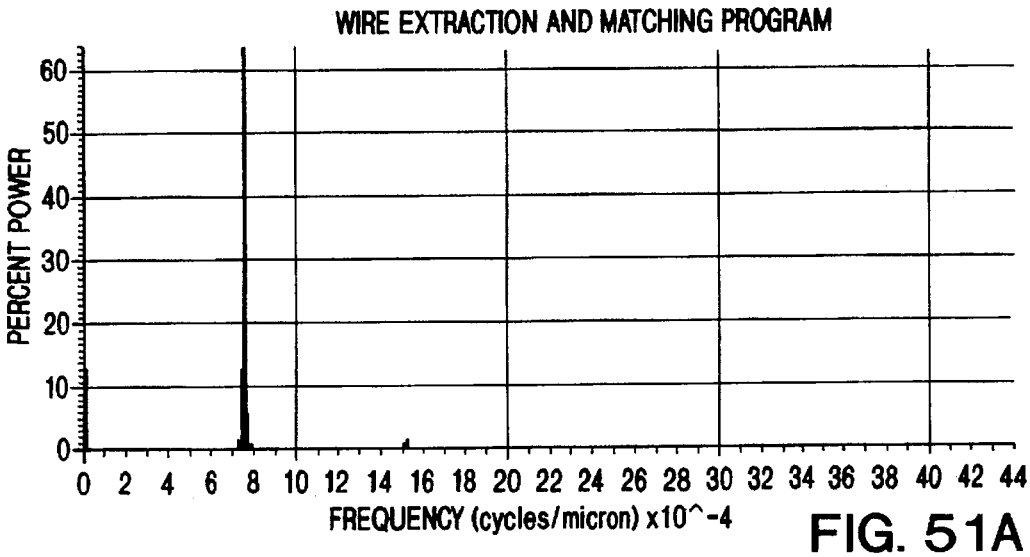
FIGS. 51A–51F illustrate results of Fourier analysis of webs creped using an undulatory creping blade as compared to webs creped using a blade following the teachings of Fuerst.
Figure 51B:
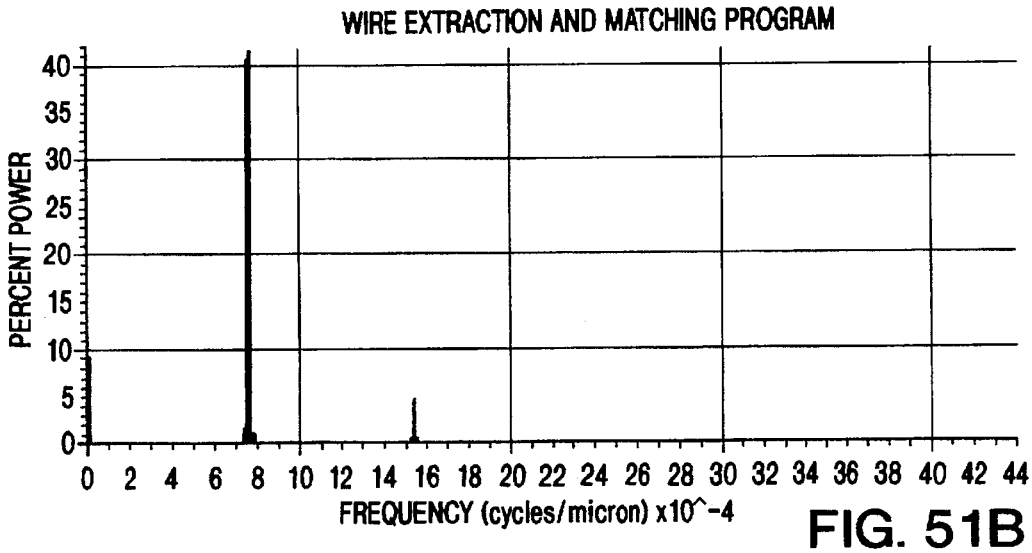
Figure 51C:
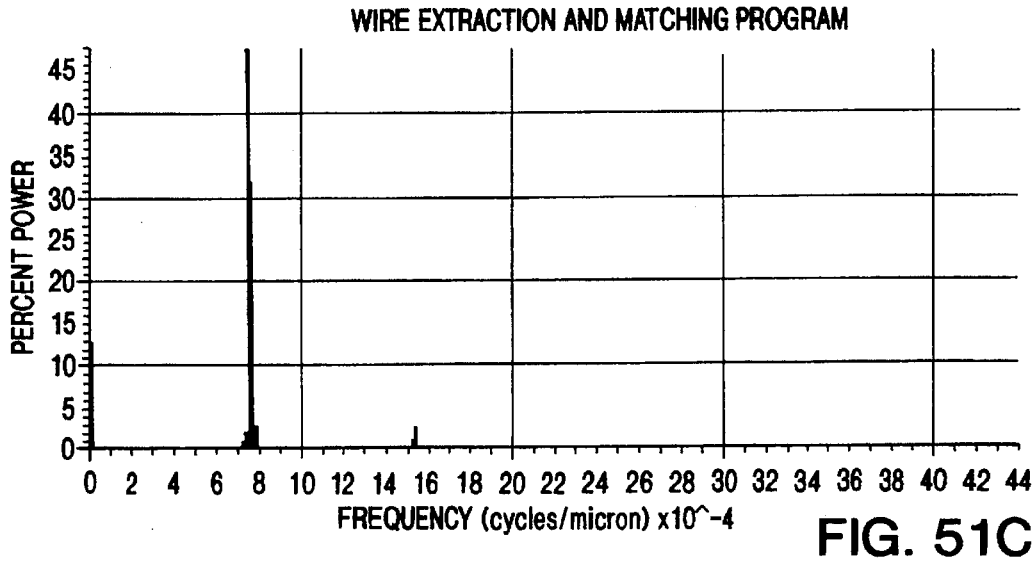
Figure 51D:
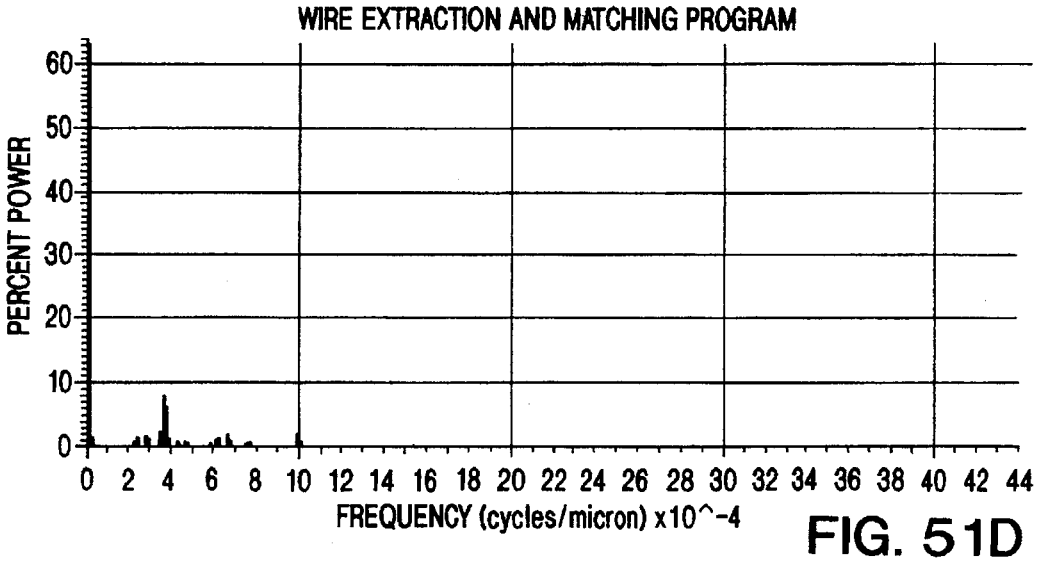
Figure 51E:
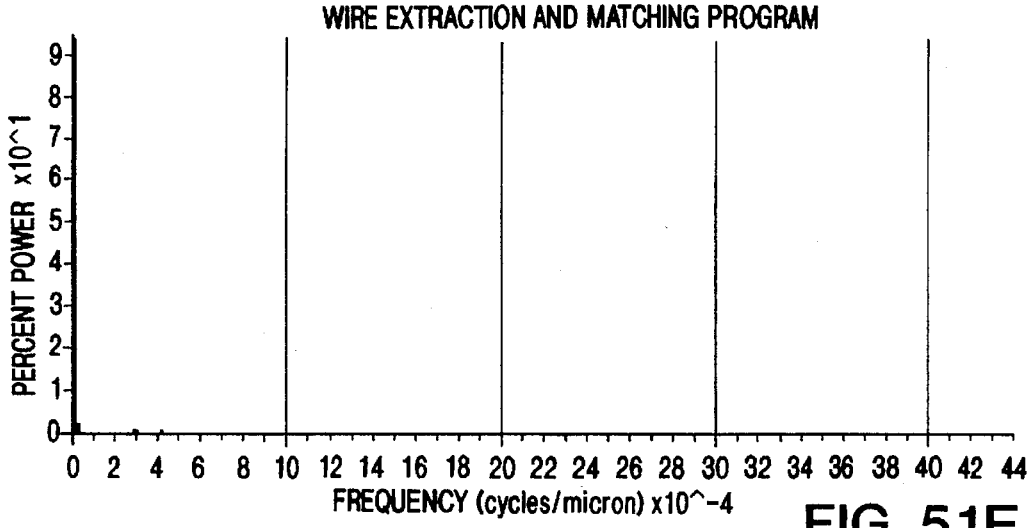
Figure 51F:
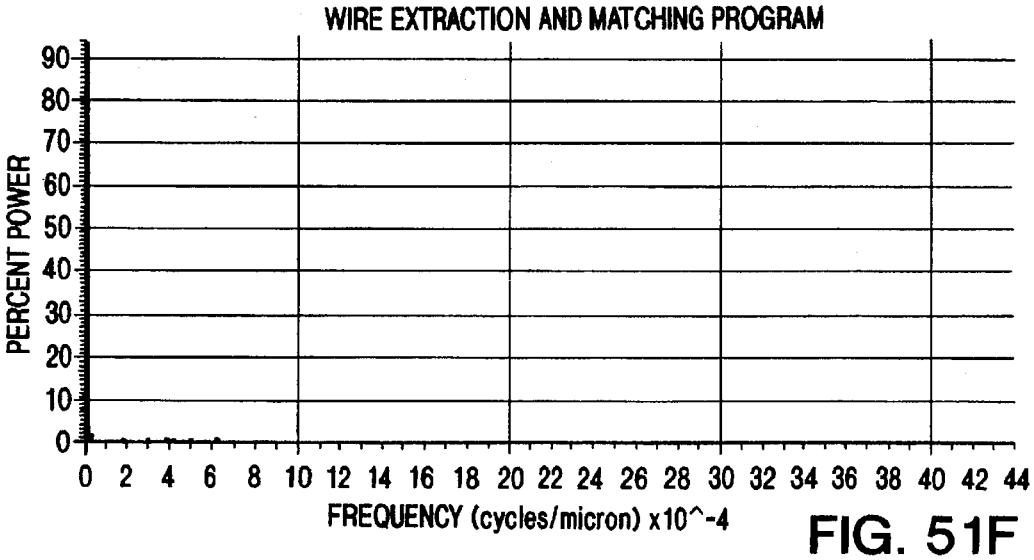

The results of physical tests performed on these base sheets are shown in FIGS. 49 and 50 which plot the base sheets' uncalendered calipers as a function of the sheets' tensile strength. From the graphs it can be seen that the use of the undulatory crepe blades increased the base sheet caliper approximately 10 to 15 percent.

EXAMPLE 24

This example illustrates various undulatory blades some having a foot; others having flush dressing used on light and heavy tissue base sheets for single- and two-ply tissues. Single- and two-ply-weight base sheets were made using undulatory crepe blades. The single-ply product was made using a 25° beveled blade that had been knurled at a spacing of 20 undulations/inch and a depth of 0.020 inches. The base sheet made at the two-ply weight was creped using a blade having a bevel of 15°, 20 undulations/inch, and a 0.020-inch undulation depth. Both the single- and two-ply sheets were calendered while on the paper machine. The details of the sheets' furnish and physical properties are shown in Table 20. For both of the products, base sheet samples were generated using undulatory blades that were dressed to leave a relieved foot ("relief dressing") and also using blades that had been dressed "flush". The relief dressed blades were treated such that the relieved "burr" or "foot" that is produced on the back side of the blade during the knurling process is shaped at an angle equal to the blade angle when the blade is in use (See FIG. 6A). For the blades having the flush dressing (FIG. 6B), this foot was completely removed, leaving a blade that was completely flat across its back (Yankee) side.

The single-ply-weight product ran well using both the blade that had received the relieved dressing and the blade for which the foot had been removed. It was observed that the pattern of machine direction ridges produced by the undulatory crepe blade was not as pronounced on the sheet made using the flush-dressed blade as was the case for the product made using the blade that received the relieved dressing leaving the highly relieved foot.

When the product made at the two-ply basis weight was run using the flush-dressed blade, the sheet ran for approximately five minutes before suffering a break after the crepe blade. Several efforts to rethread the sheet and continue winding it were unsuccessful, as the sheet continued to break between the crepe blade and the reel. Finally, the attempts to continue to run using the blade were halted and the flush-dressed crepe blade was replaced with an undulatory blade that had been dressed using the relieved dressing technique leaving a relieved foot. Use of this blade allowed the sheet to be threaded and wound without difficulty.

Comparison of the values in Table 20 indicates that sheets having similar physical properties can be made using undulatory crepe blades that employ either the relieved or flush dressing technique. There is some indication that the blade that has been flush dressed may produce a base sheet that has slightly lower specific caliper and higher strength than will result from use of a blade made using the relieved dressing technique. However, from the standpoint of runnability, especially for lighter-weight products, it appears that the relieved dressing technique offers an advantage over the flush-dressing method. In addition to operational advantages, the relief-dressed blade offers the additional benefit of being much easier and faster to prepare than the flush-dressed blade. This consideration is particularly important when the time and effort needed to flush dress a blade to be used in a wide commercial tissue machine is considered.

TABLE 20

| Undulatory Crepe Blade Study | | | | |
|---|---|---|---|---|
| Product | Single-Ply Weight | | Two-Ply Weight | |
| Furnish | 52% NHWK; 28% NSWK; 20% Broke | | 65% NHWK; 35% NSWK | |
| Calendering Load (pli) | 9.6 | | 10.8 | |
| Blade Dressing | Relieved | Flush | Relieved | Flush |
| Basis Weight (lbs/ream) | 17.4 | 17.4 | 9.3 | 9.4 |
| Caliper (mils/8 sht) | 61.0 | 57.5 | 32.8 | 31.5 |
| Specific Caliper (mils/8 sheets/lb basis weight) | 3.51 | 3.30 | 3.53 | 3.35 |
| MD Tensile (grams/3") | 952 | 968 | 524 | 573 |
| CD Tensile (grams/3") | 446 | 482 | 223 | 271 |
| MD Stretch (%) | 30.3 | 29.8 | 16.4 | 18.2 |
| CD Stretch (%) | 6.6 | 6.2 | 6.7 | 7.7 |

For the single-ply-weight product only, an attempt was also made to produce tissue using a beveled, undulatory blade that had been dressed such that not only had the foot been completely removed, but also that the back (Yankee) side of the blade had been beveled at an angle equal to that of the blade angle when it contacts the Yankee dryer (reversed relieved dressing, FIG. 6C). This blade, prior to dressing, was a 25° beveled blade and had been knurled at a frequency of 20 undulations/inch at a depth of 0.020 inches.

Attempts to manufacture a single-ply base sheet using this blade were not successful, as the sheet had numerous holes that prevented it from being wound.

Single-ply base sheets made using the relieved and flush dressed blades from the above trial were embossed using a spot emboss pattern at an emboss depth of 0.075". Embossed product was produced both from base sheets made using the relief dressed undulatory blade and from sheets that had been made using the blade that had been flush dressed. The physical properties for these two finished products are shown in Table 21. The similar values for the physical properties of both of the rolls indicate that the mode of blade dressing did not significantly affect the embossed product quality.

TABLE 21

| Undulatory Crepe Balde Study - Embossed Product | | |
|---|---|---|
| Product | Single-Ply Weight | |
| Furnish | 52% NHWK; 28% NSWK; 20% Broke | |
| Emboss Depth (inches) | 0.075 | |
| Blade Dressing | Relieved | Flush |
| Basis Weight (lbs/ream) | 16.54 | 17.21 |
| Caliper (mils/8 sht) | 67.3 | 67.8 |
| Specific caliper (mils/8 sheets/lb basis weight) | 4.07 | 3.94 |
| MD Tensile (grams/3") | 777 | 832 |
| CD Tensile (grams/3") | 330 | 353 |
| MD Stretch (%) | 22.2 | 21.7 |
| CD Stretch (%) | 6.5 | 6.1 |
| Tensile Modulus (gr/in/%) | 11.8 | 12.5 |
| Friction Deviation | 0.204 | 0.198 |

EXAMPLE 25

The Example illustrates a suitable knurling procedure for construction of undulatory blades of the present invention having the following characteristics:

width "δ": of crescent shaped region 0.008–0.025"
depth "λ": 0.008–0.050"
span "σ": 0.01–0.095"
low linear elongated regions of width "ε": 0.005–0.012"
length "l": 0.002–0.084"

Figure 53:
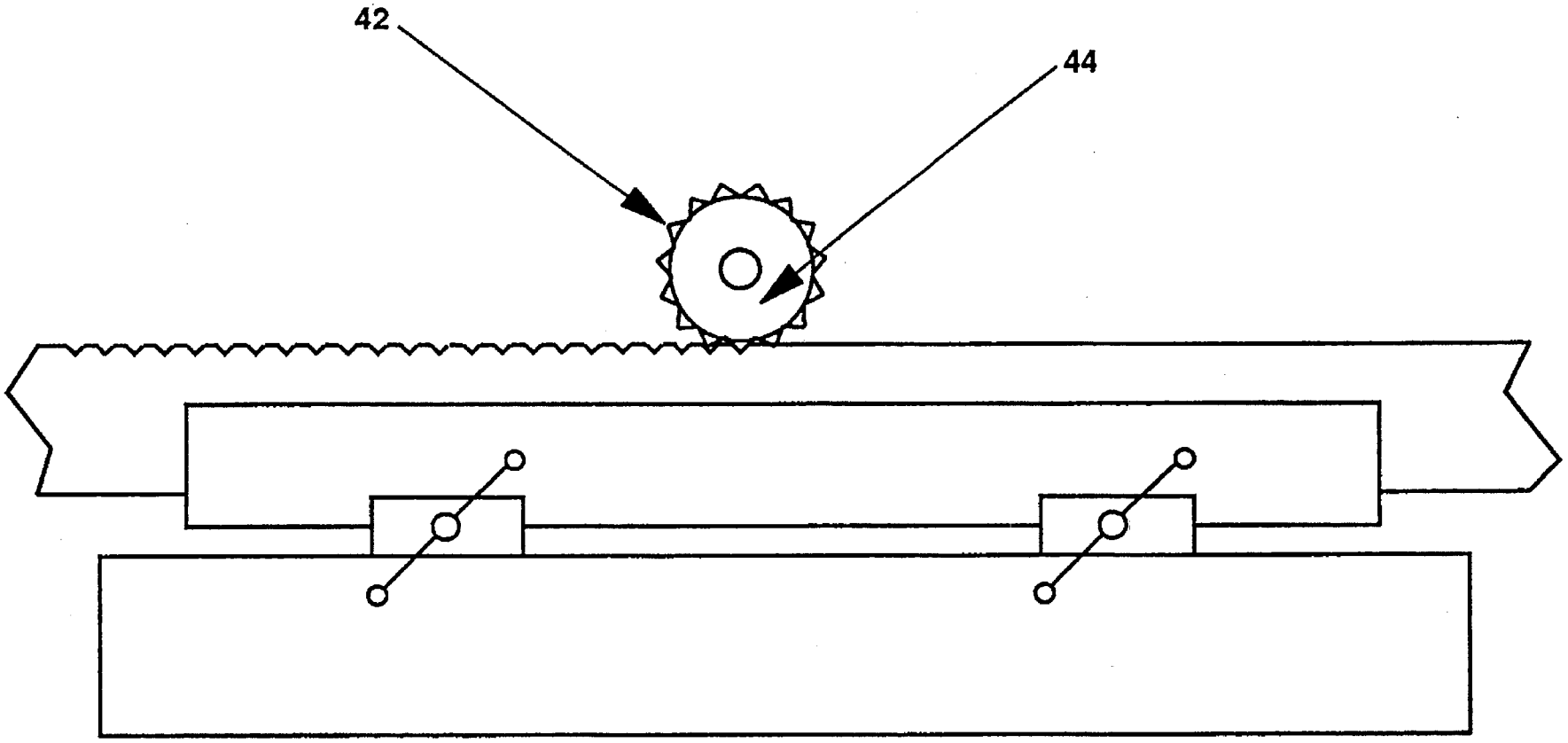
FIGS. 53, 54A and 54B illustrate a process for manufacture of undulatory creping blades.

For the knurling tool itself, as illustrated schematically in FIG. 53, we prefer steel containing about 5% cobalt and hardened to hardness $R_c$ of about 65–67, although less expensive alloys are also suitable, as for example, alloys having $R_c$ of 63–65 as compared to the blade usually having a harness of around 42 Rockwell 'C'. As starting material, it may be convenient to use a standard blade having any desired bevel angle, typically falling in the range of 0° to 50°, and comprised of 1075 steel, or some other steel commonly used for creping blades. A 15° bevel angle is quite suitable for many applications.

The knurling tool, rotatably supported in a clevis so that the tool can spin about a horizontal axis, is fixed in position above the rake surface of the blade. Heavy pieces of steel are secured around the blade to prevent the body blade from being deformed by the forces necessary to knurl the cutting edge of the blade and form the serrulations by displacing metal. Care should be taken that the blade is supported well both laterally and vertically as the forces required for knurling can easily ruin an unsupported blade.

With the knurling tool supported solidly, the blade is brought into contact with the knurling tool. To begin the knurling process, the blade is put in motion longitudinally with respect to the knurling tool and the blade rake surface while the blade is slowly raised by a distance equal to the desired undulation depth "easing" the knurl into the blade over about 1" of longitudinal travel of the blade.

Once the knurl is into the blade to the desired depth, the blade is moved with respect to the knurling tool at a moderate speed, 12 inches per minute table speed being satisfactory. At the end of the travel, the direction of movement of the blade is reversed and the knurl is brought back to approximately its starting position. At this point the blade is separated away from the knurling tool and is un-clamped. The above described process can be used over the entire blade length or repeated in a piecemeal fashion until the blade is knurled along its entire length. The knurling process increases the microhardness near the base of the serrulation by about 3–6 points on the Rockwell 'C' scale.

Figure 54B:
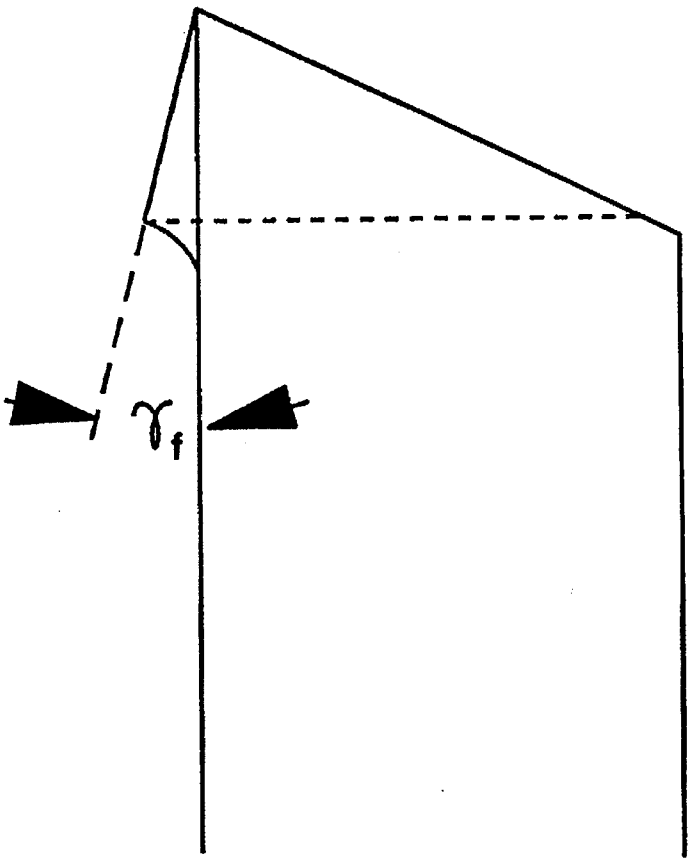
Figure 54A:
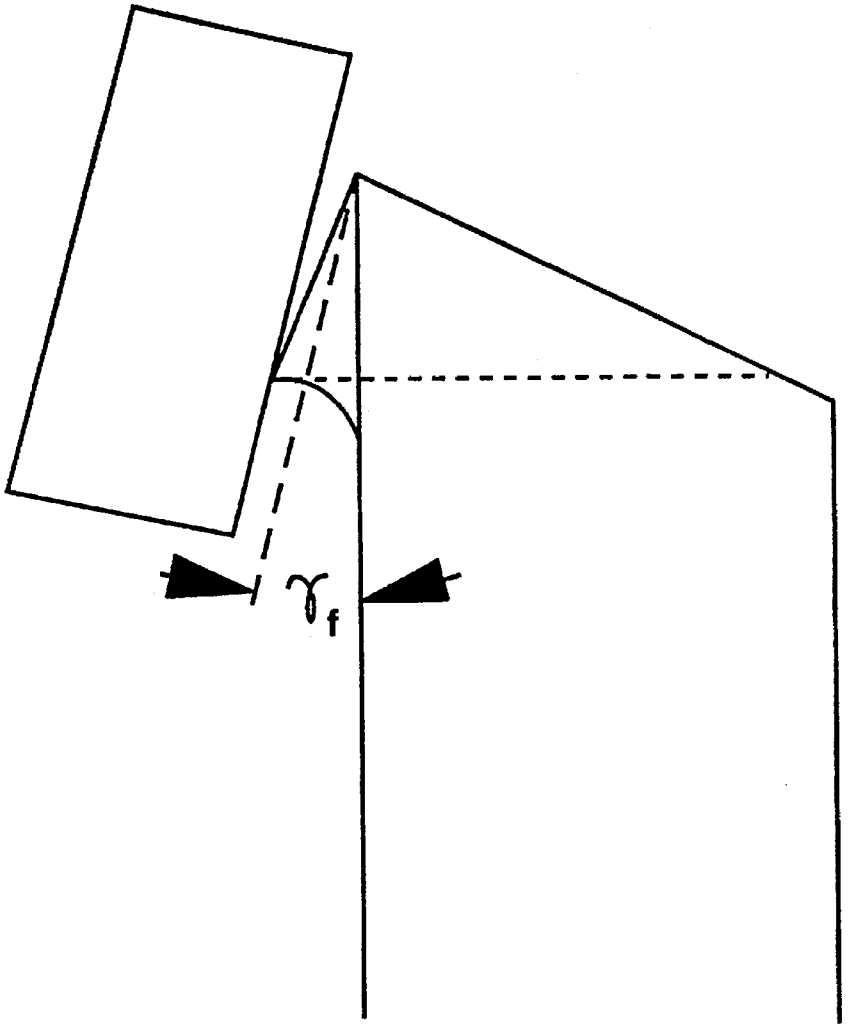

The blade may be finished according to the following procedure:

The blade is set up in a blade dressing holder and a coarse hard hand stone is used to take off the bulk of the burr on the high side (or Yankee side) of the bevel, the stone is held against the burr at the same angle the blade makes with the dryer. A small piece of metal of appropriate thickness may be laid along the blade as a guide to help maintain the correct stone angle and ensure that a foot having the proper height remains on the relief side of the blade. Once the bulk of the burr has been removed, the final finish is applied by hand polishing. Conveniently, a small block wrapped with 120 grit emery cloth may be used for the initial polish while 180 grit is used for the final polish with only enough metal being removed to produce a surface having the shape shown in FIG. 54B and maintain the requisite angle.

EXAMPLE 26

This example compares a two-ply towel product made from base sheets creped using the undulatory crepe blade to a product made from base sheets made using a conventional crepe blade. Towel base sheets were made on a crescent-former paper machine. The towels' furnish was composed of 70% Southern Hardwood Kraft, 30% Southern Softwood Kraft. Base sheets were made using both a conventional (square) crepe blade and an undulatory crepe blade. The control sheet that was made using the square blade had 8 lbs of wet-strength resin Kymene® 557H per ton of pulp added to the furnish. The towel base sheet made using the undulatory crepe blade had wet-strength resin Kymene® 557H added to the sheet at a level of 12 lbs/ton of pulp. The undulatory blade employed to crepe the product had a 25 degree bevel, a 16 undulations/inch undulation frequency, and an undulation depth of 0.020 inches. The physical properties of the base sheets are shown in Table 22.

The base sheets were embossed to provide finished two-ply towel products. The emboss depth for the control product was 0.090 inches while the base sheets produced using the undulatory crepe blade were embossed at a depth of 0.098 inches. The emboss depths were chosen so that both products would have approximately equal cross directional wet tensile strength. Embossing in this fashion negated the benefits of undulation. The properties of the embossed products are also shown in Table 22.

TABLE 22

Physical Properties of Towel Base Sheet and Embossed Towel Products

| | Base Sheet | | Embossed Product | |
|---|---|---|---|---|
| Crepe Blade Type | Control | Undulatory | Control | Undulatory |
| Basis Weight (lb/ream) | 16.5 | 17.0 | 31.8 | 31.3 |
| Caliper (mil/8 sheet) | 52.4 | 82.1 | 168 | 168 |
| Specific Caliper (mils/8 sheets/lb basis weight) | 3.18 | 4.83 | 5.28 | 5.37 |
| MD Dry Tensile (gr/3") | 1893 | 1931 | 2850 | 2581 |
| CD Dry Tensile (gr/3") | 1390 | 1452 | 1406 | 1408 |
| MD Wet Tensile (gr/3") | 589 | 658 | 803 | 756 |
| CD Wet Tensile (gr/3") | 335 | 356 | 380 | 399 |
| Absorbency (gr/sq. meter) | — | — | 292 | 322 |
| MD Stretch (%) | 16.2 | 22.2 | 15.5 | 13.0 |
| CD Stretch (%) | 4.1 | 6.6 | 5.7 | 6.9 |
| Tensile Modulus (gram/inch/%) | — | — | 55.1 | 50.5 |
| Friction Deviation | — | — | 0.306 | 0.337 |

The control and undulatory blade products were placed in Monadic Home Use Tests. The consumers testing these various towels products were asked to rate the product for their overall performance and to rate the product for specific attributes. The products could be rated as "Excellent", "Very Good", "Good", "Fair", or "Poor". The sum of the percentage of consumers that rated a product as either "Excellent" or "Very Good" are shown in Table 23 for the control product and for the product made using the undulatory crepe blade. The results indicate that the two products were preferred about equally both for overall performance and for most important attributes.

TABLE 23

Monadic Home-Use-Test Results Percentage of Consumers Rating a Product Excellent or Very Good

| | Crepe Blade Type | |
|---|---|---|
| | Control | Undulatory |
| Overall rating | 73 | 74 |
| Absorbing quickly | 75 | 77 |
| Absorbing a lot | 82 | 79 |
| Not tearing or falling apart when wet | 80 | 75 |
| Strength | 79 | 79 |
| Softness | 60 | 62 |
| Thickness | 77 | 80 |
| Not leaving lint | 72 | 69 |

As our invention, we claim:

1. A serrulated creping blade comprising:

an elongated, relatively rigid, thin plate, the length of the plate being substantially greater than the width of said plate and the width of said plate being substantially greater than the thickness thereof, said plate having:

a serrulated engagement surface formed along the length of an elongated edge of said plate, said serrulated engagement surface being adaptable to be engaged against the surface of a Yankee drying cylinder, said serrulated engagement surface constituting a spaced plurality of relieved nearly planar crescent-shaped bands of width "$\delta$", depth "$\lambda$" and span "$\sigma$" interspersed with, and inter-connected by, a plurality of substantially co-linear rectilinear elongate regions of width "$\epsilon$" and length "l", the width "$\epsilon$" of the substantially rectilinear elongate regions being substantially less than the width "$\delta$" of the nearly planar crescent-shaped bands of the serrulated engagement surface wherein the width "$\delta$" is about 0.008 to about 0.025 inches, the depth "$\lambda$" is about 0.008 to about 0.050 inches, the span "$\sigma$" is about 0.01 to about 0.095 inches, the width "$\epsilon$" is about 0.005 to about 0.012 inches and the length "l" is about 0.002 to about 0.084 inches;

a rake surface defined upon said plate extending across the thickness of said plate and adjoining said serrulated engagement surface, wherein an axial rake angle defined by a first portion of said rake surface adjacent each of said relieved nearly planar crescent-shaped bands is substantially 0° and an axial rake angle defined by a second portion of said rake surface adjacent each of said relieved nearly planar crescent-shaped bands is between about 15° and 75°; and a relief surface defined upon said plate extending across the width of said plate and adjoining said serrulated engagement surface, wherein adjacent each of said relieved nearly planar crescent-shaped bands a foot having a height of at least about 0.001 inch protrudes from said relief surface.

2. The serrulated creping blade of claim 1 wherein the creping angle defined by the portion of said rake surface adjacent each of said substantially co-linear rectilinear elongate regions is between about 30° and 135° and the creping angle defined by the portion of said rake surface adjacent each of said nearly planar crescent-shaped bands is between about 15° and 135°.

3. The serrulated creping blade of claim 1 wherein the relief angle of the relieved nearly planar crescent-shaped bands is greater than the relief angle of said substantially co-linear rectilinear elongate regions.

* * * * *